US009878560B2

(12) United States Patent
Makuta et al.

(10) Patent No.: US 9,878,560 B2
(45) Date of Patent: Jan. 30, 2018

(54) INKJET RECORDING METHOD USING NOZZLE ARRAYS AND PRINTED MATERIAL OBTAINED BY THE INKJET RECORDING METHOD

(71) Applicant: FUJIFILM CORPORATION, Tokyo (JP)

(72) Inventors: Toshiyuki Makuta, Kanagawa (JP); Yasuhiko Kachi, Kanagawa (JP); Kazuo Sanada, Kanagawa (JP); Hirofumi Saita, Kanagawa (JP); Kazuaki Okamori, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 1201 days.

(21) Appl. No.: 13/962,783

(22) Filed: Aug. 8, 2013

(65) Prior Publication Data

US 2014/0062076 A1 Mar. 6, 2014

(30) Foreign Application Priority Data

Aug. 29, 2012 (JP) ..... 2012-189067

(51) Int. Cl.
*B41J 11/00* (2006.01)
*B42D 15/00* (2006.01)

(52) U.S. Cl.
CPC ..... *B41J 11/0015* (2013.01); *B41J 11/002* (2013.01); *B42D 15/0053* (2013.01)

(58) Field of Classification Search
CPC .. B41J 11/0015; B41J 11/002; B42D 15/0053
See application file for complete search history.

(56) References Cited

U.S. PATENT DOCUMENTS 6,027,202 A 2/2000 Narushima
6,113,210 A * 9/2000 Gotoh ..... H04N 1/40087 347/15

(Continued)

FOREIGN PATENT DOCUMENTS

JP H04-118250 A 4/1992
JP H06-155726 A 6/1994

(Continued)

OTHER PUBLICATIONS

The extended European search report dated Nov. 26, 2013, which corresponds to European Patent Application No. 13181806.4-1701 and is related to U.S. Appl. No. 13/962,783.

(Continued)

*Primary Examiner* — Bradley Thies
(74) *Attorney, Agent, or Firm* — Studebaker & Brackett PC

(57) ABSTRACT

An inkjet recording method of the present invention includes preparing an inkjet recording apparatus having an inkjet head that has N (N≥4) nozzle arrays, so as to respectively discharge inks of at least four colors of cyan, magenta, yellow and black, having nozzles arranged in a first direction at a predetermined pitch P for discharging a curable ink which is cured by providing active energy, each of the nozzle arrays is arranged to be shifted in the first direction so as to have distances of more than 0 among each virtual line extending from each nozzle in a second direction perpendicular to the first direction, in which the viscosity of any of the respective inks at 25° C. is 10 to 30 mPa·s.

16 Claims, 11 Drawing Sheets

(56) References Cited

U.S. PATENT DOCUMENTS

| | | | | |
|---|---|---|---|---|
| 2004/0104964 | A1* | 6/2004 | Niekawa | B41J 2/2103 347/40 |
| 2006/0098043 | A1 | 5/2006 | Niekawa | |
| 2008/0033072 | A1* | 2/2008 | Nagase | C07D 407/12 522/169 |
| 2009/0073246 | A1 | 3/2009 | Makuta et al. | |

FOREIGN PATENT DOCUMENTS

| | | | | |
|---|---|---|---|---|
| JP | 2002-036526 | A | | 2/2002 |
| JP | 2002-067317 | A | | 3/2002 |
| JP | 2003-127385 | A | | 5/2003 |
| JP | 2004-174985 | A | | 6/2004 |
| JP | 2005-262570 | A | | 9/2005 |
| JP | 2007-118409 | A | | 5/2007 |
| JP | 2007118409 | A | * | 5/2007 |
| JP | 2010-000691 | A | | 1/2010 |
| JP | 2012-067179 | A | | 4/2012 |
| WO | 1997/037854 | A1 | | 10/1997 |

OTHER PUBLICATIONS

An Office Action; "Notice of Reasons for Rejection," issued by the Japanese Patent Office on Jul. 15, 2014, which corresponds to Japanese Patent Application No. 2012-189067 and is related to U.S. Appl. No. 13/962,783; with English language translation.

* cited by examiner

INKJET RECORDING METHOD USING NOZZLE ARRAYS AND PRINTED MATERIAL OBTAINED BY THE INKJET RECORDING METHOD

BACKGROUND OF THE INVENTION

1. Field of the Invention

The present invention relates to an inkjet recording method and a printed material, and particularly to a technology of forming an image by discharging inks of plural colors.

2. Description of the Related Art

In an inkjet recording apparatus of the related art, an array in which nozzles of each color head are aligned on the same main scan line has been used to share dot positions of inks of respective colors.

In addition, there have been known inkjet recording apparatuses and inkjet heads disclosed in JP2005-262570A, WO1997/037854A, JP2007-118409A, and JP2002-67317A.

In JP2005-262570A, there is disclosed an inkjet recording apparatus, which performs recording using an inkjet-type recording head where discharge ports which discharge ink to be cured by light irradiation are arranged, including plural recording heads which respectively discharge inks of different colors, a light irradiation device which cures the discharged ink, and a control device which performs discharge control of one recording head to perform recording so that the center position of an ink dot recorded by the one recording head among the plural recording heads is shifted from the center positions of ink dots recorded by the other plural recording heads.

In WO1997/037854A, there is disclosed a head unit of an inkjet printer, which relatively moves in a main scanning direction with respect to a member to be recorded and a sub-scanning direction perpendicular to the main scanning direction, including plural print heads respectively having N nozzles, which are arranged in the sub-scanning direction at K pixel intervals in a predetermined resolution so that K/N has a value of an irreducible fraction, in which each of the print heads is disposed so that the nozzles are arranged in the main scanning direction according to the color of ink to be discharged and are shifted from each other in the sub-scanning direction by L pixels.

In JP2007-118409A, there is disclosed a technology in which inkjet heads of inks of respective colors are arranged at different positions, printing with an ink having the lowest transmittance is performed first to make the ink cured, and then, printing with other inks is sequentially performed so that image quality is improved.

In JP2002-67317A, there is disclosed an inkjet-type recording head including a nozzle array group in which plural lines of nozzle arrays formed with plural nozzle openings punched at a predetermined nozzle pitch are horizontally aligned so as to set an ink type for each nozzle array to be discharged, in which the nozzle array group is formed with N lines of high resolution nozzle arrays in which punching positions of the nozzle openings are respectively shifted in the direction of the nozzle array by 1/N (N is a natural number of 4 or more) pitch.

SUMMARY OF THE INVENTION

In the case where a nozzle arrangement in which nozzles of each color head are aligned on the same main scanning line is applied to an inkjet recording apparatus using UV curable inks (ultraviolet curable inks), since dots of all color inks are aligned on the same line with one main scanning action, there is a problem of the dots of inks causing landing interference in a main scanning direction to form a surface shape that is a significantly irregular line shape. Gloss unevenness easily becomes visible by small irregular shape differences.

An object of the present invention is to provide an inkjet recording method capable of obtaining an image in which gloss unevenness and graininess are reduced.

The above object is achieved by means of <1> or <11> below. The means of <1> or <11> are also listed together with <2> to <10>, which are preferred embodiments, below.

<1> An inkjet recording method including: a step of preparing an inkjet recording apparatus having an inkjet head that has N (N≥4) nozzle arrays, so as to respectively discharge inks of at least four colors of cyan, magenta, yellow and black, having nozzles arranged in a first direction at a predetermined pitch P for discharging a curable ink which is cured by providing active energy, each of the nozzle arrays is arranged to be shifted in the first direction so as to have distances of more than 0 among each virtual line extending from each nozzle in a second direction perpendicular to the first direction, an active energy providing unit that provides active energy to ink droplets discharged from the nozzles and dropped onto a recording surface of a recording medium, a holding unit that arranges the inkjet head and the active energy providing unit in the second direction and holds them, a scanning unit that causes the holding unit to relatively perform scanning on the recording medium in the second direction, a movement unit that causes the holding unit and the recording medium to relatively move in the first direction in each scan by the scanning unit, and a control unit that causes an image to be formed on the recording surface of the recording medium while causing the inkjet head and the active energy providing unit held by the holding unit to relatively perform scanning on each region of the recording medium by a predetermined number of times; a step of discharging at least one type of the ink from the inkjet head of the inkjet recording apparatus on the recording medium; and a step of curing the discharged ink by providing active energy from the active energy providing unit, in which the viscosity of any of the respective inks at 25° C. is 10 to 30 mPa·s.

<2> The inkjet recording method according to <1>, wherein the viscosity of any of the respective inks at 25° C. is 15 to 25 mPa·s.

<3> The inkjet recording method according to <1> or <2>, wherein the surface tension of at least one type of the ink at 25° C. is 23 to 39 mN/m.

<4> The inkjet recording method according to any one of <1> to <3>, wherein the surface tension of any of the respective inks at 25° C. is 23 to 39 mN/m.

<5> The inkjet recording method according to any one of <1> to <4>, wherein the surface tension of any of the respective inks at 25° C. is 30 to 39 mN/m.

<6> The inkjet recording method according to any one of <1> to <5>, wherein the N or more nozzle arrays are provided and each nozzle array is arranged to be shifted in the first direction so as to have a distance between the two adjacent virtual lines of P/N.

<7> The inkjet recording method according to any one of <1> to <6>, wherein a nozzle density of the inkjet head is 100 npi or less, and discharge frequency is 10 kHz or more.

<8> The inkjet recording method according to any one of <1> to <7>, wherein a scanning speed of the inkjet head is 0.9 m/s or more in the discharging step.

<9> The inkjet recording method according to any one of <1> to <8>, wherein any of the respective inks contains an oligomer.

<10> The inkjet recording method according to <9>, wherein the oligomer is urethane (meth)acrylate.

<11> A printed material obtained by the inkjet recording method according to any one of <1> to <10>.

According to the present invention, it is possible to provide an inkjet recording method capable of obtaining an image in which gloss unevenness and graininess are reduced.

DESCRIPTION OF THE PREFERRED EMBODIMENTS

Figure 1:
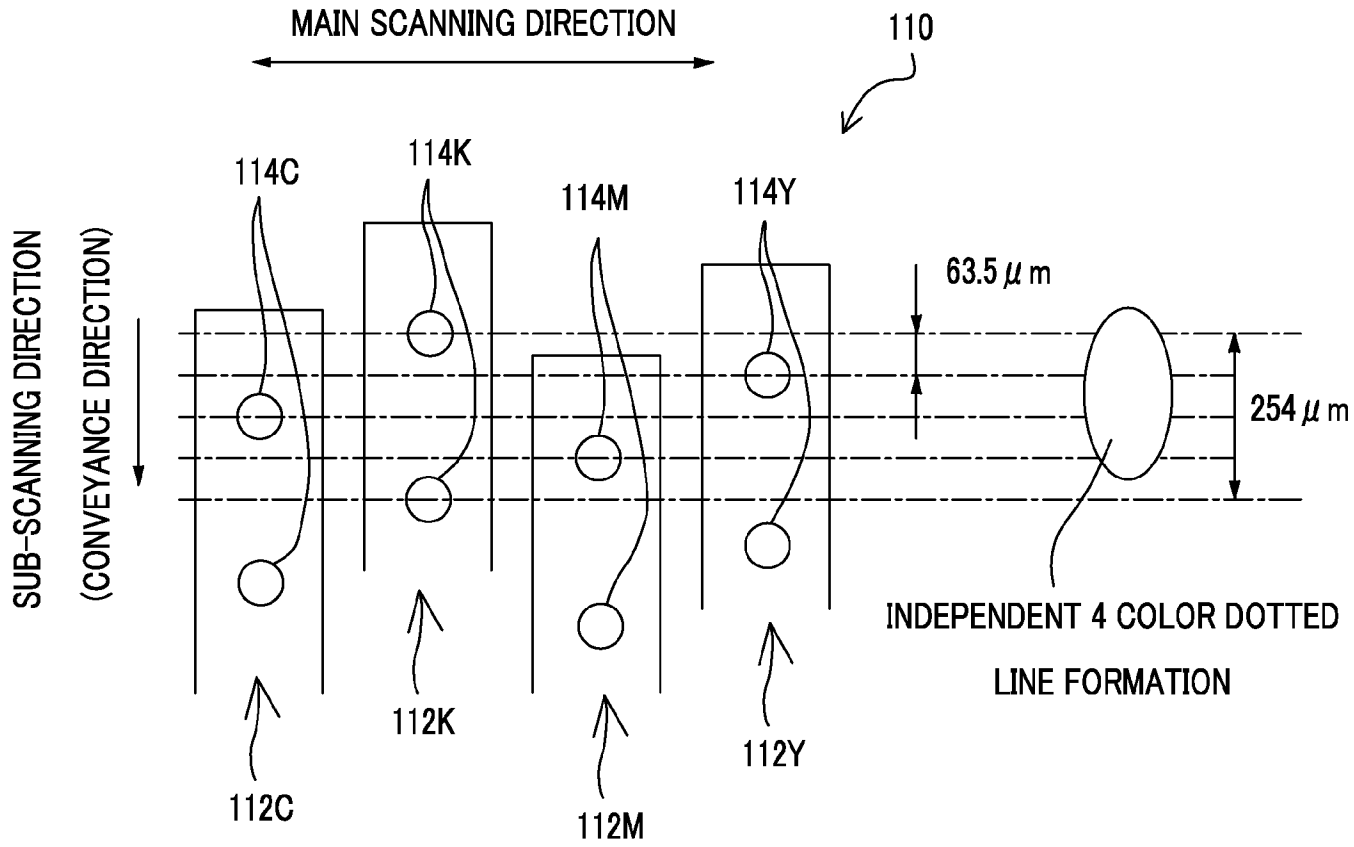
FIG. 1 is an enlarged schematic view showing an example of an inkjet head suitably used in the present invention.

Hereinafter, the present invention will be described in detail.

Furthermore, in the specification, the description of "xx to yy" represents a numerical value range including xx and yy.

"(meth)acrylate" is synonymous with "acrylate and/or methacrylate", and the same will be applied to the following description.

In addition, in the present invention, "% by mass" is synonymous with "% by weight, and "parts by mass" is synonymous with "parts by weight".

(Inkjet Recording Method)

An inkjet recording method of the present invention includes a step of preparing an inkjet recording apparatus including an inkjet head that has N (N≥4) nozzle arrays, so as to respectively discharge inks of at least four colors of cyan, magenta, yellow and black, having nozzles arranged in a first direction at a predetermined pitch P for discharging a curable ink, which is cured by providing active energy, each of the nozzle arrays is arranged to be shifted in the first direction so as to have distances of more than 0 among each virtual line, extending from each nozzle in a second direction perpendicular to the first direction, an active energy providing unit that provides the active energy to ink droplets discharged from the nozzles and dropped onto a recording surface of a recording medium, a holding unit that arranges the inkjet head and the active energy providing unit in the second direction and holds them, a scanning unit that causes the holding unit to relatively perform scanning on the recording medium in the second direction, a movement unit that causes the holding unit and the recording medium to relatively move in the first direction in each scan by the scanning unit, and a control unit that causes an image to be formed on the recording surface of the recording medium while causing the inkjet head and the active energy providing unit held by the holding unit to relatively perform scanning on each region of the recording medium by a predetermined number of times; a step of discharging at least one type of the ink from the inkjet head of the inkjet recording apparatus on the recording medium; and a step of curing the discharged ink by providing active energy from the active energy providing unit, in which the viscosity of any of the respective inks at 25° C. is 10 to 30 mPa·s.

As a result of conducting a detailed examination, the inventors have found that an image in which gloss unevenness and graininess are reduced can be obtained by using a nozzle arrangement depending on ink characteristics and further, precisely controlling physical properties of ink. In particular, even when an amount of light from a curing light source is decreased, an image in which graininess is reduced can be obtained.

<Preparation Step>

The inkjet recording method of the present invention includes a step of preparing an inkjet recording apparatus including an inkjet head that has N (N≥4) nozzle arrays, so as to respectively discharge inks of at least four colors of cyan, magenta, yellow and black, having nozzles arranged in a first direction at a predetermined pitch P for discharging a curable ink, which is cured by providing active energy, each of the nozzle arrays is arranged to be shifted in the first direction so as to have distances of more than 0 among each virtual line extending from each nozzle in a second direction perpendicular to the first direction, an active energy providing unit that provides the active energy to ink droplets discharged from the nozzles and dropped onto a recording surface of a recording medium, a holding unit that arranges the inkjet head and the active energy providing unit in the second direction and holds them, a scanning unit that causes the holding unit to relatively perform scanning on the recording medium in the second direction, a movement unit that causes the holding unit and the recording medium to relatively move in the first direction in each scan by the scanning unit, and a control unit that causes an image to be formed on the recording surface of the recording medium while causing the inkjet head and the active energy providing unit held by the holding unit to relatively perform scanning on each region of the recording medium by a predetermined number of times.

The inkjet recording apparatus which can be suitably used in the inkjet recording method of the present invention will be described below. In addition, inks of each color of cyan, magenta, yellow, black and the like will be described later.

—Inkjet Head—

The inkjet recording apparatus which can be suitably used in the inkjet recording method of the present invention includes the inkjet head which has N (N≥4) nozzle arrays having nozzles for discharging a curable ink, which is cured by providing active energy, arranged at a predetermined pitch P in the first direction, so as to respectively discharge inks of at least four colors of cyan, magenta, yellow and black, each of which is arranged to be shifted in the first direction so as to have distances of more than 0 among each virtual line extending from each nozzle in the second direction perpendicular to the first direction.

The first direction is preferably a conveyance direction (sub-scanning direction) of the recording medium.

The inkjet head has N (N≥4) nozzle arrays for respective inks which discharge inks of at least four colors of cyan, magenta, yellow and black, preferably has N (N≥5) nozzle arrays for respective inks which discharge inks of at least four colors of cyan, magenta, yellow and black and at least one color of a light ink, and more preferably has N (N≥6) nozzle arrays for respective inks which discharge inks of at least six colors of cyan, magenta, yellow, black, light cyan and light magenta.

Each nozzle array of the inkjet head is a nozzle array in which nozzles for discharging a curable ink cured by providing active energy are arranged at a predetermined pitch P in the first direction.

The pitch P is not particularly limited as long as the pitch is a desired pitch. The pitch is preferably 50 dpi or more (approximately 508 μm or less) and 600 dpi or less (approximately 42 μm or more).

In addition, each nozzle array of the inkjet head has nozzles which are relatively arranged to be shifted in the first direction and the nozzles are preferably arranged to be shifted in the first direction by P/N.

A shifting method of each nozzle array is not particularly limited as long as at least each nozzle array is shifted. Each nozzle may be arranged to be shifted in a stepwise manner, and the shift of adjacent nozzle arrays may be P/N, integral multiple of P/N and may have a size of a random shift. For example, in the case of nozzle arrays of inks of four colors, there may be a shifting method shown in FIG. 1 or 2. Among them, in the case of the nozzles shifted by P/N, a shifting method which does not make the shift of adjacent nozzle arrays become P/N as much as possible is preferable, and in a case of nozzle arrays of five colors or more, a shifting method in which every shift of adjacent nozzle arrays is (2×P/N) or more is particularly preferable.

In the case of using four colors, each nozzle array of the inkjet head is preferably arranged to be shifted in the order of a nozzle array for black ink, a nozzle array for yellow ink, a nozzle array for cyan ink and a nozzle array for magenta ink in the first direction from the most upstream side in the relative movement of the recording medium with respect to the inkjet head. Moreover, in the case of using a total of six colors including the four colors, light cyan and light magenta, each nozzle array is preferably arranged to be shifted in the order of a nozzle array for black ink, a nozzle array for yellow ink, a nozzle array for light magenta ink, a nozzle array for cyan ink, a nozzle array for light cyan ink and a nozzle array for magenta ink.

Further, in each nozzle array of the inkjet head, a nozzle of the ink having the lowest curing sensitivity is preferably arranged on the most upstream side in the relative movement of the recording medium with respect to the inkjet head in the first direction, and the nozzles are more preferably arranged from an upstream side to a downstream side in the relative movement of the recording medium with respect to the nozzle inkjet head in the order of ink curing sensitivity from the lowest. In the above-mentioned embodiment, since the ink of the nozzles arranged on the more upstream side in the relative movement of the recording medium is arranged on a layer closer to the recording surface of the recording medium to form an image on the recording surface of the recording medium, the ink having the lowest curing sensitivity is arranged on the layer closest to the recording surface so that the state of a surface layer can be made constant at all times to reduce gloss unevenness.

Among the inks of the four colors, an ink having the lowest curing sensitivity is the black ink and an ink having the second lowest curing sensitivity is the yellow ink in most cases.

In addition, the inkjet head has nozzle arrays which respectively discharge light cyan and light magenta inks as light inks, and in each nozzle array of the inkjet head, the nozzles are arranged to be shifted in the first direction by P/6 and the nozzle array for light cyan or the nozzle array for light magenta is preferably arranged between the nozzle array for cyan and the nozzle array for magenta, between the nozzle array for magenta and the nozzle array for yellow, or between the nozzle array for yellow and the nozzle array for cyan.

Further, the inkjet head may have a nozzle array for white ink and/or a nozzle array for clear ink. Since the gloss unevenness of an image is not greatly affected by the white ink and the clear ink, in the nozzle array for white ink and the nozzle array for clear ink, the nozzles may or may not be arranged to be shifted in the first direction with each of other nozzle arrays.

In addition, the nozzle array for white ink and/or the nozzle array for clear ink are preferably respectively arranged on both sides of the N nozzle arrays for the respective inks for discharging inks of each color of cyan, magenta, yellow and black (preferably, further light cyan and/or light magenta) one by one in the second direction. Specifically, for example, there may be an arrangement shown in FIG. 9 which will be described later, and the like.

The number of nozzles of the nozzle arrays which are arranged at a predetermined pitch P in the inkjet head is not particularly limited as long as the number of nozzles is 2 or more. The number of nozzles is preferably 4 or more and 1,024 or less, and more preferably 8 or more and 512 or less.

As an inkjet recording apparatus that can be used in the present invention, for example, there may be an apparatus including an ink supply system and a temperature sensor.

The ink supply system is provided with, for example, a main tank containing an ink, a supply pipe, an ink supply tank immediately before the inkjet head, a filter, and a piezo type inkjet head. The piezo type inkjet head may be driven so as to discharge multisize dots of preferably 1 to 100 pL, more preferably 3 to 42 pL and still more preferably 8 to 30 pL, at a resolution of preferably 300×300 to 4,000×4,000 dpi and more preferably 400×400 to 1,600×1,600 dpi. Here, dpi referred to in the present invention means the number of dots per 2.54 cm.

The inkjet head used in the inkjet recording method of the present invention is preferably an inkjet head having a non-liquid repellent-treated nozzle plate.

As the nozzle plate having the nozzle arrays arranged at the pitch P, a known nozzle plate can be used. For example, inkjet heads disclosed in U.S. Pat. No. 7,011,396B, US2009/0290000A and the like can be suitably used. The nozzle resolution (density) is preferably 150 npi or less (npi refers to the number of nozzles per 2.54 cm), and particularly preferably 100 npi or less. By using such a low density head, an effect of shifting the head is more effectively exhibited.

Such a nozzle plate is mounted in, for example, a piezo drive system on-demand inkjet head manufactured by FUJIFILM Dimatix, Inc. Specific examples thereof include the S-class and Q-class Sapphire.

The nozzle plate is preferably one in which at least a part of a surface on the side opposing a recording medium is treated so as to be non-liquid repellent (ink affinity treatment). As a non-liquid repellent treatment method, a known method may be used and examples thereof include, but are not limited to, (1) a method in which a silicon oxide film is formed by thermally oxidizing the surface of a nozzle plate made of silicon, (2) a method in which an oxide film of silicon or a material other than silicon is oxidatively formed or a method in which an oxide film is formed by sputtering, and (3) a method in which a metal film is formed. Details of these methods can refer to US2010/0141709A.

In the present invention, since it is preferable for the ink to be discharged at a constant temperature, an image forming apparatus having a portion from the ink supply tank to the inkjet head which can be thermally insulated and heated is preferably used. A method of controlling temperature is not particularly limited, but it is preferable to provide, for example, plural temperature sensors at each pipe section, and control heating according to the ink flow rate and the temperature of the surroundings. The temperature sensors can be provided on the ink supply tank and in the vicinity of the inkjet head nozzle. Furthermore, the head unit that is to be heated is preferably thermally shielded or insulated so that the apparatus main body is not influenced by the temperature of the outside air. In order to reduce the printer start-up time required for heating, or in order to reduce the thermal energy loss, it is preferable to thermally insulate the head unit from other sections and also to reduce the heat capacity of the entire heating unit.

Active Energy Providing Unit—

The inkjet recording apparatus which can be suitably used in the inkjet recording method of the present invention includes an active energy providing unit that provides the active energy to ink droplets discharged from the nozzles and dropped onto the recording surface of a recording medium.

The active energy providing unit preferably provides active energy to the ink droplets to the extent that the ink droplets dropped onto the recording surface of the recording medium are incompletely cured with one scanning action by the scanning unit. In the above-mentioned embodiment, glossiness can be increased.

The inkjet recording apparatus used in the present invention preferably includes a second active energy providing unit that further provides active energy to the ink droplets to which the active energy has been provided by the active energy providing unit to perform main curing of the ink droplets. In the above-mentioned embodiment, ink can be appropriately cured.

As an active energy source of the active energy providing unit, a mercury lamp, a gas and solid laser and the like are mainly used, and as a light source used in curing an ultraviolet curable inkjet recording ink, a mercury lamp and a metal halide lamp are widely known. However, there is a strong demand for not using mercury from the viewpoint of current environment protection and substitution into a GaN-based semiconductor ultraviolet emitting device is very useful in industrial and environmental senses. Furthermore, LED (UV-LED) and LD (UV-LD) have a small size, a long service life, a high efficiency, and a low cost, and are expected as a light curable inkjet light source.

For ink curing in the present invention, as a radiation source for irradiating ink with ultraviolet light, an ultraviolet light emitting diode (UV-LED) is suitably used, and a light emitting diode that emits ultraviolet light having an emission peak wavelength in the range of 300 to 420 nm is more suitably used.

As the UV-LED, for example, Nichia Corporation put on the market a violet LED of which the main emission spectrum has a wavelength between 365 nm and 420 nm. Furthermore, other ultraviolet LEDs are also available, and a violet LED with a different ultraviolet bandwidth can be used.

The emission peak wavelength of ultraviolet light used in the active energy providing unit depends on absorption characteristics of a sensitizer, but is preferably 300 to 420 nm from the viewpoint of curability, more preferably 350 to 420 nm and still more preferably 380 to 420 nm.

Active energy providing conditions and a basic providing method which are disclosed in JP1985-132767A (JP-S60-132767A) may be used. Specifically, light sources are provided on both sides of a head unit including a discharging device for discharging an ink composition, and the head unit and light sources are preferably made to scan by a so-called shuttle method.

In this manner, according to the use of a small-size and light-weight UV-LED as an active energy source provided in the operating section, it is possible to achieve small size and low energy inkjet recording apparatus, thus enabling an image to be formed with high productivity. Moreover, since an UV-LED has excellent variability with regard to exposure conditions, suitable exposure conditions can be set according to the ink composition, and an image can be formed with high productivity.

Furthermore, curing may be completed using another light source that is not driven. WO99/54415A discloses, as a providing method, a method using an optical fiber and a method in which a collimated light source is incident on a mirror surface provided on the side surface of a head unit, and a recording section is irradiated with UV light. Such curing methods above can also be applied to the inkjet recording method of the present invention.

—Holding Unit—

The inkjet recording apparatus which can be suitably used in the inkjet recording method of the present invention includes a holding unit that holds the inkjet head and the active energy providing unit arranged in the second direction perpendicular to the first direction.

The second direction is preferably an inkjet head scanning direction (main scanning direction) perpendicular to the conveyance direction of the recording medium. In addition, the second direction is preferred to be approximately parallel to the recording surface of the recording medium.

The holding unit is not particularly limited and for example, a member including an inkjet head and an active energy providing unit together and a mechanism which drives an inkjet head and an active energy providing unit together may be used.

The holding unit is not particularly limited as long as the holding unit is an unit that holds the arrangement of an inkjet head and an active energy providing unit as described above. However, an unit that holds at least one inkjet head and at least two active energy providing unit is preferable and an unit that holds active energy providing unit on both sides of an inkjet head in the second direction is more preferable. In the above-mentioned embodiment, an ink is easily cured incompletely.

Further, the holding unit preferably holds a second active energy providing unit on the downstream side in the relative movement of the recording medium. In the above-mentioned embodiment, an ink can be properly completely cured.

The maximum illumination intensity of the second active energy providing unit on the surface of the recording medium is preferably greater than the maximum illumination intensity of the (first) active energy providing unit on the surface of the recording medium. In addition, an integrated amount of light of the second active energy providing unit on the surface of the recording medium is preferably greater than an integrated amount of light of the (first) active energy providing unit on the surface of the recording medium.

—Scanning Unit and Movement Unit—

The inkjet recording apparatus which can be suitably used in the inkjet recording method of the present invention includes a scanning unit that causes the holding unit to relatively perform scanning on the recording medium in the second direction and a movement unit that causes the holding unit and the recording medium to relatively move in the first direction in each scan by the scanning unit.

The scanning unit and the movement unit are not particularly limited and known unit can be used.

As the scanning unit, for example, there may be a guide rail, a drive mechanism, a drive motor, a control circuit and the like.

As the movement unit, for example, there may be a nip roller, a platen, a drive mechanism, a drive motor, a control circuit and the like.

—Control Unit—

The inkjet recording apparatus which can be suitably used in the inkjet recording method of the present invention includes a control unit that causes an image to be formed on the recording surface of the recording medium while causing the inkjet head and the active energy providing unit held by the holding unit to relatively perform scanning on each region of the recording medium by a predetermined number of times.

The control unit is not particularly limited and known unit can be used. For example, a computer having a central processing unit (CPU) may be used as a control device.

For example, as the control device, there may be a recording medium conveyance control unit, a carriage drive control unit, a light source control unit, an image processing unit and a discharge control unit. Each unit may be a hardware circuit or software, or a combination thereof.

—Other Unit—

The inkjet recording apparatus which can be suitably used in the inkjet recording method of the present invention may include known unit in addition to above-mentioned unit, as necessary. For example, there may be an input device such as an operation panel which operates an inkjet recording apparatus or an interface which inputs an image to be formed, and a display device which displays the current state of an inkjet recording apparatus, an input operation and an input image.

The inkjet recording apparatus which can be suitably used in the inkjet recording method of the present invention will be further described with reference to the drawing.

Figure 3:
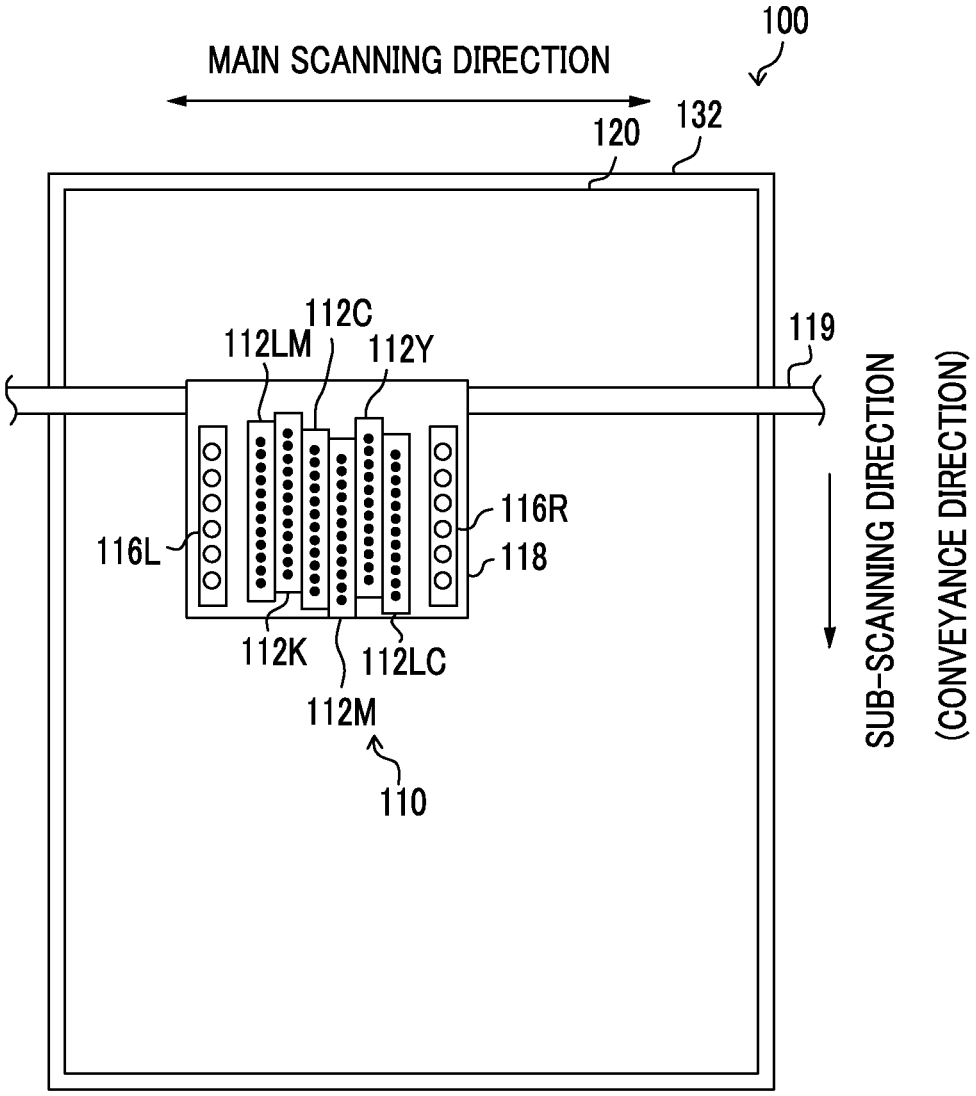
FIG. 3 is an illustrative diagram for describing a configuration outline of an example of an inkjet recording apparatus suitably used in the present invention.
Figure 4:
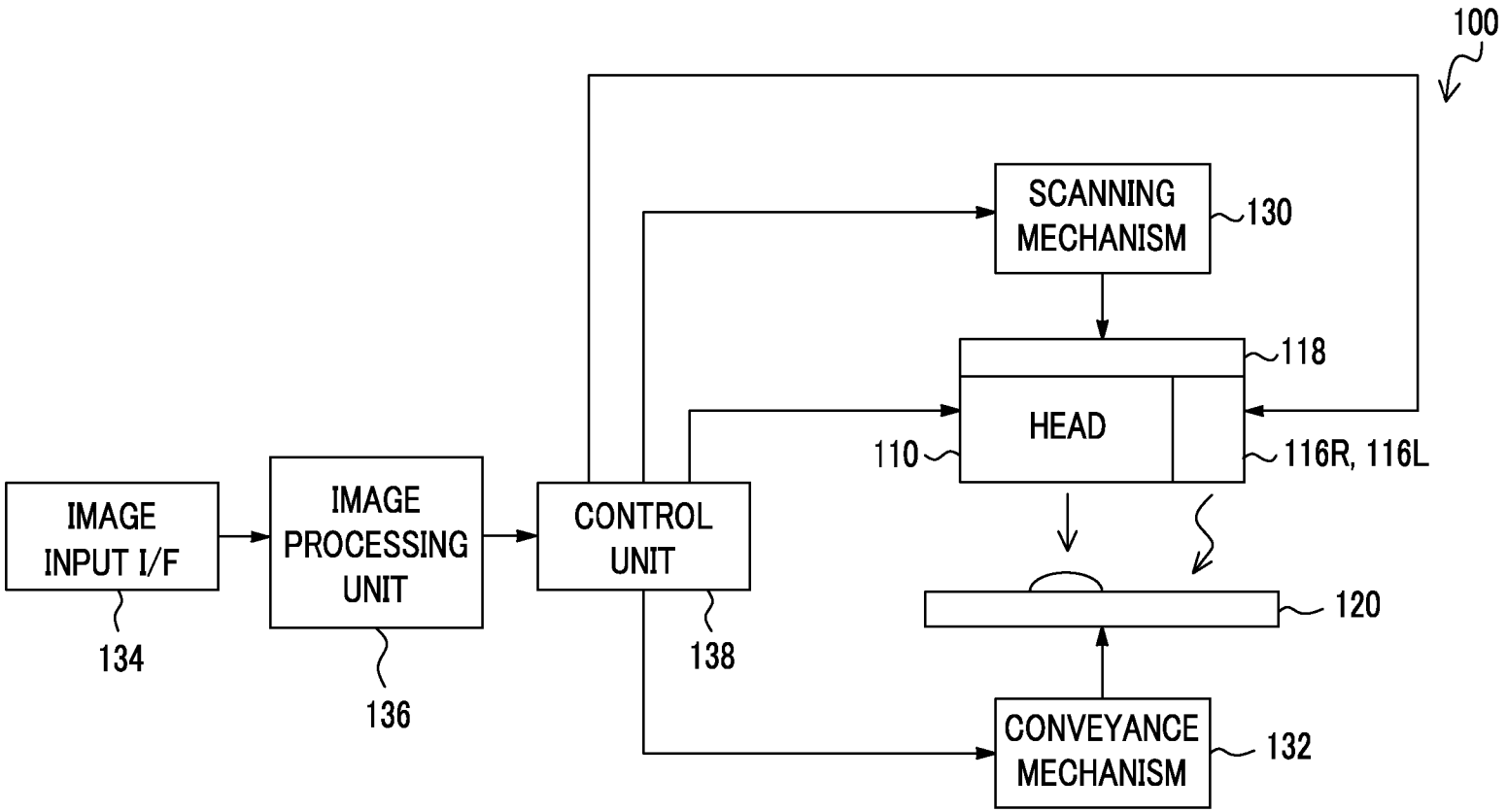
FIG. 4 is a view showing a system configuration of the example of the inkjet recording apparatus suitably used in the present invention.

FIG. 3 is an illustrative diagram for describing a configuration outline of an inkjet recording apparatus 100. FIG. 4 is a view showing a system configuration of the inkjet recording apparatus 100.

The inkjet recording apparatus 100 includes an inkjet head 110, curing light sources 116R and 116L, a carriage 118 (an example of the holding unit) on which the inkjet head 110 and the curing light sources 116R and 116L are mounted, a carriage scanning mechanism 130 (an example of the scanning unit) which allows the carriage 118 to perform scanning along a guide 119 extending in a main scanning direction (corresponding to the second direction), a recording medium conveyance mechanism 132 (an example of the movement unit) which allows a recording medium 120 placed on the upper surface to move in a sub-scanning direction (corresponding to the first direction) perpendicular to the main scanning direction, an image input interface 134 which acquires image data via a wired or wireless communication interface, an image processing unit 136 which performs desired image processing on the input image data, and a control unit 138 which performs overall control of the inkjet recording apparatus 100.

Figure 5:
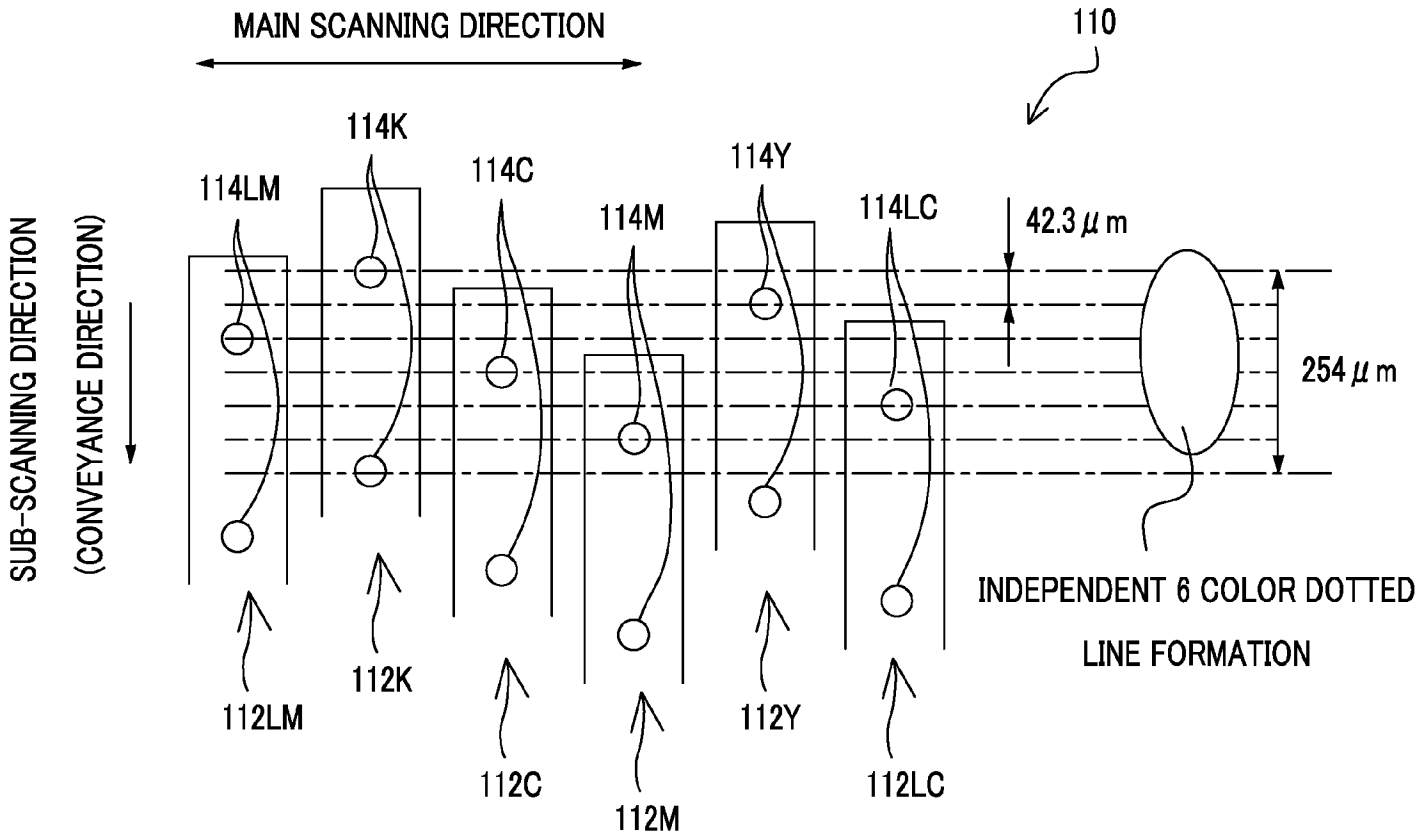
FIG. 5 is an enlarged schematic view showing still another example of the inkjet head suitably used in the present invention.

FIG. 5 is an enlarged schematic view of the inkjet head 110. The inkjet head 110 is configured with six heads 112K, 112C, 112M, 112Y, 112LC and 112LM (examples of the nozzle arrays). The six heads 112K, 112C, 112M, 112Y, 112LC and 112LM respectively have plural nozzles 114K, 114C, 114M, 114Y, 114LC and 114LM for discharging a black ink (black ink, K ink), cyan ink (C ink), magenta ink (M ink), yellow ink (Y ink), light cyan ink (LC ink) and light magenta ink (LM ink), which are ultraviolet curable inks (UV curable inks, examples of curable inks which are cured by providing active energy). Here, the LC ink has the same color system as the C ink and is an ink having a lower coloring agent concentration (light ink) than the C ink. In the same manner, the LM ink has the same color system as the M ink and is an ink having a lower coloring agent concentration (light ink) than the M ink.

Here, among the inks of the six colors of K ink, C ink, M ink, Y ink, LC ink and LM ink, with respect to the wavelength (for example, 385 nm) of ultraviolet light emitted from the curing light sources 116R and 116L, the curing sensitivity of the K ink is the lowest and the curing sensitivity of the Y ink is the second lowest. Further, the curing sensitivity becomes lower in the order of LM ink, C ink, LC ink and M ink.

Here, the curing sensitivity refers to an amount of energy required for completely curing ink droplets when the ink droplets are cured by irradiation of ultraviolet light, and the smaller amount of energy, the higher the sensitivity. Therefore, the lowest curing sensitivity refers to the largest amount of energy required for completely curing the ink droplets.

The plural nozzles 114K of the head 112K are arranged in one row at regular intervals in the sub-scanning direction. In the same manner, the plural nozzles 114C of the head 112C, the plural nozzles 114M of the head 112M, the plural nozzles 114Y of the head 112Y, the plural nozzles 114LC of the head 112LC, and the plural nozzles 114LM of the head 112LM are respectively arranged in one row at regular intervals in the sub-scanning direction. Here, all pitch values among the nozzles 114 of each color head 112 are 100 dpi.

Each color head 112 is arranged in the order of 112LM, 112K, 112C, 112M, 112Y and 112LC from the left side of the main scanning direction.

Further, in the sub-scanning direction, the nozzles 114K are arranged on the most upstream side in the recording medium conveyance direction and each color head 112 is arranged to be shifted so that the nozzles are aligned at regular intervals (at intervals of 600 dpi (254 μm/6=approximately 42 μm)) toward the downstream side in the order of 114*k*, 114Y, 114LM, 114C, 114LC and 114M. Here, among the nozzles used in printing (effective nozzles), the nozzles arranged on the most upstream side may be the nozzles 114K, and the nozzles not used in printing (ineffective nozzles) may be arranged on the more upstream side than the position of the nozzles 114K.

In this manner, each color head 112 is arranged to be shifted by P/N in the sub-scanning direction when the nozzle pitch is P and the number of heads (the number of nozzle arrays) is N. The shifting in the sub-scanning direction means that the nozzles are arranged before and after first nozzles of an ink in which the nozzles (first nozzles) on the most upstream side in the recording medium conveyance direction are set as a reference, among the nozzles 114 of each color head 112. The first nozzles are not limited to the nozzles on the most upstream side in the recording medium conveyance direction among the plural nozzles 114 provided in each color head 112, and refer to nozzles disposed on the most upstream side among the nozzles which are used in discharge in an image formation mode to contribute to image formation.

The inkjet head 110 performs scanning back and forth in the main scanning direction by the scan of the carriage 118 and inks are discharged from the nozzles 114 of each color head 112 according to the control of the control unit 138 to drop droplets of inks of respective colors on the recording surface of the recording medium 120.

Every time the inkjet head 110 performs scanning on the recording medium 120 in the main scanning direction, the recording medium 120 is conveyed (scanned) in the sub-scanning direction by the recording medium conveyance mechanism 132 by a predetermined amount. In the specification, the upper side of FIG. 3 is referred to as the upstream side in the conveyance direction of the recording medium 120, and the lower side of FIG. 3 is referred to as the downstream side in the conveyance direction of the recording medium 120.

The curing light sources 116R and 116L (examples of the active energy providing unit) respectively have plural UV-LEDs. In the curing light sources 116R and 116L, the UV-LEDs disposed on the upstream side of the main scan of the carriage 118 are turned off and the UV-LEDs disposed on the downstream side are turned on by the control unit 138. The turned-on UV-LEDs irradiate the ink droplets of the respective color inks dropped on the recording medium 120 from each color head 112 with ultraviolet light to incompletely cure (half-cure) the ink droplets.

That is, in the case where inks are discharged from the nozzles 114 of each color head 112 while the carriage 118 moves in the right direction of FIG. 3, the ink droplets are irradiated with ultraviolet light from the UV-LEDs of the curing light source 116L disposed on the downstream side of the scan. In addition, in the case where inks are discharged from the nozzles 114 of each color head 112 while the carriage 118 moves in the left direction of FIG. 3, the ink droplets are irradiated with ultraviolet light from the UV-LEDs of the curing light source 116R disposed on the downstream side of the scan.

The ink droplets dropped on the recording medium 120 are not completely cured with one ultraviolet irradiation action by the curing light sources 116R and 116L and have a half-cured state. Here, the half-cured state refers to a cured state from the time when ink starts curing until the time when ink reaches main curing state. Then, the half-cured ink droplets are further irradiated with ultraviolet light from main curing light sources (not shown) disposed on the downstream side in the conveyance direction of the recording medium 120 to be half-cured, and accordingly, an image is recorded on the recording surface of the recording medium 120. Further, the main curing state refers to a state in which the ink droplets are cured to an extent of not deteriorating an image regardless of handling of the recording medium 120. That is, the main curing does not necessarily mean a state in which a curing reaction is completed.

An amount of irradiation light from the curing light sources 116R and 116L and an amount of irradiation light from the main curing light sources can be separately set. As described above, glossiness of the recorded image can be increased by reducing the amount of irradiation light during the half curing.

[Data Processing Method]

As shown in FIG. 5, since the positions of (the nozzles 114 of) each color head 112 are arranged to be shifted in the sub-scanning direction, as half-tone image data, half-tone data in the shifted position is cut off for each raster and transmitted to each color head 112 and then, ink droplets are dropped.

The half-tone processed image data is generated on RIP soft as usual, input to the inkjet recording apparatus 100 via the image input interface 134 and transmitted to the image processing unit 136. The image data is transmitted to and accumulated in the image processing unit 136 from the upper end of the image in the sub-scanning direction in the form of each color of, for example, LM, K, C, M, Y and LC being continued in such a manner that each color head is shifted by one dot.

In the image processing unit 136, depending on the shifted amount of each color head 112, image data at a point shifted in the sub-scanning direction from color data as a reference, which is close to the shifted amount, is transmitted to the control unit 138. According to the shifted arrangement, the data at the point shifted in the sub-scanning direction from the reference color data is transmitted to the control unit 138. Therefore, in the RIP software, while a usual half-tone process is performed, the output according to the shifted position of the each color head 112 is performed in the inkjet recording apparatus 100. Then, an image forming process, which has less influence on the shift in the arrangement of each color head 112 on a completed imaged, is performed.

In the embodiment shown in FIG. 4, while the half-tone processed image data is input from the image input interface 134, an RGB image and the like may be input to be converted to dot data for printing in the image processing unit 136.

Since each color head 112 is arranged in the sub-scanning direction in the order of 112K, 112Y, 112LM, 112C, 112LC and 112M, the K ink having the lowest curing sensitivity first lands on the surface of the recording medium 120, and next, the Y ink having the second lowest curing sensitivity lands. Hereinafter, the inks land on the recording medium in the order of LM ink, C ink, LC ink and M ink, which is the order of curing sensitivity from the lowest. Therefore, the inks are arranged in the order of K ink, Y ink, LM ink, C ink, LC ink and M ink from the surface of the recording medium toward the upper layer.

Figure 6:
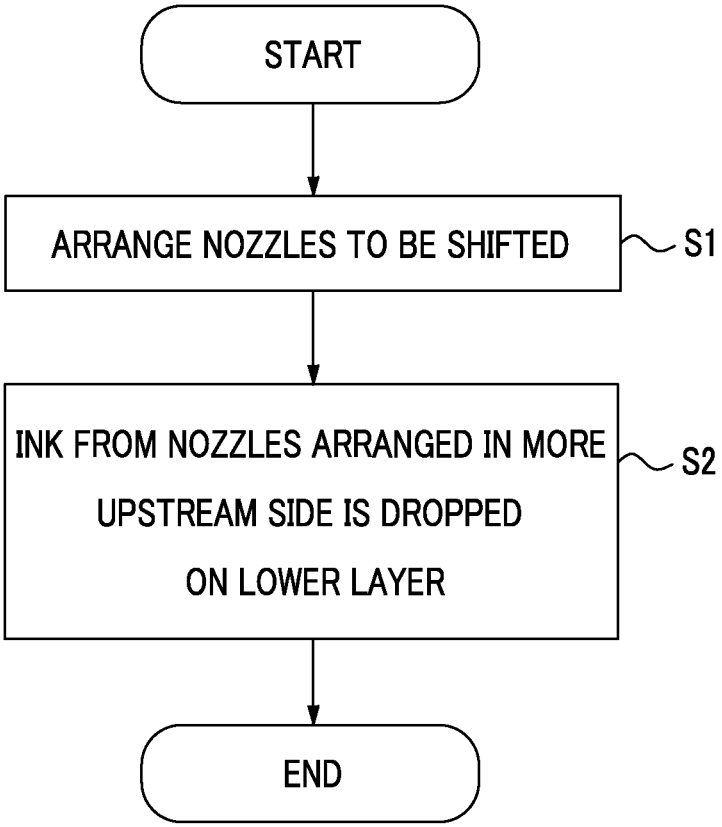
FIG. 6 is a flowchart showing an example of an inkjet recording method of the present invention.

In this manner, in the inkjet recording method of the present invention, it is preferable that the nozzles be arranged to be shifted in the order of ink curing sensitivity from the lowest (Step S1 in FIG. 6), and the ink having a lower curing sensitivity be arranged on the lower layer and the ink having a higher curing sensitivity be arranged on the upper layer (the ink of the nozzles arranged on the more upstream side in the recording medium conveyance direction is arranged on the lower layer) to from an image (Step S2 in FIG. 6). Accordingly, the state of the surface layer can be kept constant at all times and gloss unevenness can be further reduced.

In addition, since the UV curable inks do not penetrate into the recording medium during curing and forms a stereoscopic shape on the surface, gloss unevenness becomes remarkable in a black solid image formed with 4C (cyan ink, magenta ink, yellow ink and black ink) in which the amount of dropped ink is large. In a portion of the image with a high concentration formed with the four kinds of inks, the light inks are rarely used.

Accordingly, in the embodiment shown in FIG. 3, as the arrangement of each color head 112 in the sub-scanning direction, the nozzles of light inks are arranged among the nozzles of Y ink, C ink and M ink which are dark inks. With this arrangement, it is possible to reduce interference among each droplet of dropped dark ink and avoid gloss unevenness.

In the order of the nozzles in the sub-scanning direction, each color nozzle 114 is preferably arranged at intervals of 600 dpi in intervals of 100 dpi among the nozzles 114 of each color head 112. Therefore, the inkjet recording apparatus in which the light sources for half curing are separated from the light sources for main curing can form an image with high glossiness and unremarkable gloss unevenness by reducing the illumination intensity of the half curing light sources.

In this manner, the position of each color head 112 with the nozzles of the ink having a lower curing sensitivity in the sub-scanning direction is shifted in the more upstream direction of the recording medium conveyance direction in consideration of curing sensitivity of the inks, and the nozzles of light inks are placed among the nozzles of dark inks so that a gap is formed between dots of the dark inks during formation of an image with high concentration, and more amount of light from the light sources for half curing can be reduced. Therefore, it is possible to realize gloss increase and avoidance of gloss unevenness at the same time.

In the embodiment, inks of two colors of LC ink and LM ink are used as light inks, but the light inks are not limited to the inks of the two colors. Using a light black ink (LK ink) having the same color system as the K ink and lower coloring agent concentration than the K ink and a light yellow ink (LY ink) having the same color system as the Y ink and lower coloring agent concentration than the Y ink, inks of one to four colors can be used. Even in this case, as the arrangement of each color head 112 in the sub-scanning direction, the nozzles of light inks are arranged among the nozzles of K ink, Y ink, C ink and M ink which are dark inks. Therefore, it is possible to reduce interference among each droplet of dropped dark inks.

In the embodiment, the position of each color heads 112 with the nozzles of inks having a lower sensitivity in the sub-scanning direction is shifted in the more upstream direction of the recording medium conveyance direction. However, as long as the nozzles of the ink having the lowest curing sensitivity are arranged on the most upstream side and the ink having the lowest curing sensitivity is arranged on a layer closest to the recording medium, even when the arrangement sequence of other inks is different, a predetermined effect with respect to avoidance gloss unevenness is obtained.

For example, in the case of using the inks of the six colors, the nozzles 114K of the ink having the lowest curing sensitivity are arranged on the most upstream side in the conveyance direction of the recording medium 120, and the K ink only has to first land on the surface of the recording medium 120 (that is, land on the layer closest to the recording surface of the recording medium 120). Other nozzles may be arranged in the order of 114K, 114C, 114LM, 114M, 114LC and 114Y or in the order of 114K, 114M, 114LC, 114Y, 114LM and 114C toward the downstream side.

Another inkjet recording apparatus which can be suitably used in the inkjet recording method of the present invention will be described with reference to the drawing, but the embodiment is not limited thereto.

Figure 7:
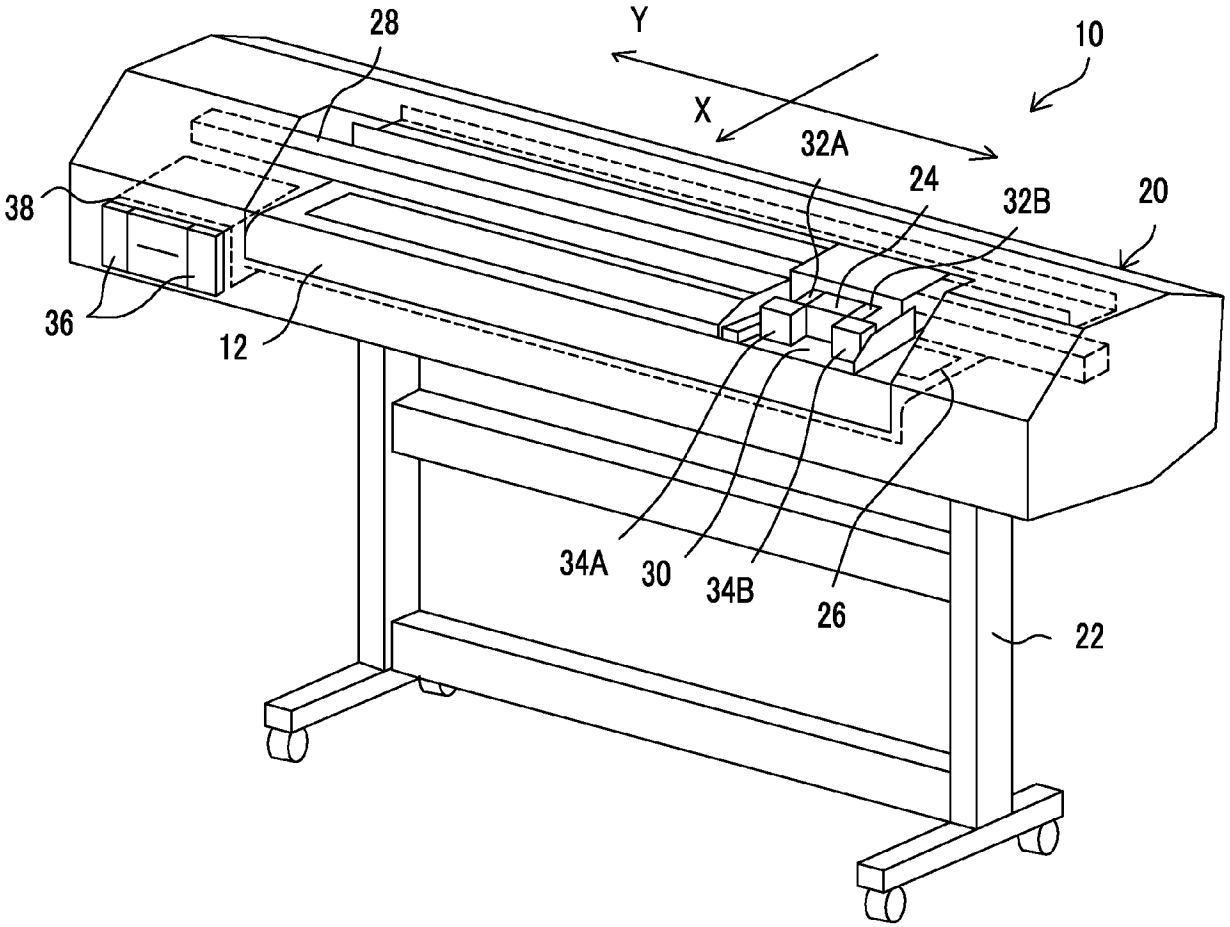
FIG. 7 is an external perspective view of another example of the inkjet recording apparatus suitably used in the present invention.

FIG. 7 is an external perspective view of another inkjet recording apparatus which can be suitably used in the inkjet recording method of the present invention. This inkjet recording apparatus 10 is a wide-format printer which forms a color image on the recording medium 12 by using ultraviolet curable inks (UV curable inks). A wide-format printer is an apparatus which is suitable for recording a wide image formation range, such as for large posters or commercial wall advertisements, or the like. Here, a printer for dealing with a medium having a size of A3 or more is called "wide-format".

The inkjet recording apparatus 10 includes an apparatus main body 20 and a stand 22 which supports the apparatus main body 20. The apparatus main body 20 is provided with a drop-on-demand type inkjet head 24 which discharge inks toward the recording medium (medium) 12, a platen 26 which supports the recording medium 12, and a guide mechanism 28 and a carriage 30 as a head movement unit (examples of the scanning unit).

The guide mechanism 28 is arranged so as to extend above the platen 26, following a scanning direction (Y direction, second direction) which is parallel to the medium supporting surface of the platen 26 and which is perpendicular to the conveyance direction (X direction, first direction) of the recording medium 12. The carriage 30 is supported so as to be able to perform reciprocal movement in the Y direction along a guide mechanism 28. The inkjet head 24 is mounted on the carriage 30 and the temporary curing light sources 32A and 32B, and the main curing light sources 34A and 34B, which irradiate the ink on the recording medium 12 with ultraviolet light, are also mounted on the carriage.

The temporary curing light sources 32A and 32B are light sources which irradiate the ink droplets which have been discharged from the inkjet head 24 and have landed on the recording medium 12 with ultraviolet light to temporarily cure the ink to the extent that adjacent ink droplets do not combine together (half cure). The main curing light sources 34A and 34B are light sources which irradiate the ink with ultraviolet light to perform additional exposure after the temporary curing and finally, completely cure the ink droplets (main cure).

The inkjet head 24, the temporary curing light sources 32A and 32B and the main curing light sources 34A and 34B arranged on the carriage 30 move in unison with (together with) the carriage 30 along the guide mechanism 28.

Various media can be used for the recording medium 12, which will be described later, without any restrictions on the material, such as paper, unwoven cloth, vinyl chloride, compound chemical fibers, polyethylene resins, polyester resins, tarpaulin, or the like, or whether the medium is permeable or non-permeable. The recording medium 12 is supplied in a rolled state (refer to FIG. 8) from the rear side of the apparatus, and after printing, the medium is rolled onto a take-up roller on the front side of the apparatus (not shown in FIG. 7 but shown by reference numeral 44 in FIG.

8) (an example of the movement unit). Ink droplets are discharged from the inkjet head 24 onto the recording medium 12 which is conveyed onto the platen 26, and ultraviolet light is emitted from the temporary curing light sources 32A and 32B and the main curing light sources 34A and 34B onto ink droplets which are attached onto the recording medium 12.

In FIG. 7, an installation section 38 of ink cartridges 36 is provided in the left-side front surface of the apparatus main body 20 when the apparatus is viewed from the front. The ink cartridges 36 are replaceable ink supply sources (ink tanks) which each store ultraviolet curable ink. The ink cartridges 36 are provided so as to correspond to the respective inks which are used in the inkjet recording apparatus 10 of the example. The ink cartridges 36 of each color are respectively connected to the inkjet head 24 through ink supply paths (not shown) which are formed independently. The ink cartridges 36 are replaced when the amount of remaining ink of the corresponding color becomes low.

Although not shown in the drawings, a maintenance unit for the inkjet head 24 is provided on the right side of the apparatus main body 20 as viewed from the front side. This maintenance unit includes a cap for keeping the inkjet head 24 moist when not printing, and a wiping member (blade, web and the like) for cleaning the nozzle surface (ink discharge surface) of the inkjet head 24. The cap which caps the nozzle surface of the inkjet head 24 is provided with an ink receptacle for receiving ink droplets discharged from the nozzles for the purpose of maintenance.

[Description of Recording Medium Conveyance Path]

Figure 8:
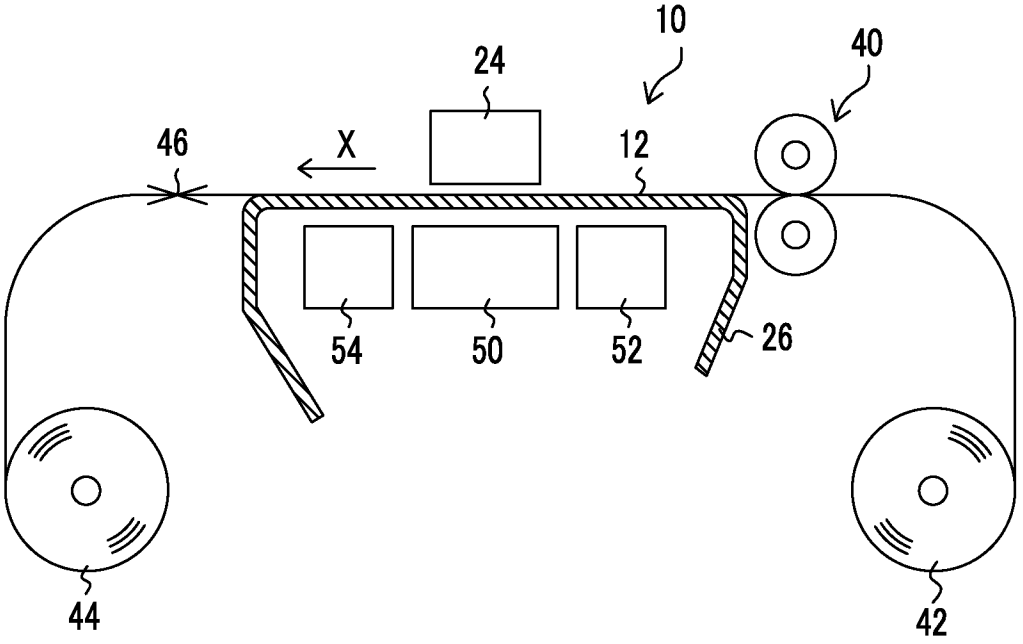
FIG. 8 is an illustrative diagram schematically showing a recording medium conveyance path in the inkjet recording apparatus shown in FIG. 7.

FIG. 8 is an illustrative diagram schematically showing the recording medium conveyance path in the inkjet recording apparatus 10. As shown in FIG. 8, the platen 26 is formed in an inverted gutter shape and the upper surface thereof is a supporting surface (medium supporting surface) for the recording medium 12. A pair of nip rollers 40 which is recording medium conveyance means that intermittently conveys the recording medium 12 is provided on the upstream side in the conveyance direction (X direction) of the recording medium 12, in the vicinity of the platen 26. These nip rollers 40 move the recording medium 12 in the X direction over the platen 26.

The recording medium 12 which is output from a supply side roller (also referred to as "pay-out supply roller") 42 that configures a roll-to-roll type recording medium conveyance unit is conveyed intermittently in the X direction by the pair of nip rollers 40 which are provided in an inlet entrance of the print region (on the upstream side of the platen 26 in the recording medium conveyance direction). When the recording medium 12 is arrived at the print region directly below the inkjet head 24, printing is performed by the inkjet head 24, and the recording medium is then rolled up onto a take-up roller 44 after printing. A guide 46 for the recording medium 12 is provided on the downstream side of the print region in the recording medium conveyance direction.

A temperature adjustment unit 50 which adjusts the temperature of the recording medium 12 during printing is provided on the rear surface (an opposite surface side to the surface supporting the recording medium 12) of the platen 26 at a position opposing the inkjet head 24, in the print region. When the temperature of the recording medium 12 is adjusted to a predetermined temperature during the printing, physical properties such as viscosity, surface tension, and the like, of the ink droplets having landed onto the recording medium 12, have predetermined values and it is possible to obtain a desired dot diameter. As necessary, a heat pre-adjustment unit 52 may be provided on the upstream side of the temperature adjustment unit 50 or a heat after-adjustment unit 54 may be provided on the downstream side of the temperature adjustment unit 50.

[Description of Inkjet Head]

Figure 9:
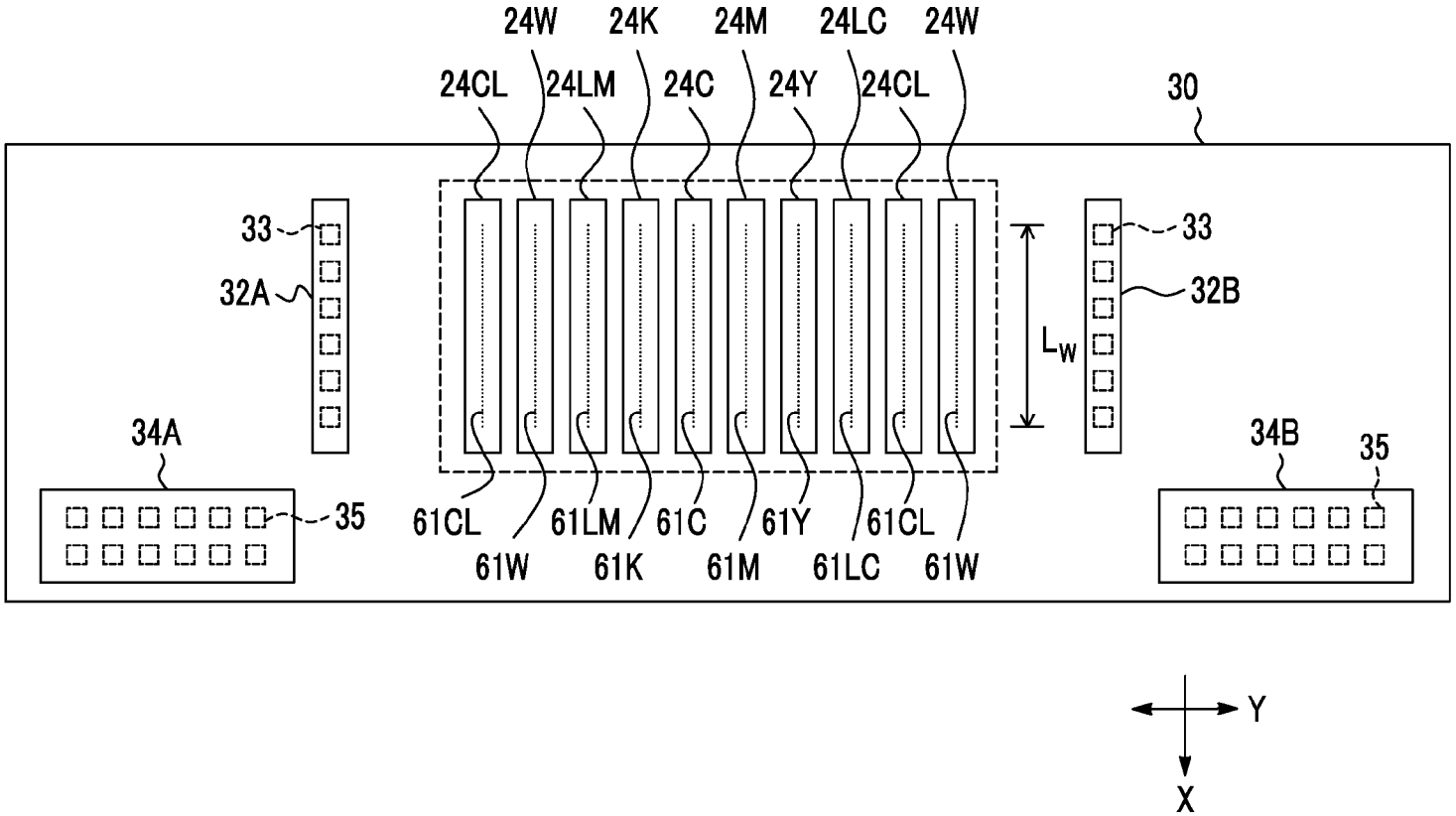
FIG. 9 is a plan perspective view showing the arrangement of the inkjet head, temporary curing light sources and main curing light sources in the inkjet recording apparatus shown in FIG. 7.

FIG. 9 is a plan perspective view showing an example of the arrangement of the inkjet head 24, temporary curing light sources 32A and 32B and main curing light sources 34A and 34B, which are arranged in the carriage 30.

In the inkjet head 24, nozzle arrays 61CL, 61W, 61LM, 61K, 61C, 61M, 61Y, 61LC, 61CL and 61W for respectively discharging inks of each color of CL (clear), W (white), LM, K, C, M, Y and LC are provided. In FIG. 9, the nozzle arrays are indicated by dotted lines for a simple description and the shift of each nozzle array and the individual nozzles are not shown. In addition, in the following description, the nozzle arrays 61CL, 61W, 61LM, 61K, 61C, 61M, 61Y, 61LC, 61CL and 61W can be referred to generally as "nozzle arrays 61".

The types of ink colors (number of colors) and the combination of the ink colors are not limited to the embodiment shown in FIG. 9. For example, it is possible to adopt a mode in which the LC and LM nozzle arrays are omitted, a mode in which the CL or W nozzle array is omitted, or a mode in which a nozzle array for discharging an ink of a special color is added. Further, the arrangement sequence of each color nozzle array in the Y direction is not particularly limited.

The inkjet head 24 capable of forming a color image can be configured by forming head modules for each color nozzle array 61 and aligning the head modules together. For example, it is possible to adopt a mode in which each head module 24CL, 24W, 24LM, 24K, 24C, 24M, 24Y and 24LC, which has each nozzle array 61CL, 61W, 61LM, 61K, 61C, 61M, 61Y and 61LC, is aligned at regular intervals in the Y direction of the carriage 30.

Each color head module 24CL, 24W, 24LM, 24K, 24C, 24M, 24Y and 24LC can be interpreted respectively as an "inkjet head". Alternatively, it is also possible to adopt a mode in which the ink flow paths are divided for the inks of the respective colors inside one inkjet head 24, and the nozzle arrays for discharging the inks of plural colors are arranged in the one inkjet head.

In each of the nozzle arrays 61, plural nozzles are aligned in one row (on one straight line) in the X direction at regular intervals. In the inkjet head 24 of the example, the arrangement pitch (nozzle pitch) of the nozzles configuring each nozzle array 61 is 254 μm (100 dpi), the number of the nozzles configuring one nozzle array 61 is 256, and the total length Lw of the nozzle arrays 61 (corresponding to "length of nozzle arrays", also referred to as "nozzle array width" in some cases) is approximately 65 mm (254 μm×255=64.8 mm).

Further, each nozzle of the nozzle arrays 61LM, 61K, 61C, 61M, 61Y and 61LC is arranged to be respectively shifted in the X direction (not shown), and aligned in the order of the nozzle array 61K for discharging the K ink having the lowest curing sensitivity and the nozzle array 61Y for discharging the Y ink having the second lowest curing sensitivity from on the upstream side in the medium conveyance direction. In addition, the nozzles of LM ink and LC ink, which are light inks, are arranged among the nozzles of Y ink, C ink and M ink, which are dark inks (refer to FIG. 5). A dark ink having a lower curing sensitivity may be arranged on the more upstream side in the medium conveyance direction.

The discharge frequency is preferably 10 kHz, and more preferably 15 kHz, and amounts of discharged droplets of three types of 10 pl, 20 pl and 30 pl, can be selectively discharged by changing drive waveforms. That is, dots with three types of sizes such as a small dot, middle dot and large dot can be formed.

The ink discharge method of the inkjet head 24 employs a method which ejects ink droplets by deformation of a piezoelectric element (piezo-actuator) (piezo-j et method). For the discharge energy generating element, in addition to a mode using an electrostatic actuator (electrostatic actuator method), it is also possible to employ a heating body such as a heater (heating element) which generates bubbles by heating ink to eject droplets of the ink by the pressure of the bubbles (thermal-jet method).

[Regarding to Arrangement of Ultraviolet Light Irradiation Device]

As shown in FIG. 9, the temporary curing light sources 32A and 32B are arranged on the left and right sides of the inkjet head 24 in the scanning direction (Y direction). Further, the main curing light sources 34A and 34B are arranged on the downstream side of the inkjet head 24 in the recording medium conveyance direction (X direction).

The ink droplets which have been discharged from the nozzles of the inkjet head 24 and landed on the recording medium 12 are irradiated with ultraviolet light for temporary curing by the temporary curing light source 32A (or 32B) which passes over the ink droplets immediately after the landing. In addition, the ink droplets on the recording medium 12 which have passed through the print region of the inkjet head 24 due to the intermittent conveyance of the recording medium 12 are irradiated with ultraviolet light for main curing by the main curing light sources 34A and 34B.

The temporary curing light sources 32A and 32B, and the main curing light sources 34A and 34B may be constantly turned on during the print operation of the inkjet recording apparatus 10 and may be controlled to be appropriately turned on and off as necessary.

[Regarding to Configuration Example of Temporary Curing Light Source]

As shown in FIG. 9, the temporary curing light sources 32A and 32B respectively have a structure in which plural UV-LED elements 33 are aligned. The two temporary curing light sources 32A and 32B are common in configuration. In the example, as the temporary curing light sources 32A and 32B, an LED element array in which six UV-LED elements 33 are aligned in one row along the X direction is shown as an example, but the number and the array mode of LED elements are not limited to the example. For example, plural LED elements can be arranged in a matrix shape in the X or Y direction.

The six UV-LED elements 33 are aligned so as to perform UV irradiation on a region with the same width as a nozzle array width Lw of the inkjet head 24 at one time.

[Regarding to Configuration Example of Main Curing Light Source]

As shown in FIG. 9, the main curing light sources 34A and 34B respectively have a structure in which plural UV-LED elements 35 are aligned. The two main curing light sources 34A and 34B are common in configuration. In the example of FIG. 9, as the main curing light sources 34A and 34B, an LED element array (6×2) in which six UV-LED elements 35 are arranged along the Y direction and two UV-LED elements 35 are arranged along the X direction in a matrix shape is shown as an example.

The arrangement of the UV-LED elements 35 in the X direction is determined such that UV irradiation can be performed at one time on a region with the width corresponding to an n-th part (n is a positive integer) of the nozzle array width Lw, in relation to a swath width which will be described later, in one scanning action of the carriage 30. In the example of FIG. 9, the UV-LED elements 35 which can perform irradiation on a region with ½ (n=2) of the nozzle array width Lw at one time are arranged.

The number and the array mode of LED elements in the main curing light source are not limited to the example of FIG. 9. In addition, the light sources of the temporary curing light sources 32A and 32B and the main curing light sources 34A and 34B are not limited to the UV-LED elements 33 and 35, and UV lamps and the like can be used.

[Regarding to Image Formation Mode]

The thus-configured inkjet recording apparatus 10 employs multi-pass image formation control, and can change print resolution by changing the number of printing passes. For example, three image formation modes are used: high-productivity mode, standard mode and high-quality mode, and the print resolutions are different in the respective modes. It is possible to select the image formation mode according to the print objective and application.

In the high-productivity mode, printing is performed at the resolution of 600 dpi (in the main scanning direction)× 400 dpi or 500 dpi (in the sub-scanning direction). In the high-productivity mode, the resolution of 600 dpi is realized by 2 passes (two scanning actions) in the main scanning direction. In the first scan (the outbound movement of the carriage 30), dots are formed at the resolution of 300 dpi. In the second scan (during the inbound movement of the carriage 30), dots are formed at the resolution of 300 dpi so as to be interpolated between the dots having been formed in the first scan (during the outbound movement), and the resolution of 600 dpi is obtained in the main scanning direction.

On the other hand, the nozzle pitch is 100 dpi in the sub-scanning direction, and one main scanning action (1 pass) can form dots at the resolution of 100 dpi in the sub-scanning direction. Consequently, the resolution of 400 dpi or 500 dpi in the sub-scanning direction is realized by performing interpolation printing of 4 passes (4 or 5 scanning actions).

In the specification, the product of the number of passes in the main scanning direction and the number of passes in the sub-scanning direction is referred to as the number of passes in the image formation mode. Therefore, the number of passes in the high-productivity mode is 2 passes in the main scanning direction×4 passes or 5 passes in the sub-scanning direction=8 passes or 10 passes.

In the standard mode, printing is performed at the resolution of 900 dpi×800 dpi. The resolution is obtained by means of printing of 2 passes in the main scanning direction and 8 passes in the sub-scanning direction. That is, the number of passes in the standard mode is 2 passes in the main scanning direction×8 passes in the sub-scanning direction=16 passes.

Further, in the high-quality mode, printing is performed at the resolution of 1200 dpi×1200 dpi, which is obtained by means of printing of 4 passes in the main scanning direction and 12 passes in the sub-scanning direction. That is, the number of passes in the high-quality mode is 4 passes in the main scanning direction×12 passes in the sub-scanning direction=48 passes.

[Description of Ink Supply System]

Figure 10:
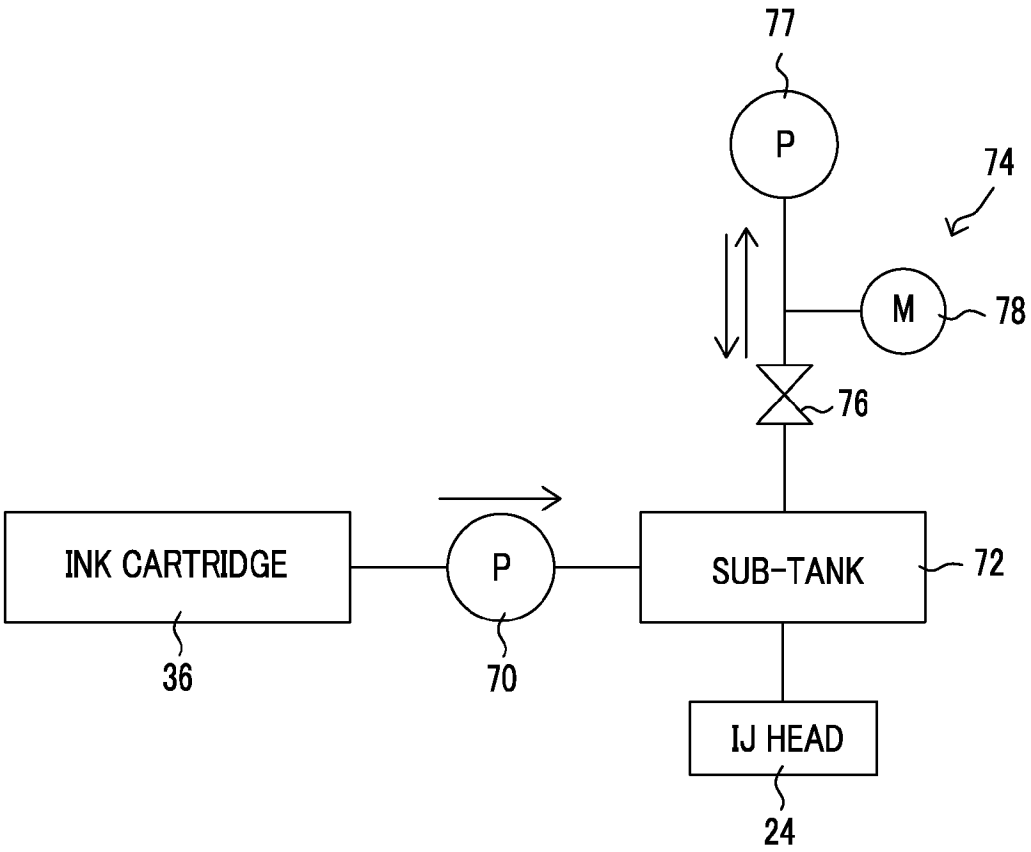
FIG. 10 is a block diagram showing an example of a configuration of an ink supply system in the inkjet recording apparatus suitably used in the present invention.

FIG. 10 is a block diagram showing a configuration of an ink supply system in the inkjet recording apparatus 10. As shown in the drawing, an ink accommodated in an ink cartridge 36 is suctioned by a supply pump 70, and is conveyed to the inkjet head 24 via a sub-tank 72. A pressure adjustment unit 74 for adjusting the pressure of the ink in the sub-tank 72 is provided with the sub-tank 72.

The pressure adjustment unit 74 includes a pressure adjusting pump 77 which is connected to the sub-tank 72 via a valve 76, and a pressure gauge 78 which is provided between the valve 76 and the pressure adjusting pump 77.

During the normal printing, the pressure adjusting pump 77 operates in a direction in which the ink in the sub-tank 72 is suctioned, and keeps a negative pressure inside the sub-tank 72 and a negative pressure inside the inkjet head 24. On the other hand, during maintenance of the inkjet head 24, the pressure adjusting pump 77 is operated in a direction in which the pressure of the ink in the sub-tank 72 is increased, thereby forcibly raising the pressure inside the sub-tank 72 and the pressure inside the inkjet head 24, and ink inside the inkjet head 24 is expelled via nozzles. The ink which has been forcibly expelled from the inkjet head 24 is accommodated in the ink receptacle of the cap (not shown) described above.

[Description of Control System of Inkjet Recording Apparatus]

Figure 11:
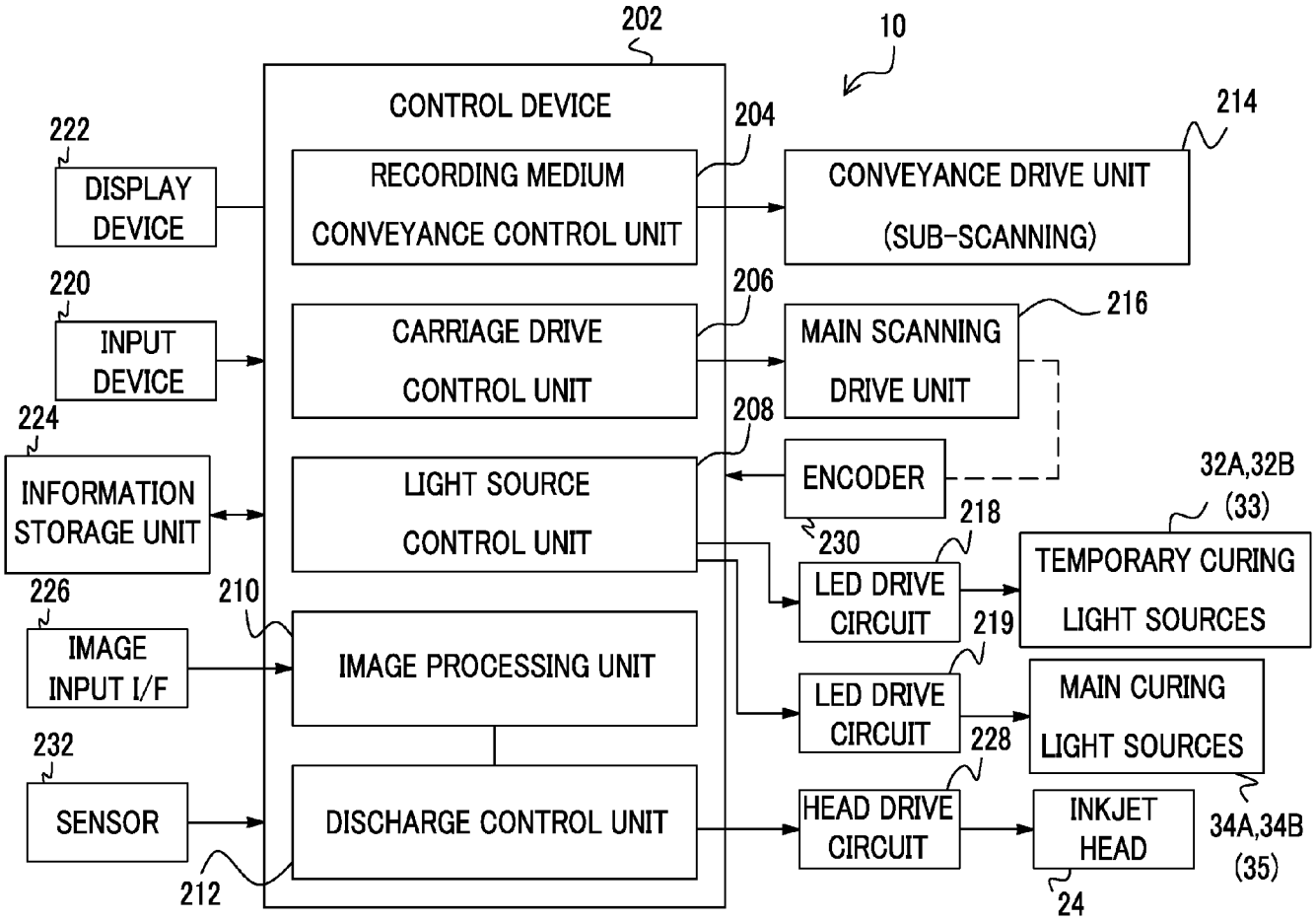
FIG. 11 is a block diagram showing an example of a configuration of the inkjet recording apparatus suitably used in the present invention.

FIG. 11 is a block diagram showing a configuration of the inkjet recording apparatus 10. As shown in the drawing, in the inkjet recording apparatus 10, a control device 202 is provided as a control unit. For the control device 202, it is possible to use, for example, a computer equipped with a central processing unit (CPU), or the like. The control device 202 corresponds to the control unit 138 shown in FIG. 4 and functions as a controller for controlling the whole of the inkjet recording apparatus 10 according to predetermined programs, as well as functioning as a calculation device for performing various calculations. The control device 202 includes a recording medium conveyance control unit 204, a carriage drive control unit 206, a light source control unit 208, an image processing unit 210, and a discharge control unit 212. Each of these units is realized by a hardware circuit or software, or a combination of these units.

The recording medium conveyance control unit 204 controls a conveyance drive unit 214 for conveying the recording medium 12 (refer to FIG. 7). The conveyance drive unit 214 corresponds to the recording medium conveyance mechanism 132 shown in FIG. 4 and includes a drive motor which drives the nip rollers 40 shown in FIG. 8, and a drive circuit thereof. The recording medium 12 which is conveyed on the platen 26 (refer to FIG. 7) is conveyed intermittently in swath width units in the sub-scanning direction according to a reciprocal scanning action (printing pass action) in the main scanning direction performed by the inkjet head 24.

The carriage drive control unit 206 shown in FIG. 11 controls a main scanning drive unit 216 for moving the carriage 30 (refer to FIG. 7) in the main scanning direction. The main scanning drive unit 216 corresponds to the carriage scanning mechanism 130 shown in FIG. 4 and includes a drive motor which is connected to a movement mechanism of the carriage 30, and a control circuit thereof.

The light source control unit 208 is a control unit which controls the amount of light emission from the UV-LED elements 33 of the temporary curing light sources 32A and 32B through an LED drive circuit 218, as well as controlling the amount of light emission from the UV-LED elements 35 of the main curing light sources 34A and 34B through an LED drive circuit 219.

The LED drive circuit 218 outputs voltage with a voltage value according to a command from the light source control unit 208 to control the amount of light emission of the UV-LED elements 33. The LED drive circuit 219 outputs voltage with a voltage value according to a command from the light source control unit 208 to control the amount of light emission of the UV-LED elements 35. The amount of light emission may be adjusted by changing the duty ratio of the drive waveform using a PWM (pulse width modulation) without changing the voltage or changing both the voltage value and the duty ratio.

An input device 220 such as an operation panel and a display device 222 are connected to the control device 202.

The input device 220 is a device by which external operating signals are manually input to the control device 202, and can employ various modes, such as a keyboard, a mouse, a touch panel, operating buttons, or the like. The display device 222 can employ various modes, such as a liquid crystal display, an organic EL display, a CRT, or the like. An operator can select an image formation mode, input print conditions, and input and edit additional information and the like, by operating the input device 220, and can confirm the input details and various information such as search results, through the display on the display device 222.

Furthermore, in the inkjet recording apparatus 10, an information storage unit 224, which stores various information, and an image input interface 226 for acquiring image data for printing are provided. A serial interface or a parallel interface may be employed for the image input interface. The image input interface may be provided with a buffer memory (not shown) for achieving high-speed communications.

The image data input through the image input interface 226 is converted into data for printing (dot data) by the image processing unit 210. In general, the dot data is generated by subjecting the multiple-tone image data to color conversion processing and half-tone processing.

The method of performing the half-tone processing can employ commonly known methods of various kinds, such as an error diffusion method, a dithering method, a threshold value matrix method, a density pattern method, and the like. The half-toning processing generally converts tonal image data having M values ($M \geq 3$) into tonal image data having N values ($N < M$). In the simplest example, the image data is converted into dot image data having 2 values (dot on/off), but in a half-toning process, it is also possible to perform quantization in multiple values which correspond to different types of dot sizes (for example, three types of dots: a large dot, medium dot and small dot).

The binary or multiple-value image data (dot data) obtained in this manner is used for "driving (on)" or "not driving (off)" each nozzle, or in the case of multiple-value data, is also used as ink discharge data (droplet control data) for controlling the droplet amounts (dot sizes).

The discharge control unit 212 generates discharge control signals for a head drive circuit 228 based on the dot data generated in the image processing unit 210. Furthermore, the discharge control unit 212 includes a drive waveform generation unit (not shown). The drive waveform generation unit is an unit which generates a drive voltage signal for driving the discharge energy generation elements (in the example, the piezoelectric elements) which correspond to each nozzle of the inkjet head 24.

The waveform data of the drive voltage signal is stored in the information storage unit 224 in advance and waveform data to be used is output as necessary. The signal (drive waveform) output from the drive waveform generation unit is supplied to the head drive circuit 228. The signal output from the drive waveform generation unit may be digital waveform data or an analog voltage signal.

A common drive voltage signal is applied to each discharge energy generation element of the inkjet head 24 via the head drive circuit 228 while switching elements (not shown) connected to the individual electrodes of each energy generating element are turned on and off according to the discharge timings of each nozzle, and the ink is discharged from the corresponding nozzles.

Programs to be executed by the CPU of the control device 202 and various data required for control purposes are stored in the information storage unit 224. The information storage unit 224 stores resolution setting information corresponding to the image formation mode, the number of passes (number of scanning repetitions), and information on the amount of light emission of the temporary curing light sources 32A and 32B and the main curing light sources 34A and 34B, and the like.

An encoder 230 is attached to the drive motor of the main scanning drive unit 216 and the drive motor of the conveyance drive unit 214, and outputs a pulse signal corresponding to the amount of rotation and the speed of rotation of each drive motor, this pulse signal being supplied to the control device 202. The position of the carriage 30 and the position of the recording medium 12 (refer to FIG. 7) are ascertained based on the pulse signal output from the encoder 230.

A sensor 232 is attached to the carriage 30 for ascertaining the width of the recording medium 12 based on a sensor signal obtained from the sensor 232.

According to the inkjet recording apparatus 10 having the configuration described above, the heads for inks of respective colors are respectively shifted in the recording medium conveyance direction within the nozzle pitch, the head of ink having a lower sensitivity is arranged on the more upstream side in the recording medium conveyance direction, and the ink having a lower sensitivity is arranged on the lower layer so as to perform recording. Therefore, the state of the surface layer is kept constant at all times and gloss unevenness can be reduced.

In the above-mentioned embodiment, an example in which an image is formed using UV curable inks has been described, but the embodiment can be applied to a case of using a curable ink cured by providing active energy. For example, inks cured with X rays, molecular beams, or ion beams can be used.

<Discharge Step>

The inkjet recording method of the present invention includes a step of discharging at least one type of the ink on the recording medium from the inkjet head in the inkjet recording apparatus.

The discharge step is preferably a step of discharging at least two types of inks from the inkjet head in the inkjet recording apparatus, and more preferably a discharge step of discharging inks of at least four colors of cyan, magenta, yellow and black from the inkjet head in the inkjet recording apparatus. In the above-mentioned embodiment, the effect of the present invention can be more exhibited.

In addition, the scanning speed of the inkjet head is preferably 0.5 m/s or more in the discharge step, more preferably 0.7 m/s or more, and still more preferably 0.9 m/s or more. Further, the scanning speed is preferably 3.5 m/s or less, more preferably 3.0 m/s or less, and still more preferably 2.5 m/s or less. In the above-mentioned embodiment, gloss unevenness easily occurs in an image and the effect of the present invention can be more exhibited.

In the present invention, the recording medium is not particularly limited and known recording mediums can be used. For example, there may be paper, paper laminated with plastic (for example, polyethylene, polypropylene and polystyrene), metal sheets (for example, aluminium, zinc and copper), plastic films (for example, cellulose diacetate, cellulose triacetate, cellulose propionate, cellulose butyrate, cellulose acetate butyrate, cellulose nitrate, polyethylene terephthalate, polyethylene, polystyrene, polypropylene, polycarbonate and polyvinylacetal), the above-mentioned metal-laminated or deposited paper and plastic films.

The ink is preferably discharged in the discharging step after being heated to preferably 25° C. to 80° C. and more preferably 25° C. to 50° C., so as to reduce the viscosity of the ink to preferably 3 to 15 mPa·s, and more preferably 3 to 13 mPa·s. Particularly, as in the present invention, it is preferable to use the ink having an ink viscosity at 25° C. of 10 to 30 mPa·s since good discharge can be obtained. By using this method, high discharge stability can be realized.

Since a radiation curing type ink generally has a viscosity which is higher than that of a water-based ink composition used in an inkjet recording ink, variation in viscosity due to a change in temperature at the time of discharge is large. Viscosity variation in the ink has a large influence on changes in ink droplet size and changes in ink droplet discharge speed and, consequently, causes the image quality to be degraded. Therefore, it is necessary to maintain the ink temperature as constant as possible at the time of discharge. Accordingly, the control range for the temperature of ink is preferably ±5° C. of a set temperature, more preferably ±2° C. of the set temperature, and still more preferably ±1° C. of the set temperature.

<Curing Step>

The inkjet recording method of the present invention includes a step of curing the discharged ink by irradiating the ink with active energy from the active energy providing unit.

The ink discharged on the recording medium is cured by active energy irradiation.

The maximum illumination intensity on the surface of the recording medium by the active energy providing unit is preferably 10 to 3,000 mW/cm$^2$, more preferably 50 to 2,100 mW/cm$^2$, and still more preferably 100 to 1,600 mW/cm$^2$, from the viewpoint of image quality and productivity.

The energy provided by the light emission diode of the active energy providing unit, that is, by ultraviolet light irradiation, the energy which is provided to the ink on the recording medium (integrated amount of light) is preferably 100 to 1,000 mJ/cm$^2$, 150 to 800 mJ/cm$^2$, and still more preferably 200 to 700 mJ/cm$^2$. When the energy amount is in the above-mentioned range, both productivity and curability can be achieved.

In the inkjet recording method of the present invention, the active energy irradiation is performed for preferably 0.1 to 2 seconds, more preferably 0.2 to 1.5 seconds, and still more preferably 0.3 to 1 second.

The active energy irradiation is performed after a predetermined time (for example, preferably 0.01 to 0.5 seconds, more preferably 0.01 to 0.3 seconds, and still more preferably 0.01 to 0.15 seconds) has elapsed from when the ink has landed on the recording medium. By controlling the time from ink landing to the irradiation so as to be a minimum in this manner, it is possible to prevent the ink that has landed on the recording medium from bleeding before being cured. Furthermore, even when the ink is discharged onto a porous recording medium, the ink can be exposed before the ink penetrates to a deep area of that the light source cannot reach, and therefore, it is possible to inhibit the monomers from remaining unreacted.

As described above, the inkjet recording apparatus used in the present invention preferably includes a second active energy providing unit that further provides active energy to the ink droplets to which the active energy has been provided by the active energy providing unit to perform main curing of the ink droplets.

Further, the curing step preferably includes a temporary curing (also referred to as "half curing) step of incompletely curing the discharged ink by the irradiation with the active energy from the active energy providing unit, and a main curing step of completely curing the ink which has been incompletely cured in the temporary curing step with the irradiation with active energy from the second active energy providing unit.

The "complete curing" in the present invention refers to a state in which the inside and the surface of the ink are completely cured. Specifically, it can be determined that whether or not the ink is transferred onto an osmotic medium such as plain paper by pressing the osmotic medium against the ink. That is, the case where the ink is not transferred to the medium at all refers to a state in which the ink is completely cured.

In addition, the "half curing" in the present invention refers to a state from the time when the ink starts curing until the time when the ink reaches the complete curing.

The illumination intensity of the active energy providing unit in the temporary curing step is preferably 50 to 1,000 $mW/cm^2$, and more preferably 100 to 500 $mW/cm^2$. When the illumination intensity is in the above-mentioned range, spreadability and wettability of droplets is particularly accelerated and thus, a printed material having excellent glossiness can be obtained. Further, a printed material in which interference among dropped droplets does not easily occur and streak unevenness is unremarkable can be obtained.

In addition, in the temporary curing step, the discharged ink is irradiated with the active energy from the active energy providing unit within preferably 0 to 1.0 second after the discharge of ink, more preferably 0 to 0.7 seconds after the discharge of ink, still more preferably 0 to 0.5 seconds after the discharge of ink, and particularly preferably 0 to 0.4 seconds after the discharge of ink.

In the main curing step, the upper limit of the time elapsed from the time when the ink is discharged until the time when the active energy irradiation is performed in the main curing step is not rigorously defined, but the upper limit is preferably within 1 minute, more preferably within 30 seconds, and particularly preferably within 10 seconds from the viewpoint of suppression of contamination such as attachment of dust in the air or the like. Further, the lower limit is not particularly limited as long as the main curing is performed after the temporary curing step.

The illumination intensity of the second active energy providing unit is preferably 600 to 3,000 $mW/cm^2$, more preferably 700 to 2,100 $mW/cm^2$, and particularly preferably 800 to 1,800 $mW/cm^2$ from the viewpoint of a balance being achieved between productivity/rapid drying and spreadability and wettability of dropped droplets.

Further, the inkjet recording method of the present invention may include steps other than the above-mentioned steps as necessary.

<Ink>

In the inkjet recording method of the present invention, inks of at least four colors of cyan, magenta, yellow and black are used.

In addition, other inks may be used as well as the inks of the four colors in the inkjet recording method of the present invention. For example, there may be light inks such as a light cyan ink and light magenta ink, a white ink, a clear ink, an orange ink, a green ink, a violet ink and the like.

In the inkjet recording method of the present invention, in addition to the inks of the four color, at least one type of a light ink is preferably used among the light inks, and in addition to the inks of the four color, a light cyan ink and a light magenta ink are more preferably used.

The light cyan ink may be a cyan ink having a lower coloring agent concentration than that of the cyan ink, and the light magenta ink may be a magenta ink having a lower coloring agent concentration than that of the magenta ink. Further, the light ink is preferably an ink with a content of the coloring agent of 2% by mass or less with respect to a total amount of the ink composition.

In addition, the clear ink substantially does not contain a coloring agent and is a transparent ink composition. The clear ink may be used for forming an undercoat layer or an overcoat layer (protective layer) in the inkjet recording method of the present invention.

The viscosity of any of the inks of the four colors used in the present invention at 25° C. is 10 to 30 mPa·s and preferably 15 to 25 mPa·s. When the viscosity is in the above-mentioned range, an image in which gloss unevenness and graininess are reduced can be obtained.

Further, the viscosity of any of the inks used in the present invention at 25° C. is preferably 10 to 30 mPa·s, and more preferably 15 to 25 mPa·s. When the viscosity is in the above-mentioned range, an image in which gloss unevenness and graininess are further reduced can be obtained.

The viscosity is a viscosity at 25° C. and preferably a viscosity measured using a VISCOMETER TV-22LT (manufactured by TOKI SANGYO CO., LTD.) at 25° C.

Among the inks of the four colors used in the present invention, the surface tension of at least one type of the ink at 25° C. is preferably 23 to 39 mN/m and more preferably 30 to 39 mN/m. When the surface tension is in the above-mentioned range, an image in which gloss unevenness and graininess are further reduced can be obtained.

In addition, the surface tension of any one of the inks of the four colors used in the present invention at 25° C. is preferably 23 to 39 mN/m, and more preferably 30 to 39 mN/m. When the surface tension is in the above-mentioned range, an image in which gloss unevenness and graininess are further reduced can be obtained.

Furthermore, the surface tension of all the inks used in the present invention at 25° C. is preferably 23 to 39 mN/m, and more preferably 30 to 39 mN/m. When the surface tension is in the above-mentioned range, an image in which gloss unevenness and graininess are further reduced can be obtained.

The surface tension of the inks used in the present invention is a value measured at 25° C. by the Wilhelmy method using a commonly used surface tensiometer (for example, an AUTOMATIC SURFACE TENSIOMETER CBVP-Z, manufactured by Kyowa Interface Science Co., LTD., and the like).

The ink used in the present invention is an inkjet ink composition, that is, an inkjet recording ink composition.

The ink composition used in the present invention is preferably an oil-based ink composition and preferably an active energy curable ink composition.

In addition, the ink composition used in the present invention does not contain a highly volatile solvent and is preferably solvent-free.

The "active energy" used in the present invention is not particularly limited as long as irradiation with the energy rays can provide an energy that is configured to generate an initiator species in a composition, and broadly includes α-rays, γ-rays, X-rays, ultraviolet rays (UV), visible rays, electron beams and the like. Among these, ultraviolet rays and electron beams are preferable, and particularly ultraviolet rays are preferable, from the viewpoint of curing sensitivity and easy availability of the apparatus. Accordingly, as the ink composition used in the present invention, an ink composition that can be cured by ultraviolet irradiation is preferable.

Hereinafter, components contained in the respective ink compositions that can be used in the inkjet recording method of the present invention will be described.

(Component A) Polymerizable Compound

The ink used in the present invention preferably contains (component A) a polymerizable compound.

As the polymerizable compound, there may be a radically polymerizable compound and a cationic polymerizable compound, and a radically polymerizable compound is preferably contained in the ink.

In addition, as the radically polymerizable compound, an ethylene unsaturated compound is preferable and a (meth) acrylate compound and an N-vinyl compound are more preferable.

The ink used in the present invention preferably contains an N-vinyl compound as a radically polymerizable compound.

As the N-vinyl compound, N-vinyl lactams are preferable and a compound represented by Formula (a-1) is more preferable.

[Chem. 1]

(a-1)

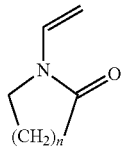

In Formula (a-1), n represents an integer of 1 to 5, n is preferably an integer of 2 to 4 from the viewpoint of flexibility after the ink composition is cured, adhesion to a recording medium, and ease of availability of starting material, n is more preferably an integer of 2 or 4, and n is particularly preferably 4, which is N-vinylcaprolactam. N-vinylcaprolactam is preferable since N-vinylcaprolactam has excellent safety, is commonly used and easily available at a relatively low price, and gives particularly good ink curability and adhesion of a cured film to a recording medium.

The content of the N-vinyl compound in the ink used in the present invention is preferably 5% by mass to 60% by mass with respect to the mass of the entire ink composition, more preferably 15% by mass to 35% by mass. When the content is 5% by mass or more, the adhesion to a recording medium is excellent, and when the content is 60% by mass or less, the storage stability is excellent.

The ink used in the present invention preferably contains a compound represented by Formula (a-2) as a radically polymerizable compound.

[Chem. 2]

(a-2)

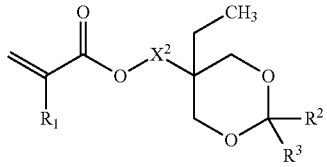

(In Formula (a-2), $R^1$,$R^2$, and $R^3$ independently represent a hydrogen atom, a methyl group, or an ethyl group, and $X^2$ represents a single bond or a divalent linking group)

$R^1$ is preferably a hydrogen atom or a methyl group, and more preferably a hydrogen atom.

$R^2$ and $R^3$ are independently preferably a hydrogen atom or a methyl group, and more preferably a hydrogen atom, and it is still more preferable that both $R^2$ and $R^3$ are hydrogen atoms.

The divalent linking group represented by $X^2$ is not particularly limited as long as the effect of the present invention is not greatly impaired, and is preferably a divalent hydrocarbon group or a divalent group in which a hydrocarbon group and an ether bond are combined, and more preferably a divalent hydrocarbon group, poly(alkyleneoxy) group, or poly(alkyleneoxy)alkyl group. Furthermore, the number of carbons of the divalent linking group is preferably 1 to 60, and more preferably 1 to 20.

$X^2$ is preferably a single bond, a divalent hydrocarbon group, or a divalent group in which a hydrocarbon group and an ether bond are combined, more preferably a divalent hydrocarbon group having 1 to 20 carbons, still more preferably a divalent hydrocarbon group having 1 to 8 carbons, and particularly preferably a methylene group.

Specific examples of the compound represented by Formula (a-2) are cited below, but it is not limited to these compounds. In the specific examples below, R represents a hydrogen atom or a methyl group.

[Chem. 3]

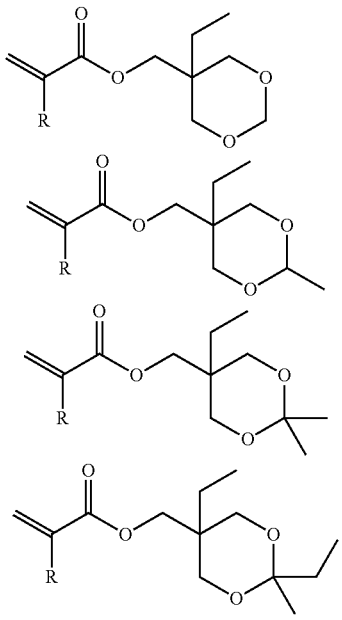

-continued

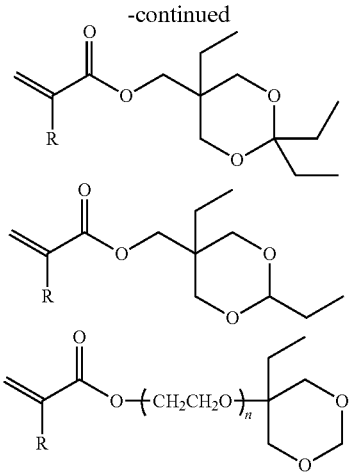

n = 1~30

Among them, cyclic trimethylolpropane formal (meth) acrylate is preferable, and cyclic trimethylolpropane formal acrylate is particularly preferable. The compound represented by Formula (a-2) may be a commercial product, and specific examples of the commercial product include SR531 (manufactured by Sartomer Japan Inc)

From the viewpoint of adhesion between a recording medium and an image and curability of the ink composition, the content of the compound represented by Formula (a-2) is preferably 1% by mass to 70% by mass with respect to the total mass of the ink composition, more preferably 3% by mass to 65% by mass, and still more preferably 5% by mass to 60% by mass, and most preferably 5% by mass to 50% by mass.

The ink used in the present invention preferably contains hydroxyalkyl (meth)acrylate as a radically polymerizable compound.

As hydroxyalkyl (meth)acrylate, 2-hydroxyethyl (meth) acrylate, 2-hydroxypropyl (meth)acrylate, 4-hydroxybutyl (meth)acrylate and the like are preferably used. Among them, 4-hydroxybutyl (meth)acrylate is particularly preferable.

From the viewpoint of adhesion between a recording medium and an image and curability of the ink composition, the content of hydroxyalkyl (meth)acrylate is preferably 1% by mass to 70% by mass with respect to the total mass of the ink composition, more preferably 3% by mass to 65% by mass, and still more preferably 5% by mass to 60% by mass.

Preferred examples of the ink used in the present invention include an aromatic hydrocarbon group-containing monofunctional (meth)acrylate as a radically polymerizable compound.

The aromatic hydrocarbon group-containing monofunctional (meth)acrylate preferably has a molecular weight of 500 or less and more preferably has a molecular weight of 300 or less.

As the aromatic hydrocarbon group-containing monofunctional (meth)acrylate, there may be an aromatic monofunctional radically polymerizable monomer described in paragraphs 0048 to 0063 of JP2009-096985A. In the present invention, the aromatic hydrocarbon group-containing monofunctional (meth)acrylate is preferably a compound represented by Formula (a-4).

[Chem. 4]

(a-4)

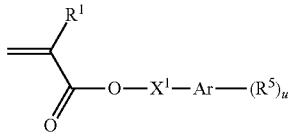

(In Formula (a-4), $R^1$ represents a hydrogen atom or a methyl group, $X^1$ represents a divalent linking group, Ar represents an aromatic hydrocarbon group, $R^5$ represents a substituent, u represents an integer of 0 to 5, and the u $R^5$s may be identical to or different from each other)

In Formula (a-4), $R^1$ is preferably a hydrogen atom.

$X^1$ represents a divalent linking group, and preferably an ether bond (—O—), an ester bond (—C(O)O— or —OC(O)—), an amide bond (—C(O)NR'— or —NR'C(O)—), a carbonyl group (—C(O)—), an imino group (—NR'—), an optionally substituted alkylene group having 1 to 15 carbons, or a divalent group in which two or more thereof are combined. R' represents a hydrogen atom, a straight-chain, branched, or cyclic alkyl group having 1 to 20 carbons, or an aryl group having 6 to 20 carbons. Examples of the substituent include a hydroxy group and a halogen atom.

The moiety containing $R^1$ and $X^1$ ($H_2C{=}C(R^1)$—C(O)O—$X^1$—) can be bonded to any position of the aromatic hydrocarbon structure. From the viewpoint of improving affinity with a coloring agent, the end of $X^1$ bonded to the aromatic hydrocarbon group is preferably an oxygen atom, and more preferably an ethereal oxygen atom. $X^1$ in Formula (a-4) is preferably *-$(LO)_q$—. Here, * represents the position at which the carbonic ester bond in Formula (a-4) are bonded, q is an integer of 0 to 10, and L represents an alkylene group having 2 to 4 carbons. q is preferably an integer of 0 to 4, more preferably an integer of 0 to 2, and still more preferably 1 or 2. $(LO)_q$ is preferably an ethylene oxide chain or a propylene oxide chain.

Ar represents an aromatic hydrocarbon group. Examples of the aromatic hydrocarbon group include a monocyclic or polycyclic aromatic hydrocarbon group having 1 to 4 rings. Specific examples thereof include a group in which at least one hydrogen atom is removed from benzene, naphthalene, anthracene, 1H-indene, 9H-fluorene, 1H-phenalene, phenanthrene, triphenylene, pyrene, naphthacene, tetraphenylene, biphenylene, as-indacene, s-indacene, acenaphthylene, fluoranthene, acephenanthrylene, aceanthrylene, chrysene, pleiadene and the like.

Among them, in the present invention, a phenyl group and a naphthyl group are preferable, and a monocyclic aromatic hydrocarbon group, that is a phenyl group, is more preferable.

It is preferable that the u $R^5$s independently represent a halogen atom, a carboxy group, an acyl group having 1 to 10 carbons, a hydroxy group, a substituted or unsubstituted amino group, a thiol group, a siloxane group, or an optionally substituted hydrocarbon group, or heterocyclic group having a total number of carbons of 30 or less. The substituents include a hydroxy group, an alkyl group having 1 to 10 carbons, and an aryl group having 6 to 12 carbons.

u represents an integer of 0 to 5, and is preferably 0.

The compound represented by Formula (a-4) is preferably a compound having a phenyl group, more preferably 2-phenoxyethyl (meth)acrylate or benzyl (meth)acrylate, still more preferably 2-phenoxyethyl (meth)acrylate, and particularly preferably 2-phenoxyethyl acrylate.

From the viewpoint of inkjet discharge properties and flexibility, the content of the aromatic hydrocarbon group-containing monofunctional (meth)acrylate is preferably 1% by mass to 50% by mass with respect to the total mass of the ink composition, more preferably 3% by mass to 45% by mass, and still more preferably 5% by mass to 40% by mass.

As monofunctional (meth)acrylate other than above-mentioned monofunctional (meth)acrylate, there may be isoamyl (meth)acrylate, stearyl (meth)acrylate, lauryl (meth)acrylate, octyl (meth)acrylate, isooctyl (meth)acrylate, decyl (meth)acrylate, isomyristic (meth)acrylate, isostearyl (meth) acrylate, 2-ethylhexyl diglycol (meth)acrylate, 2-methoxyethyl (meth)acrylate, buthoxyethyl (meth)acrylate, methoxydiethylene glycol (meth)acrylate, methoxypolyethylene glycol (meth)acrylate, methoxypropylene glycol (meth)acrylate, tetrahydrofurfuryl (meth)acrylate, isobornyl (meth)acrylate, 2-(meth)acryloyloxyethylsuccinic acid, 2-(meth)acryloyloxyethyl-2-hydroxyethylphthalic acid, a lactone-modified flexible (meth)acrylate, t-butylcyclohexyl (meth)acrylate, 2-(2-ethoxyethoxy)ethyl (meth)acrylate, cyclopentenyl (meth)acrylate, cyclopentenyloxyethyl (meth)acrylate, dicyclopentanyl (meth)acrylate and the like.

Among them, 2-methoxyethyl (meth)acrylate, isobornyl (meth)acrylate and 2-(2-ethoxyethoxy)ethyl (meth)acrylate are preferable.

The total content of the monofunctional radically polymerizable compounds in the ink is preferably 50% by mass to 90% by mass with respect to the total amount of the radically polymerizable compounds, more preferably 55% by mass to 90% by mass, and still more preferably 65% by mass to 85% by mass. When the content of the monofunctional polymerizable compound is in the above-mentioned range, an image having excellent ink-ink and ink-recording medium adhesion and excellent flexibility can be obtained.

The ink used in the present invention preferably contains a polyfunctional (meth)acrylate compound. Due to the ink containing a polyfunctional (meth)acrylate compound, high curability can be obtained.

Specific examples of the polyfunctional (meth)acrylate compound include trimethylolpropane tri(meth)acrylate, ethoxylated (3) trimethylolpropane tri(meth)acrylate (compound formed by tri(meth)acrylating a 3-mol adduct of trimethylolpropane ethylene oxide), propoxylated (3) trimethylolpropane tri(meth)acrylate (compound formed by tri (meth)acrylating a 3-mol adduct of trimethylolpropane propylene oxide), bis (4-acryloxypolyethoxyphenyl)propane, neopentyl glycol di(meth)acrylate, ethoxylated (2) neopentylglycol di(meth)acrylate(compound formed by diacrylating a 2-mol adduct of neopentylglycol ethylene oxide), propoxylated (2) neopentylglycol di(meth)acrylate(compound formed by diacrylating a 2-mol adduct of neopentylglycol propylene oxide), 1,6-hexanediol di(meth)acrylate, 1,9-nonanediol di(meth)acrylate, ethylene glycol di(meth) acrylate, diethylene glycol di(meth)acrylate, triethylene glycol di(meth)acrylate, tetraethylene glycol di(meth)acrylate, polyethylene glycol di(meth)acrylate, dipropylene glycol di(meth)acrylate, tripropylene glycol di(meth)acrylate, tetrapropylene glycol di(meth)acrylate, polypropylene glycol di(meth)acrylate, pentaerythritol tri(meth)acrylate, pentaerythritol tetra(meth)acrylate, dipentaerythritol tetra(meth) acrylate, tetramethylolmethane tetra(meth)acrylate, tetramethylolmethane tri(meth)acrylate, dimethyloltricyclodecane di(meth)acrylate, modified glycerol tri(meth)acrylate, modified bisphenol A di(meth)acrylate, bisphenol A propylene oxide (PO) adduct di(meth)acrylate, bisphenol A ethylene oxide (EO) adduct di(meth)acrylate, dipentaerythritol hexa (meth)acrylate, and caprolactone-modified dipentaerythritol hexa(meth)acrylate.

Among them, polyfunctional alkoxylated (meth)acrylate compounds are preferable and ethoxylated (3) trimethylolpropane tri(meth)acrylate is particularly preferable.

From the viewpoint of curability, the total content of the polyfunctional (meth)acrylate is preferably 1% by mass to 30% by mass with respect to the total mass of the ink composition, more preferably 3% by mass to 25% by mass, still more preferably 5% by mass to 20% by mass, and particularly preferably 5% by mass to 15% by mass.

The ink used in the present invention preferably contains an oligomer.

The "oligomer" is a polymer which generally has a limited number (generally 5 to 100) of monomer-based constituent units. A weight average molecular weight of the oligomer is preferably 400 to 10,000 and more preferably 500 to 5,000.

The oligomer is preferably a compound preferably having polymerizable group, more preferably having an ethylenically unsaturated group, and particularly preferably having a (meth)acryloly group, as a functional group.

From the viewpoint of a balance between flexibility and curability, the number of the functional groups contained in the oligomer is preferably 1 to 15 per oligomer molecule, more preferably 2 to 6, still more preferably 2 to 4, and particularly preferably 2.

Examples of the oligomer in the present invention include a polyester (meth)acrylate-based oligomer, an olefin-based oligomer (an ethylene oligomer, a propylene oligomer, a butene oligomer and the like), a vinyl-based oligomer (a styrene oligomer, a vinyl alcohol oligomer, a vinylpyrrolidone oligomer, a (meth)acrylate oligomer and the like), a diene-based oligomer (a butadiene oligomer, a chloroprene rubber, a pentadiene oligomer and the like), a ring-opening polymerization type oligomer (di-, tri-, tetra-ethylene glycol, polyethylene glycol, polyethylimine and the like), an addition-polymerization type oligomer (an oligoester (meth) acrylate, a polyamide oligomer and a polyisocyanate oligomer), an addition-condensation oligomer (a phenolic resin, an amino resin, a xylene resin, a ketone resin and the like), and amine-modified polyester oligomer. Among them, a urethane (meth)acrylate and a polyester (meth)acrylate are more preferable, and a urethane (meth)acrylate is particularly preferable since the ink composition with excellent curability and adhesion can be obtained. The oligomer may be used singly or in combination of plural types.

As the urethane (meth)acrylate, there may be an aliphatic urethane (meth)acrylate, an aromatic urethane (meth)acrylate and the like. Specifically, an "Oligomer Handbook" (edited by Junji Furukawa, The Chemical Daily Co., Ltd.) can be referred to.

Examples of the urethane (meth)acrylate include U-2PPA, U-4HA, U-6HA, U-6LPA, U-15HA, U-324A, UA-122P, UA5201, UA-512 and the like manufactured by Shin-Nakamura Chemical Co., Ltd.; CN964A85, CN964, CN959, CN962, CN963J85, CN965, CN982B88, CN981, CN983, CN996, CN9002, CN9007, CN9009, CN9010, CN9011, CN9178 and CN9788, CN9893 manufactured by Sartomer Japan Inc.; and EB204, EB230, EB244, EB245, EB270, EB284, EB285, EB810, EB4830, EB4835, EB4858, EB1290, EB210, EB215, EB4827, EB4830, EB4849, EB6700, EB204, EB8402, EB8804, EB8800-20R and the like manufactured by DAICEL-CYTEC Company LTD.

Examples of the amine-modified polyester oligomer include EB524, EB80 and EB81 manufactured by DAICEL- CYTEC Company LTD.; CN550, CN501 and CN551 manufactured by Sartomer Japan Inc.; and GENOMER5275 manufactured by RAHN AG From the viewpoint of compatibility between curability and adhesion, the content of the oligomer is preferably 1% by mass to 10% by mass with respect to the total mass of the ink composition, more preferably 2% by mass to 8% by mass, and still more preferably 3% by mass to 7% by mass.

The total content of all (Component A) the polymerizable compounds in the ink composition is preferably 65% by mass to 99% by mass, and more preferably 70% by mass to 90% by mass.

(Component B) Polymerization Initiator

The ink used in the present invention preferably contains (Component B) a polymerization initiator.

As the polymerization initiator, there may be a radical polymerization initiator and a cationic polymerization initiator, and a radical polymerization initiator is preferably contained in the ink.

As the polymerization initiator, a known polymerization initiator can be used. The polymerization initiator that can be used in the present invention may be used singly or in combination of two or more types. In addition, a radical polymerization initiator and cationic polymerization initiator may be used in combination.

The polymerization initiator that can be used in the present invention is a compound which forms a polymerization initiating species by absorbing external energy. The external energy used for initiating polymerization can be broadly divided into heat and active energy rays, and a thermal polymerization initiator and a photopolymerization initiator are used respectively. Examples of the active energy rays include γ rays, β rays, an electron beams, ultraviolet rays, visible rays and infrared rays.

Examples of the polymerization initiator that can be used in the present invention include (a) an aromatic ketone, (b) an acylphosphine compound, (c) an aromatic onium salt compound, (d) an organic peroxide, (e) a thio compound, (f) a hexaarylbiimidazole compound, (g) a ketoxime ester compound, (h) a borate compound, (i) an azinium compound, (j) a metallocene compound, (k) an active ester compound, (l) a compound having a carbon-halogen bond, (m) an alkylamine compound and the like. With regard to these polymerization initiators, the above-mentioned compounds (a) to (m) may be used singly or in combination. Details of the above-mentioned polymerization initiators are known to a person skilled in the art, and are described in, for example, JP2009-185186A.

The polymerization initiator of the present invention can be suitably used singly or in combination of two or more types, and a combination of two or more types is preferable, a combination of three or more types is more preferable, and a combination of three to five types is still more preferable.

The polymerization initiator in the present invention may contain a compound which functions as a sensitizer (hereinafter, simply referred to as a "sensitizer") in order to accelerate decomposition of the polymerization initiator by absorbing specific active energy rays.

Examples of the sensitizer include polynuclear aromatics (for example, pyrene, perylene, triphenylene, 2-ethyl-9,10-dimethoxy anthracene and the like), xanthenes (for example, fluorescein, eosin, erythrosine, rhodamine B, rose Bengal, and the like), cyanines (for example, thiacarbocyanine, oxacarbocyanine and the like), merocyanines (for example, merocyanine, carbomerocyanine and the like), thiaxines (for example, thionine, methylene blue, toluidine blue and the like), acridines (for example, acridine orange, chloroflavin, acriflavine and the like), anthraquinones (for example, anthraquinone and the like), squaryliums (for example, squarylium and the like), coumarins (for example, 7-diethylamino-4-methyl coumarin and the like), and the like.

In addition, the sensitizer may be used singly or in combination of two or more types.

As the radical polymerization initiator, at least one type of a compound selected from the group consisting of a bisacylphosphine compound, a monoacylphosphine compound, an α-hydroxy ketone compound, an α-amino ketone compound, a thioxanthone compound and a thiochromanone compound, is preferably used, at least two types of compounds selected from the group consisting of a bisacylphosphine compound, a monoacylphosphine compound, an α-hydroxy ketone compound, an α-amino ketone compound, a thioxanthone compound and a thiochromanone compound, are more preferably used, at least three types of compounds selected from the group consisting of a bisacylphosphine compound, a monoacylphosphine compound, an α-hydroxy ketone compound, an α-amino ketone compound, a thioxanthone compound and a thiochromanone compound, are still more preferably used, and at least three types of compounds selected from the group consisting of a bisacylphosphine compound, a monoacylphosphine compound, an α-hydroxy ketone compound and a thioxanthone compound, are particularly preferably used.

Preferred examples of the bisacylphosphine compound and the monoacylphosphine compound include a bisacylphosphine oxide compound and a monoacylphosphine compound described in paragraphs 0080 to 0098 of JP2009-096985A.

Among them, as the bisacylphosphine oxide compound, bis(2,4,6-trimethylbenzoyl)phenylphosphine oxide is preferable.

Further, as the monoacylphosphine oxide compound, 2,4,6-trimethylbenzoyldiphenylphosphine oxide is preferable.

Examples of the α-hydroxy ketone compound include 1-[4-(2-hydroxyethoxy)-phenyl]-2-hydroxy-2-methyl-1-propane-1-one, 2-hydroxy-2-methyl-1-phenyl propan-1-one, 1-hydroxycyclohexyl phenyl ketone and the like.

Examples of the α-amino ketone compound include 2-methyl-1-phenyl-2-morpholino propan-1-one, 2-methyl-1-[4-(hexyl)phenyl]-2-morpholino propan-1-one, 2-ethyl-2-dimethylamino-1-(4-morpholino phenyl)-butane-1-one and the like.

Preferred examples of the thioxanthone compound include 2,4-diethylthioxanthone, 2-isopropylthioxanthone and 4-isopropylthioxanthone.

Examples of the thiochromanone compound preferably include the following (I-1) to (I-31), more preferably include (I-14), (I-17) and (I-19), and particularly preferably include (I-14).

[Chem. 5]

(I-1)

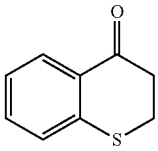

(I-2)

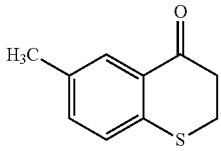

-continued
(I-3)
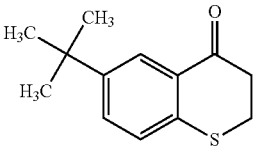
(I-4)
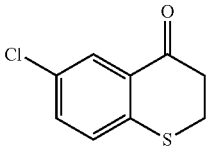
(I-5)
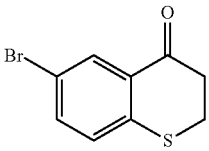
(I-6)
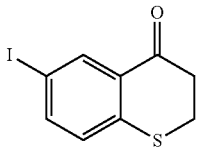
(I-7)
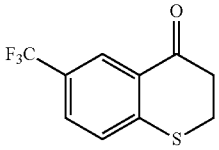
(I-8)
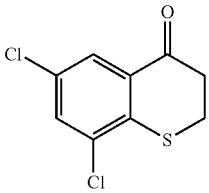
(I-9)
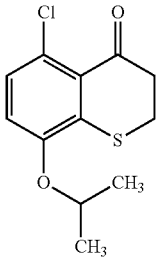
(I-10)
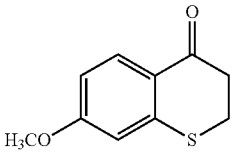
-continued
(I-11)
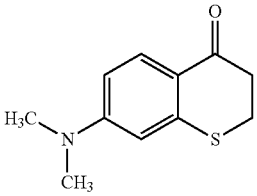
(I-12)
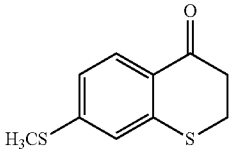
(I-13)
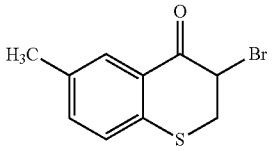
(I-14)
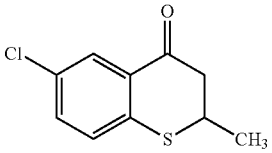
(I-15)
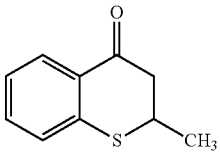
(I-16)
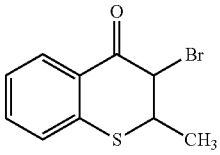
(I-17)
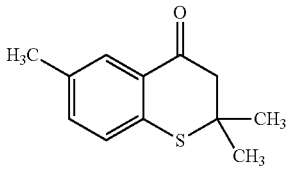
[Chem. 6]
(I-18)
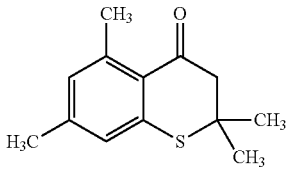
(I-19)
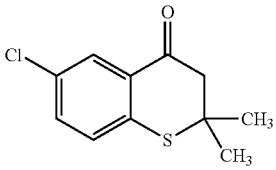

-continued (I-20)

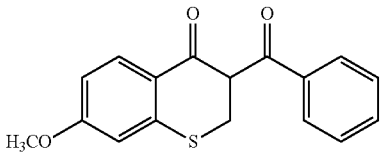

(I-21)

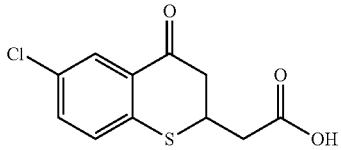

(I-22)

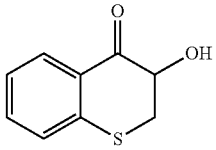

(I-23)

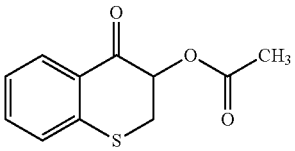

(I-24)

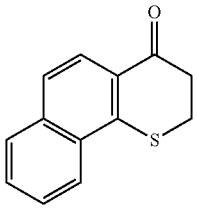

(I-25)

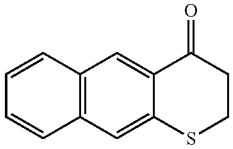

(I-26)

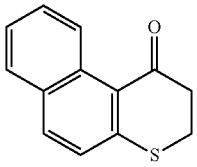

(I-27)

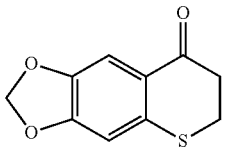

(I-28)

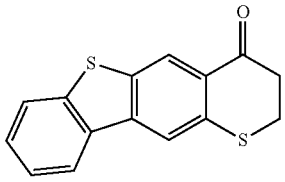

-continued (I-29)

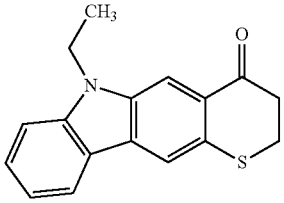

(I-30)

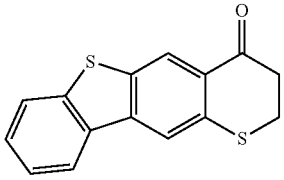

(I-31)

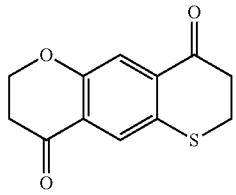

The content of the polymerization initiator in the ink composition of the present invention is preferably 0.1% by mass to 20.0% by mass with respect to the total mass of the ink composition, more preferably 0.5% by mass to 18.0% by mass, and still more preferably 1.0% by mass to 15.0% by mass. When the added amount of the polymerization initiator is in the above-mentioned range, the curability is excellent and furthermore, it is appropriate from the viewpoint of reducing the surface tackiness.

In addition, the content ratio (mass ratio) of the polymerization initiator and the polymerizable compound used in combination therewith is preferably polymerization initiator:polymerizable compound=0.5:100 to 30:100, more preferably 1:100 to 15:100, and still more preferably 2:100 to 10:100.

(Component C) Coloring Agent

The ink used in the present invention preferably contains (Component C) a coloring agent depending on each color.

The coloring agent that can be used in the present invention is not particularly limited and various known pigments and dyes can be appropriately selected to be used according to the purpose. Among them, as a coloring agent, pigments are preferable particularly from the viewpoint of excellent light fastness.

Pigments that are preferably used in the present invention will be described.

The pigments are not particularly limited and any generally commercially available organic pigment and inorganic pigment, resin particles dyed with a dye and the like can be used. Furthermore, a commercial pigment dispersion or a surface-treated pigment such as, for example, a dispersion of a pigment in an insoluble resin and the like, as a dispersion medium or a pigment having a resin grafted on the surface, and the like can be used as long as the effect of the present invention is not impaired.

Examples of these pigments include pigments described in, for example, "Pigment Dictionary", Edited by Seishiro Ito (2000), W. Herbst, K. Hunger, "Industrial Organic Pigments", JP2002-12607A, JP2002-188025A, JP2003-26978A, and JP2003-342503A.

Specific examples of the organic pigment and the inorganic pigment that can be used in the present invention include, as those exhibiting a yellow color, monoazo pigments such as C.I. Pigment Yellow 1 (Fast Yellow G and the like) and C.I. Pigment Yellow 74, disazo pigments such as C.I. Pigment Yellow 12 (Disazo Yellow AAA and the like) and C.I. Pigment Yellow 17, benzidine-free azo pigments such as C.I. Pigment Yellow 180, azo lake pigments such as C.I. Pigment Yellow 100 (Tartrazine Yellow Lake and the like), condensed azo pigments such as C.I. Pigment Yellow 95 (Azo Condensation Yellow GR and the like), acidic dye lake pigments such as C.I. Pigment Yellow 115 (Quinoline Yellow Lake and the like), basic dye lake pigments such as C.I. Pigment Yellow 18 (Thioflavine Lake and the like), anthraquinone pigments such as Flavanthrone Yellow (Y-24), isoindolinone pigments such as Isoindolinone Yellow 3RLT (Y-110), quinophthalone pigments such as Quinophthalone Yellow (Y-138), isoindoline pigments such as Isoindoline Yellow (Y-139), nitroso pigments such as C.I. Pigment Yellow 153 (Nickel Nitroso Yellow and the like), metal complex salt azomethine pigments such as C.I. Pigment Yellow 117 (Copper Azomethine Yellow and the like) and the like.

Examples of pigments exhibiting a red or magenta color include monoazo pigments such as C.I. Pigment Red 3 (Toluidine Red and the like), disazo pigments such as C.I. Pigment Red 38 (Pyrazolone Red B and the like), azo lake pigments such as C.I. Pigment Red 53:1 (Lake Red C and the like) and C.I. Pigment Red 57:1 (Brilliant Carmine 6B), condensed azo pigments such as C.I. Pigment Red 144 (Azo Condensation Red BR and the like), acidic dye lake pigments such as C.I. Pigment Red 174 (Phloxine B Lake and the like), basic dye lake pigments such as C.I. Pigment Red 81 (Rhodamine 6G' Lake and the like), anthraquinone pigments such as C.I. Pigment Red 177 (Dianthraquinonyl Red and the like), thioindigo pigments such as C.I. Pigment Red 88 (Thioindigo Bordeaux and the like), perinone pigments such as C.I. Pigment Red 194 (Perinone Red and the like), perylene pigments such as C.I. Pigment Red 149 (Perylene Scarlet and the like), quinacridone pigments such as C.I. Pigment violet 19 (unsubstituted quinacridone) and C.I. Pigment Red 122 (Quinacridone Magenta and the like), isoindolinone pigments such as C.I. Pigment Red 180 (Isoindolinone Red 2BLT and the like), alizarin lake pigments such as C.I. Pigment Red 83 (Madder Lake and the like) and the like.

Examples of pigments exhibiting a blue or cyan color include disazo pigments such as C.I. Pigment Blue 25 (Dianisidine Blue and the like), phthalocyanine pigments such as C.I. Pigment Blue 15 (Phthalocyanine Blue and the like), acidic dye lake pigments such as C.I. Pigment Blue 24 (Peacock Blue Lake and the like), basic dye lake pigments such as C.I. Pigment Blue 1 (Victoria Pure Blue BO Lake and the like), anthraquinone pigments such as C.I. Pigment Blue 60 (Indanthrone Blue and the like), alkali blue pigments such as C.I. Pigment Blue 18 (Alkali Blue V-5:1) and the like.

Examples of pigments exhibiting a green color include phthalocyanine pigments such as C.I. Pigment Green 7 (Phthalocyanine Green) and C.I. Pigment Green 36 (Phthalocyanine Green), azo metal complex pigments such as C.I. Pigment Green 8 (Nitroso Green) and the like.

Examples of pigments exhibiting an orange color include isoindoline pigments such as C.I. Pigment Orange 66 (Isoindoline Orange) and anthraquinone pigments such as C.I. Pigment Orange 51 (Dichloropyranthrone Orange).

Examples of pigments exhibiting a black color include carbon black, titanium black, aniline black and the like.

Specific examples of white pigments that can be used include basic lead carbonate ($2PbCO_3Pb(OH)_2$, so-called "silver white"), zinc oxide (ZnO, so-called "zinc white"), titanium oxide ($TiO_2$, so-called "titanium white"), and strontium titanate ($SrTiO_3$, so-called "titanium strontium white").

Here, titanium oxide has, compared with other white pigments, a low specific gravity, a high refractive index, and is chemically and physically stable, and therefore has high hiding power and coloring power as a pigment and, furthermore, has excellent durability toward acids, alkalis, and other environments. It is therefore preferable to use titanium oxide as the white pigment. It is of course possible to use another white pigment (which can be any white pigment, in addition to the white pigments mentioned above) as necessary.

For dispersion of the coloring agent, for example, a dispersing machine such as a ball mill, a sand mill, an attritor, a roll mill, a jet mill, a homogenizer, a paint shaker, a kneader, an agitator, a Henschel mixer, a colloidal mill, an ultrasonic homogenizer, a pearl mill, or a wet type jet mill may be used.

During dispersion of the coloring agent, a dispersant such as a surfactant can be added.

Furthermore, when the coloring agent is added, as a dispersion adjuvant, it is also possible to use a synergist as necessary according to the various types of coloring agent. The dispersant adjuvant is preferably added 1 part by mass to 50 parts by mass with respect to 100 parts by mass of the coloring agent.

In the ink composition, a solvent may be added as a dispersion medium for the components such as the coloring agent, or the polymerizable compound, which is solvent-free and has a low molecular weight component, may be used as a dispersion medium, and since the ink composition is preferably an active energy ray curing type liquid and the ink composition is cured after being applied on a recording medium, it is preferable for it to be solvent-free. This is because, when solvent remains in the image formed from the cured ink composition, the solvent resistance is degraded and the volatile organic compound (VOC) problem of residual solvent occurs. From this viewpoint, it is preferable to use the polymerizable compound as a dispersion medium. Among them, it is preferable to select a polymerizable compound having the lowest viscosity from the viewpoint of improvement of dispersion suitability and handling properties of the ink composition.

Since excellent coloration is achieved by finer particles, it is preferable for the average particle size of the coloring agent used here to be 0.01 μm to 0.4 μm, and more preferably 0.02 μm to 0.2 μm. In order to make the maximum particle size be preferably 3 μm or less, and more preferably 1 μm or less, it is preferable for the coloring agent, the dispersant, and the dispersion medium to be selected, and dispersion conditions and filtration conditions to be set. By such control of particle size, clogging of a head nozzle can be suppressed, and the storage stability of the ink composition, and the transparency and curing sensitivity of the ink composition can be maintained. Even when a coloring agent having fine particles is used, an even and stable dispersed material can be obtained by using the coloring agent having excellent dispersion properties and stability in the present invention.

The particle size of the coloring agent may be measured by a known measurement method. Specifically, it may be measured by a centrifugal sedimentation light transmission method, an X-ray transmission method, a laser diffraction and scattering method, or a dynamic light scattering method. In the present invention, a value obtained by measurement using the laser diffraction and scattering method is employed.

When the ink contains the coloring agent, the content of the coloring agent is selected appropriately according to the color and the purpose, but from the viewpoint of image density and storage stability, the content is preferably from 0.01% by mass to 40% by mass with respect to the mass of the entire ink, more preferably 0.1% by mass to 30% by mass, and particularly preferably 0.2% by mass to 20% by mass.

The ink of the present invention can contain a polymerization inhibitor, a dispersant, a co-sensitizer, an ultraviolet absorber, an antioxidant, an antifading agent, conductive salts, a solvent, a polymer compound, a basic compound, a surfactant, a leveling additive, a matting agent and, for adjusting film physical properties, a polyester resin, polyurethane resin, vinyl-based resin, acrylic resin, rubber-based resin, waxes and the like, as necessary, in addition to the above-mentioned each component. These are described in JP2009-185186A and can be used in the present invention as well.

The ink used in the present invention preferably contains a polymerization inhibitor from the viewpoint of improving the storage stability.

When the ink is used in inkjet recording, the ink is preferably heated in the range of 25° C. to 80° C. to thus make it less viscous and then discharged, and in order to prevent clogging of a head due to thermal polymerization it is preferable to add a polymerization inhibitor.

Examples of the polymerization inhibitor include a nitroso-based polymerization inhibitor, a hydroquinone, a methoxyhydroquinone, a benzoquinone, p-methoxyphenol, TEMPO, TEMPOL (HO-TEMPO), A1 cupferron, a hindered amine and the like.

Specific examples of the nitroso-based polymerization inhibitor preferably used in the present invention are shown below, but not limited thereto.

[Chem. 7]

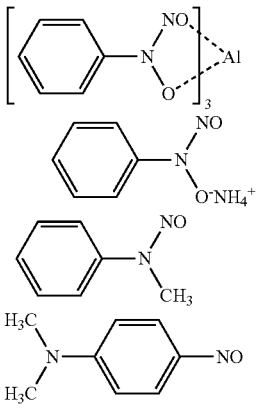

Examples of the nitroso-based polymerization inhibitor include a commercial product such as FIRSTCIJRE ST-1 (manufactured by Chem First) and the like.

Examples of the hindered amine-based polymerization inhibitor include a commercial product such as TINUVIN292, TINUVIN770DF, TINUVIN765, and TINUVIN123

Among them, it is preferable that the polymerization inhibitor be at least one type of a compound selected from the group consisting of cupferron A1 (tris(N-nitroso-N-phenylhydroxylamine) aluminum salt, FIRSTCURE ST-1), methoxyhydroquinone and HO-TEMPO (4-hydroxy-2,2,6,6-tetramethyl piperidinyloxy)

The content of the polymerization inhibitor in the ink used in the present invention is preferably 0.01% by mass to 1.5% by mass, more preferably 0.1% by mass to 1.0% by mass, and still more preferably 0.2% by mass to 0.8% by mass. When the content is in the numerical range above, it is possible to suppress polymerization during storage and preparation of the ink composition and prevent clogging of an inkjet nozzle.

The ink used in the present invention preferably contains a dispersant. Especially, when the pigment is used, the ink composition preferably contains a dispersant in order to stably disperse the pigment in the ink composition. As the dispersant, a polymeric dispersant is preferable. The "polymeric dispersant" referred to in the present invention means a dispersant having a weight average molecular weight of 1,000 or more.

Examples of the polymeric dispersant include DISPERBYK-101, DISPERBYK-102, DISPERBYK-103, DISPERBYK-106, DISPERBYK-111, DISPERBYK-161, DISPERBYK-162, DISPERBYK-163, DISPERBYK-164, DISPERBYK-166, DISPERBYK-167, DISPERBYK-168, DISPERBYK-170, DISPERBYK-171, DISPERBYK-174, and DISPERBYK-182 (manufactured by BYK Chemie); EFKA4010, EFKA4046, EFKA4080, EFKA5010, EFKA5207, EFKA5244, EFKA6745, EFKA6750, EFKA7414, EFKA745, EFKA7462, EFKA7500, EFKA7570, EFKA7575, and EFKA7580 (manufactured by EFKA Additives); Disperse Aid 6, Disperse Aid 8, Disperse Aid 15, and Disperse Aid 9100 (manufactured by San Nopco Limited); various types of SOLSPERSE dispersants such as Solsperse 3000, 5000, 9000, 12000, 13240, 13940, 17000, 22000, 24000, 26000, 28000, 32000, 36000, 39000, 41000, and 71000 (manufactured by Noveon Inc.); Adeka Pluronic L31, F38, L42, L44, L61, L64, F68, L72, P95, F77, P84, F87, P94, L101, P103, F108, L121, and P-123 (manufactured by ADEKA Corporation); Ionet S-20 (manufactured by Sanyo Chemical Industries, Ltd.); and Disparlon KS-860, 873 SN, and 874 (polymeric dispersant), #2150 (aliphatic poly carboxylic acid), and #7004 (polyether ester type) (manufactured by Kusumoto Chemicals, Ltd.).

The content of the dispersant in the ink composition is appropriately selected according to the purpose, but is preferably 0.05% by mass to 15% by mass with respect to the mass of the entire ink composition.

The ink used in the present invention may contain a surfactant for providing stable discharge properties for a long period of time.

The surfactant includes those described in JP1987-173463A (JP-S62-173463A) and JP1987-183457A (JP-S62-183457A). Examples thereof include an anionic surfactant such as dialkylsulfosuccinates, alkylnaphthalenesulfonates and fatty acid salts; a nonionic surfactant such as polyoxyethylene alkyl ethers, polyoxyethylene alkylaryl ethers, acetylene glycols and polyoxyethylene-polyoxypropylene block copolymers; and a cationic surfactant such as alkylamine salts and quaternary ammonium salts. In addition, as the surfactant, a fluorine-based surfactant (for example, organic fluoro compound and the like) and a silicone-based surfactant (for example, polysiloxane compound) may be used. The organic fluoro compound is preferably hydrophobic. Examples of the organic fluoro compound include a fluorine-based surfactant, an oily fluorine-based compound (for example, fluorine oil), a solid fluorine compound resin (for example, tetrafluoroethylene resin), and those described in JP1982-9053B (JP-S57-9053B) (columns 8 to 17) and JP1988-135826A (JP-S62-135826A). As the polysiloxane compound, a modified polysiloxane compound in which an organic group is introduced into some methyl groups of dimethyl polysiloxane is preferable. Modification examples include polyether-modified, methylstyrene-modified, alcohol-modified, alkyl-modified, aralkyl-modified, fatty acid ester-modified, epoxy-modified, amine-modified, amino-modified, mercapto-modified and the like, but are not particularly limited thereto. These methods for modification may be used in combination. Among them, polyether-modified polysiloxane compounds are preferable from the viewpoint of improvement in inkjet discharge stability. Examples of the polyether-modified polysiloxane compounds include SILWET L-7604, SILWET L-7607N, SILWET FZ-2104, and SILWET FZ-2161 (manufactured by Nippon Unicar Co., Ltd.), BYK306, BYK307, BYK331, BYK333, BYK347, and BYK348 (manufactured by BYK Chemie), and KF-351A, KF-352A, KF-353, KF-354L, KF-355A, KF-615A, KF-945, KF-640, KF-642, KF-643, KF-6020, X-22-6191, X-22-4515, KF-6011, KF-6012, KF-6015, and KF-6017 (manufactured by Shin-Etsu Chemical Co., Ltd.).

Among them, a silicone-based surfactant is preferable.

The content of the surfactant, particularly, the total content of the fluorine-based surfactant and the silicone-based surfactant is appropriately selected according to the purpose, but from the viewpoint of suppressing glossiness and streak unevenness, it is preferable that the surfactant be not contained or the total content of the surfactant be more than 0% by mass and 2% by mass or less with respect to the total mass of the ink composition, and it is more preferable that the surfactant be not contained or the total content of the surfactant be more than 0% by mass and 0.4% by mass or less with respect to the total mass of the ink composition.

EXAMPLES

Hereinafter, the present invention will be described in further detail by reference to Examples and Comparative Examples. However, the present invention is not limited to these Examples. "Parts" described below represent "parts by mass" and "%" represents "% by mass" unless otherwise specified.

(Preparation of Yellow Mill Base)

Yellow Pigment: NOVOPERM YELLOW H2G (manufactured by Clariant): 30 parts by mass SR9003 (propoxylated (2) neopentyl glycol diacrylate (compound formed by diacrylating a 2-mol adduct of neopentyl glycol propylene oxide), manufactured by Sartomer Japan Inc.): 30 parts by mass BYK168 (dispersant, manufactured by BYK Chemie): 40 parts by mass The above components were stirred to obtain a yellow mill base. Preparation of a pigment mill base was performed by placing the components in a disperser motor mill M50 (Eiger Machinery, Inc.) and dispersing using zirconia beads having a diameter of 0.65 mm at a peripheral speed of 9 m/s for 8 hours.

(Preparation of Magenta Mill Base)

Magenta Pigment: CINQUASIA MAGENTA RT-355D (manufactured by Ciba Japan KK): 30 parts by mass SR9003: 30 parts by mass BYK168: 40 parts by mass The above components were stirred under the same dispersion conditions as for preparation of the yellow mill base, thus obtaining a magenta mill base.

(Preparation of Cyan Mill Base)

Cyan Pigment: IRGALITE BLUE GLVO (manufactured by Ciba Japan KK): 30 parts by mass SR9003: 30 parts by mass BYK168: 40 parts by mass The above components were stirred under the same dispersion conditions as for preparation of the yellow mill base, thus obtaining a cyan mill base.

(Preparation of Black Mill Base)

Black Pigment: SPECIAL BLACK 250 (manufactured by Ciba Japan KK): 30 parts by mass SR9003: 30 parts by mass BYK168: 40 parts by mass The above components were stirred under the same dispersion conditions as for preparation of the yellow mill base, thus obtaining a black mill base.

<Method for Preparing Ink Composition>

Each of the ink compositions was obtained by mixing and stirring the components described in Tables 1 to 6. The numerical values in the tables represent the amount (parts by mass) of each of the components blended. The stirring was performed using a mixer (L4R, manufactured by Silverson) under the condition of room temperature (25° C.) at a rate of 5,000 rotations/min for 20 minutes. In addition, the viscosity in the table was measured using a VISCOMETER TV-22LT (manufactured by TOKI SANGYO CO., LTD) under the condition of 25° C. In addition, the surface tension was measured using an AUTOMATIC SURFACE TENSIOMETER CBVP-Z (manufactured by Kyowa Interface Science Co., LTD.) under the condition of 25° C.

TABLE 1

| | Y-1 | Y-2 | Y-3 | Y-4 | Y-5 | Y-6 | Y-7 | Y-8 | Y-9 |
|---|---|---|---|---|---|---|---|---|---|
| NVC | — | — | — | — | — | 22.500 | 22.500 | 22.500 | 22.500 |
| EOTMPTA | — | — | — | — | — | 3.500 | 3.500 | 3.500 | 3.500 |
| CTFA | — | — | — | — | — | 54.800 | 52.300 | 50.300 | 48.300 |
| 4-HBA | — | — | — | — | — | — | — | — | — |
| IBOA | 42.700 | 39.700 | 35.700 | 32.700 | 30.700 | — | — | — | — |
| EOEOEA | 20.000 | 20.000 | 20.000 | 20.000 | 20.000 | — | — | — | — |
| 2-MTA | 20.600 | 20.600 | 20.600 | 20.600 | 20.600 | — | — | — | — |
| IRGACURE 819 | 3.000 | 3.000 | 3.000 | 3.000 | 3.000 | 3.000 | 3.000 | 3.000 | 3.000 |
| DAROCUR TPO | 2.800 | 2.800 | 2.800 | 2.800 | 2.800 | 2.800 | 2.800 | 2.800 | 2.800 |
| ITX | 3.000 | 3.000 | 3.000 | 3.000 | 3.000 | 3.000 | 3.000 | 3.000 | 3.000 |
| ST-1 | 1.000 | 1.000 | 1.000 | 1.000 | 1.000 | 1.000 | 1.000 | 1.000 | 1.000 |

TABLE 1-continued

| | | | | | | | | | |
|---|---|---|---|---|---|---|---|---|---|
| MEHQ | 0.500 | 0.500 | 0.500 | 0.500 | 0.500 | 0.500 | 0.500 | 0.500 | 0.500 |
| Yellow Mill Base | 6.400 | 6.400 | 6.400 | 6.400 | 6.400 | 6.400 | 6.400 | 6.400 | 6.400 |
| CN964A85 | — | 3.000 | 7.000 | 10.000 | 12.000 | 2.500 | 5.000 | 7.000 | 9.000 |
| F-552 | — | — | — | — | — | — | — | — | — |
| Total (Parts by mass) | 100.000 | 100.000 | 100.000 | 100.000 | 100.000 | 100.000 | 100.000 | 100.000 | 100.000 |
| Viscosity (mPa · s) | 8 | 10 | 15 | 20 | 22 | 22 | 25 | 27 | 30 |
| Surface Tension (mN/m) | 38 | 38 | 38 | 38 | 38 | 38 | 38 | 38 | 38 |

| | Y-10 | Y-11 | Y-12 | Y-13 | Y-14 | Y-15 | Y-16 | Y-17 | Y-18 |
|---|---|---|---|---|---|---|---|---|---|
| NVC | 22.500 | 22.500 | 22.500 | 22.500 | 22.500 | 22.500 | 22.500 | 22.500 | 22.500 |
| EOTMPTA | 3.500 | 3.500 | 3.500 | 3.500 | 3.500 | 3.500 | 3.500 | 3.500 | 3.500 |
| CTFA | 47.300 | 53.300 | 53.800 | 54.300 | 54.500 | 54.700 | — | — | — |
| 4-HBA | — | — | — | — | — | — | 49.700 | 49.750 | 49.800 |
| IBOA | — | — | — | — | — | — | — | — | — |
| EOEOEA | — | — | — | — | — | — | — | — | — |
| 2-MTA | — | — | — | — | — | — | — | — | — |
| IRGACURE 819 | 3.000 | 3.000 | 3.000 | 3.000 | 3.000 | 3.000 | 3.000 | 3.000 | 3.000 |
| DAROCUR TPO | 2.800 | 2.800 | 2.800 | 2.800 | 2.800 | 2.800 | 2.800 | 2.800 | 2.800 |
| ITX | 3.000 | 3.000 | 3.000 | 3.000 | 3.000 | 3.000 | 3.000 | 3.000 | 3.000 |
| ST-1 | 1.000 | 1.000 | 1.000 | 1.000 | 1.000 | 1.000 | 1.000 | 1.000 | 1.000 |
| MEHQ | 0.500 | 0.500 | 0.500 | 0.500 | 0.500 | 0.500 | 0.500 | 0.500 | 0.500 |
| Yellow Mill Base | 6.400 | 6.400 | 6.400 | 6.400 | 6.400 | 6.400 | 6.400 | 6.400 | 6.400 |
| CN964A85 | 10.000 | 2.500 | 2.500 | 2.500 | 2.500 | 2.500 | 7.500 | 7.500 | 7.500 |
| F-552 | — | 1.500 | 1.000 | 0.500 | 0.300 | 0.100 | 0.100 | 0.050 | — |
| Total (Parts by mass) | 100.000 | 100.000 | 100.000 | 100.000 | 100.000 | 100.000 | 100.000 | 100.000 | 100.000 |
| Viscosity (mPa · s) | 32 | 22 | 22 | 22 | 22 | 22 | 22 | 22 | 22 |
| Surface Tension (mN/m) | 38 | 22 | 23 | 25 | 30 | 35 | 38 | 39 | 40 |

TABLE 2

| | M-1 | M-2 | M-3 | M-4 | M-5 | M-6 | M-7 | M-8 | M-9 |
|---|---|---|---|---|---|---|---|---|---|
| NVC | — | — | — | — | — | 24.000 | 24.000 | 24.000 | 24.000 |
| CTFA | — | — | — | — | — | 50.500 | 48.000 | 46.000 | 44.000 |
| 4-HBA | — | — | — | — | — | — | — | — | — |
| IBOA | 25.900 | 22.900 | 18.900 | 15.900 | 13.900 | — | — | — | — |
| EOEOEA | 24.000 | 24.000 | 24.000 | 24.000 | 24.000 | — | — | — | — |
| 2-MTA | 24.600 | 24.600 | 24.600 | 24.600 | 24.600 | — | — | — | — |
| IRGACURE 819 | 2.800 | 2.800 | 2.800 | 2.800 | 2.800 | 2.800 | 2.800 | 2.800 | 2.800 |
| DAROCUR TPO | 2.800 | 2.800 | 2.800 | 2.800 | 2.800 | 2.800 | 2.800 | 2.800 | 2.800 |
| ITX | 2.000 | 2.000 | 2.000 | 2.000 | 2.000 | 2.000 | 2.000 | 2.000 | 2.000 |
| ST-1 | 1.000 | 1.000 | 1.000 | 1.000 | 1.000 | 1.000 | 1.000 | 1.000 | 1.000 |
| MEHQ | 0.500 | 0.500 | 0.500 | 0.500 | 0.500 | 0.500 | 0.500 | 0.500 | 0.500 |
| Magenta Mill Base | 16.400 | 16.400 | 16.400 | 16.400 | 16.400 | 16.400 | 16.400 | 16.400 | 16.400 |
| CN964A85 | — | 3.000 | 7.000 | 10.000 | 12.000 | — | 2.500 | 4.500 | 6.500 |
| F-522 | — | — | — | — | — | — | — | — | — |
| Total (Parts by mass) | 100.000 | 100.000 | 100.000 | 100.000 | 100.000 | 100.000 | 100.000 | 100.000 | 100.000 |
| Viscosity (mPa · s) | 8 | 10 | 15 | 20 | 22 | 22 | 25 | 27 | 30 |
| Surface Tension (mN/m) | 38 | 38 | 38 | 38 | 38 | 38 | 38 | 38 | 38 |

| | M-10 | M-11 | M-12 | M-13 | M-14 | M-15 | M-16 | M-17 | M-18 |
|---|---|---|---|---|---|---|---|---|---|
| NVC | 24.000 | 24.000 | 24.000 | 24.000 | 24.000 | 24.000 | 24.000 | 24.000 | 24.000 |
| CTFA | 43.000 | 49.000 | 49.500 | 50.000 | 50.200 | 50.400 | — | — | — |

TABLE 2-continued

| | | | | | | | | | |
|---|---|---|---|---|---|---|---|---|---|
| 4-HBA | — | — | — | — | — | — | 45.400 | 45.450 | 45.500 |
| IBOA | — | — | — | — | — | — | — | — | — |
| EOEOEA | — | — | — | — | — | — | — | — | — |
| 2-MTA | — | — | — | — | — | — | — | — | — |
| IRGACURE 819 | 2.800 | 2.800 | 2.800 | 2.800 | 2.800 | 2.800 | 2.800 | 2.800 | 2.800 |
| DAROCUR TPO | 2.800 | 2.800 | 2.800 | 2.800 | 2.800 | 2.800 | 2.800 | 2.800 | 2.800 |
| ITX | 2.000 | 2.000 | 2.000 | 2.000 | 2.000 | 2.000 | 2.000 | 2.000 | 2.000 |
| ST-1 | 1.000 | 1.000 | 1.000 | 1.000 | 1.000 | 1.000 | 1.000 | 1.000 | 1.000 |
| MEHQ | 0.500 | 0.500 | 0.500 | 0.500 | 0.500 | 0.500 | 0.500 | 0.500 | 0.500 |
| Magenta Mill Base | 16.400 | 16.400 | 16.400 | 16.400 | 16.400 | 16.400 | 16.400 | 16.400 | 16.400 |
| CN964A85 | 7.500 | — | — | — | — | — | 5.000 | 5.000 | 5.000 |
| F-522 | — | 1.500 | 1.000 | 0.500 | 0.300 | 0.100 | 0.100 | 0.050 | — |
| Total (Parts by mass) | 100.000 | 100.000 | 100.000 | 100.000 | 100.000 | 100.000 | 100.000 | 100.000 | 100.000 |
| Viscosity (mPa · s) | 32 | 22 | 22 | 22 | 22 | 22 | 22 | 22 | 22 |
| Surface Tension (mN/m) | 38 | 22 | 23 | 25 | 30 | 35 | 38 | 39 | 40 |

TABLE 3

| | C-1 | C-2 | C-3 | C-4 | C-5 | C-6 | C-7 | C-8 | C-9 |
|---|---|---|---|---|---|---|---|---|---|
| NVC | — | — | — | — | — | 24.000 | 24.000 | 24.000 | 24.000 |
| EOTMPTA | — | — | — | — | — | 2.900 | 2.900 | 2.900 | 2.900 |
| CTFA | — | — | — | — | — | 52.550 | 50.050 | 48.050 | 46.050 |
| 4-HBA | — | — | — | — | — | — | — | — | — |
| IBOA | 42.850 | 39.850 | 35.850 | 32.850 | 30.850 | — | — | — | — |
| EOEOEA | 20.000 | 20.000 | 20.000 | 20.000 | 20.000 | — | — | — | — |
| 2-MTA | 20.600 | 20.600 | 20.600 | 20.600 | 20.600 | — | — | — | — |
| DAROCUR TPO | 5.600 | 5.600 | 5.600 | 5.600 | 5.600 | 5.600 | 5.600 | 5.600 | 5.600 |
| ITX | 2.000 | 2.000 | 2.000 | 2.000 | 2.000 | 2.000 | 2.000 | 2.000 | 2.000 |
| HO-TEMPO | 0.300 | 0.300 | 0.300 | 0.300 | 0.300 | 0.300 | 0.300 | 0.300 | 0.300 |
| Cyan Mill Base | 8.650 | 8.650 | 8.650 | 8.650 | 8.650 | 8.650 | 8.650 | 8.650 | 8.650 |
| CN964A85 | — | 3.000 | 7.000 | 10.000 | 12.000 | 4.000 | 6.500 | 8.500 | 10.500 |
| F-552 | — | — | — | — | — | — | — | — | — |
| Total (Parts by mass) | 100.000 | 100.000 | 100.000 | 100.000 | 100.000 | 100.000 | 100.000 | 100.000 | 100.000 |
| Viscosity (mPa · s) | 8 | 10 | 15 | 20 | 22 | 22 | 25 | 27 | 30 |
| Surface Tension (mN/m) | 38 | 38 | 38 | 38 | 38 | 38 | 38 | 38 | 38 |

| | C-10 | C-11 | C-12 | C-13 | C-14 | C-15 | C-16 | C-17 | C-18 |
|---|---|---|---|---|---|---|---|---|---|
| NVC | 24.000 | 24.000 | 24.000 | 24.000 | 24.000 | 24.000 | 24.000 | 24.000 | 24.000 |
| EOTMPTA | 2.900 | 2.900 | 2.900 | 2.900 | 2.900 | 2.900 | 2.900 | 2.900 | 2.900 |
| CTFA | 45.050 | 51.050 | 51.550 | 52.050 | 52.250 | 52.450 | — | — | — |
| 4-HBA | — | — | — | — | — | — | 47.450 | 47.500 | 47.550 |
| IBOA | — | — | — | — | — | — | — | — | — |
| EOEOEA | — | — | — | — | — | — | — | — | — |
| 2-MTA | — | — | — | — | — | — | — | — | — |
| DAROCUR TPO | 5.600 | 5.600 | 5.600 | 5.600 | 5.600 | 5.600 | 5.600 | 5.600 | 5.600 |
| ITX | 2.000 | 2.000 | 2.000 | 2.000 | 2.000 | 2.000 | 2.000 | 2.000 | 2.000 |
| HO-TEMPO | 0.300 | 0.300 | 0.300 | 0.300 | 0.300 | 0.300 | 0.300 | 0.300 | 0.300 |
| Cyan Mill Base | 8.650 | 8.650 | 8.650 | 8.650 | 8.650 | 8.650 | 8.650 | 8.650 | 8.650 |
| CN964A85 | 11.500 | 4.000 | 4.000 | 4.000 | 4.000 | 4.000 | 9.000 | 9.000 | 9.000 |
| F-552 | — | 1.500 | 1.000 | 0.500 | 0.300 | 0.100 | 0.100 | 0.050 | — |
| Total (Parts by mass) | 100.000 | 100.000 | 100.000 | 100.000 | 100.000 | 100.000 | 100.000 | 100.000 | 100.000 |
| Viscosity (mPa · s) | 32 | 22 | 22 | 22 | 22 | 22 | 22 | 22 | 22 |

TABLE 3-continued

| | | | | | | | | | |
|---|---|---|---|---|---|---|---|---|---|
| Surface Tension (mN/m) | 38 | 22 | 23 | 25 | 30 | 35 | 38 | 39 | 40 |

TABLE 4

| | K-1 | K-2 | K-3 | K-4 | K-5 | K-6 | K-7 | K-8 | K-9 |
|---|---|---|---|---|---|---|---|---|---|
| NVC | — | — | — | — | — | 23.000 | 23.000 | 23.000 | 23.000 |
| EOTMPTA | — | — | — | — | — | 2.800 | 2.800 | 2.800 | 2.800 |
| CTFA | — | — | — | — | — | 50.600 | 48.100 | 46.100 | 44.100 |
| 4-HBA | — | — | — | — | — | — | — | — | — |
| IBOA | 39.550 | 36.550 | 32.550 | 29.550 | 27.550 | — | — | — | — |
| EOEOEA | 20.000 | 20.000 | 20.000 | 20.000 | 20.000 | — | — | — | — |
| 2-MTA | 20.600 | 20.600 | 20.600 | 20.600 | 20.600 | — | — | — | — |
| IRGACURE 819 | 5.000 | 5.000 | 5.000 | 5.000 | 5.000 | 5.000 | 5.000 | 5.000 | 5.000 |
| DAROCUR TPO | 2.800 | 2.800 | 2.800 | 2.800 | 2.800 | 2.800 | 2.800 | 2.800 | 2.800 |
| ITX | 3.000 | 3.000 | 3.000 | 3.000 | 3.000 | 3.000 | 3.000 | 3.000 | 3.000 |
| ST-1 | 1.000 | 1.000 | 1.000 | 1.000 | 1.000 | 1.000 | 1.000 | 1.000 | 1.000 |
| Black Mill Base | 8.050 | 8.050 | 8.050 | 8.050 | 8.050 | 8.050 | 8.050 | 8.050 | 8.050 |
| CN964A85 | — | 3.000 | 7.000 | 10.000 | 12.000 | 3.750 | 6.250 | 8.250 | 10.250 |
| F-552 | — | — | — | — | — | — | — | — | — |
| Total (Parts by mass) | 100.000 | 100.000 | 100.000 | 100.000 | 100.000 | 100.000 | 100.000 | 100.000 | 100.000 |
| Viscosity (mPa · s) | 8 | 10 | 15 | 20 | 22 | 22 | 25 | 27 | 30 |
| Surface Tension (mN/m) | 38 | 38 | 38 | 38 | 38 | 38 | 38 | 38 | 38 |

| | K-10 | K-11 | K-12 | K-13 | K-14 | K-15 | K-16 | K-17 | K-18 |
|---|---|---|---|---|---|---|---|---|---|
| NVC | 23.000 | 23.000 | 23.000 | 23.000 | 23.000 | 23.000 | 23.000 | 23.000 | 23.000 |
| EOTMPTA | 2.800 | 2.800 | 2.800 | 2.800 | 2.800 | 2.800 | 2.800 | 2.800 | 2.800 |
| CTFA | 43.100 | 49.100 | 49.600 | 50.100 | 50.300 | 50.500 | — | — | — |
| 4-HBA | — | — | — | — | — | — | 45.500 | 45.550 | 45.600 |
| IBOA | — | — | — | — | — | — | — | — | — |
| EOEOEA | — | — | — | — | — | — | — | — | — |
| 2-MTA | — | — | — | — | — | — | — | — | — |
| IRGACURE 819 | 5.000 | 5.000 | 5.000 | 5.000 | 5.000 | 5.000 | 5.000 | 5.000 | 5.000 |
| DAROCUR TPO | 2.800 | 2.800 | 2.800 | 2.800 | 2.800 | 2.800 | 2.800 | 2.800 | 2.800 |
| ITX | 3.000 | 3.000 | 3.000 | 3.000 | 3.000 | 3.000 | 3.000 | 3.000 | 3.000 |
| ST-1 | 1.000 | 1.000 | 1.000 | 1.000 | 1.000 | 1.000 | 1.000 | 1.000 | 1.000 |
| Black Mill Base | 8.050 | 8.050 | 8.050 | 8.050 | 8.050 | 8.050 | 8.050 | 8.050 | 8.050 |
| CN964A85 | 11.250 | 3.750 | 3.750 | 3.750 | 3.750 | 3.750 | 8.750 | 8.750 | 8.750 |
| F-552 | — | 1.500 | 1.000 | 0.500 | 0.300 | 0.100 | 0.100 | 0.050 | — |
| Total (Parts by mass) | 100.000 | 100.000 | 100.000 | 100.000 | 100.000 | 100.000 | 100.000 | 100.000 | 100.000 |
| Viscosity (mPa · s) | 32 | 22 | 22 | 22 | 22 | 22 | 22 | 22 | 22 |
| Surface Tension (mN/m) | 38 | 22 | 23 | 25 | 30 | 35 | 38 | 39 | 40 |

TABLE 5

| | Lm-1 | Lm-2 | Lm-3 | Lm-4 | Lm-5 | Lm-6 | Lm-7 | Lm-8 | Lm-9 |
|---|---|---|---|---|---|---|---|---|---|
| NVC | — | — | — | — | — | 24.000 | 24.000 | 24.000 | 24.000 |
| EOTMPTA | — | — | — | — | — | 4.050 | 4.050 | 4.050 | 4.050 |
| CTFA | — | — | — | — | — | 54.500 | 52.000 | 50.000 | 48.000 |
| 4-HBA | — | — | — | — | — | — | — | — | — |
| IBOA | 38.950 | 35.950 | 31.950 | 28.950 | 26.950 | — | — | — | — |
| EOEOEA | 24.000 | 24.000 | 24.000 | 24.000 | 24.000 | — | — | — | — |
| 2-MTA | 24.600 | 24.600 | 24.600 | 24.600 | 24.600 | — | — | — | — |
| IRGACURE 819 | 2.800 | 2.800 | 2.800 | 2.800 | 2.800 | 2.800 | 2.800 | 2.800 | 2.800 |

TABLE 5-continued

| | | | | | | | | | |
|---|---|---|---|---|---|---|---|---|---|
| DAROCUR TPO | 2.900 | 2.900 | 2.900 | 2.900 | 2.900 | 2.900 | 2.900 | 2.900 | 2.900 |
| ITX | 0.400 | 0.400 | 0.400 | 0.400 | 0.400 | 0.400 | 0.400 | 0.400 | 0.400 |
| IRGACURE 184 | 1.600 | 1.600 | 1.600 | 1.600 | 1.600 | 1.600 | 1.600 | 1.600 | 1.600 |
| ST-1 | 1.000 | 1.000 | 1.000 | 1.000 | 1.000 | 1.000 | 1.000 | 1.000 | 1.000 |
| MEHQ | 0.500 | 0.500 | 0.500 | 0.500 | 0.500 | 0.500 | 0.500 | 0.500 | 0.500 |
| MAGENTA MILL BASE | 3.250 | 3.250 | 3.250 | 3.250 | 3.250 | 3.250 | 3.250 | 3.250 | 3.250 |
| CN964A85 | — | 3.000 | 7.000 | 10.000 | 12.000 | 5.000 | 7.500 | 9.500 | 11.500 |
| F-552 | — | — | — | — | — | — | — | — | — |
| Total (Parts by mass) | 100.000 | 100.000 | 100.000 | 100.000 | 100.000 | 100.000 | 100.000 | 100.000 | 100.000 |
| Viscosity (mPa · s) | 8 | 10 | 15 | 20 | 22 | 22 | 25 | 27 | 30 |
| Surface Tension (mN/m) | 38 | 38 | 38 | 38 | 38 | 38 | 38 | 38 | 38 |

| | Lm-10 | Lm-11 | Lm-12 | Lm-13 | Lm-14 | Lm-15 | Lm-16 | Lm-17 | Lm-18 |
|---|---|---|---|---|---|---|---|---|---|
| NVC | 24.000 | 24.000 | 24.000 | 24.000 | 24.000 | 24.000 | 24.000 | 24.000 | 24.000 |
| EOTMPTA | 4.050 | 4.050 | 4.050 | 4.050 | 4.050 | 4.050 | 4.050 | 4.050 | 4.050 |
| CTFA | 47.000 | 53.000 | 53.500 | 54.000 | 54.200 | 54.400 | — | — | — |
| 4-HBA | — | — | — | — | — | — | 49.400 | 49.450 | 49.500 |
| IBOA | — | — | — | — | — | — | — | — | — |
| EOEOEA | — | — | — | — | — | — | — | — | — |
| 2-MTA | — | — | — | — | — | — | — | — | — |
| IRGACURE 819 | 2.800 | 2.800 | 2.800 | 2.800 | 2.800 | 2.800 | 2.800 | 2.800 | 2.800 |
| DAROCUR TPO | 2.900 | 2.900 | 2.900 | 2.900 | 2.900 | 2.900 | 2.900 | 2.900 | 2.900 |
| ITX | 0.400 | 0.400 | 0.400 | 0.400 | 0.400 | 0.400 | 0.400 | 0.400 | 0.400 |
| IRGACURE 184 | 1.600 | 1.600 | 1.600 | 1.600 | 1.600 | 1.600 | 1.600 | 1.600 | 1.600 |
| ST-1 | 1.000 | 1.000 | 1.000 | 1.000 | 1.000 | 1.000 | 1.000 | 1.000 | 1.000 |
| MEHQ | 0.500 | 0.500 | 0.500 | 0.500 | 0.500 | 0.500 | 0.500 | 0.500 | 0.500 |
| MAGENTA MILL BASE | 3.250 | 3.250 | 3.250 | 3.250 | 3.250 | 3.250 | 3.250 | 3.250 | 3.250 |
| CN964A85 | 12.500 | 5.000 | 5.000 | 5.000 | 5.000 | 5.000 | 10.000 | 10.000 | 10.000 |
| F-552 | — | 1.500 | 1.000 | 0.500 | 0.300 | 0.100 | 0.100 | 0.050 | — |
| Total (Parts by mass) | 100.000 | 100.000 | 100.000 | 100.000 | 100.000 | 100.000 | 100.000 | 100.000 | 100.000 |
| Viscosity (mPa · s) | 32 | 22 | 22 | 22 | 22 | 22 | 22 | 22 | 22 |
| Surface Tension (mN/m) | 38 | 22 | 23 | 25 | 30 | 35 | 38 | 39 | 40 |

TABLE 6

| | Lc-1 | Lc-2 | Lc-3 | Lc-4 | Lc-5 | Lc-6 | Lc-7 | Lc-8 | Lc-9 |
|---|---|---|---|---|---|---|---|---|---|
| NVC | — | — | — | — | — | 24.000 | 24.000 | 24.000 | 24.000 |
| EOTMPTA | — | — | — | — | — | 6.370 | 6.370 | 6.370 | 6.370 |
| CTFA | — | — | — | — | — | 54.500 | 52.000 | 50.000 | 48.000 |
| 4-HBA | — | — | — | — | — | — | — | — | — |
| IBOA | 53.070 | 50.070 | 46.070 | 43.070 | 41.070 | — | — | — | — |
| EOEOEA | 20.000 | 20.000 | 20.000 | 20.000 | 20.000 | — | — | — | — |
| 2-MTA | 20.600 | 20.600 | 20.600 | 20.600 | 20.600 | — | — | — | — |
| DAROCUR TPO | 2.900 | 2.900 | 2.900 | 2.900 | 2.900 | 6.700 | 6.700 | 6.700 | 6.700 |
| ITX | 0.400 | 0.400 | 0.400 | 0.400 | 0.400 | 0.400 | 0.400 | 0.400 | 0.400 |
| IRGACURE 184 | 1.600 | 1.600 | 1.600 | 1.600 | 1.600 | 1.600 | 1.600 | 1.600 | 1.600 |
| HO-TEMPO | 0.300 | 0.300 | 0.300 | 0.300 | 0.300 | 0.300 | 0.300 | 0.300 | 0.300 |
| CYAN MILL BASE | 1.130 | 1.130 | 1.130 | 1.130 | 1.130 | 1.130 | 1.130 | 1.130 | 1.130 |
| CN964A85 | — | 3.000 | 7.000 | 10.000 | 12.000 | 5.000 | 7.500 | 9.500 | 11.500 |
| F-552 | — | — | — | — | — | — | — | — | — |
| Total (Parts by mass) | 100.000 | 100.000 | 100.000 | 100.000 | 100.000 | 100.000 | 100.000 | 100.000 | 100.000 |

TABLE 6-continued

| | | | | | | | | | |
|---|---|---|---|---|---|---|---|---|---|
| Viscosity (mPa · s) | 8 | 10 | 15 | 20 | 22 | 22 | 25 | 27 | 30 |
| Surface Tension (mN/m) | 38 | 38 | 38 | 38 | 38 | 38 | 38 | 38 | 38 |
| | Lc-10 | Lc-11 | Lc-12 | Lc-13 | Lc-14 | Lc-15 | Lc-16 | Lc-17 | Lc-18 |
| NVC | 24.000 | 24.000 | 24.000 | 24.000 | 24.000 | 24.000 | 24.000 | 24.000 | 24.000 |
| EOTMPTA | 6.370 | 6.370 | 6.370 | 6.370 | 6.370 | 6.370 | 6.370 | 6.370 | 6.370 |
| CTFA | 47.000 | 53.000 | 53.500 | 54.000 | 54.200 | 54.400 | — | — | — |
| 4-HBA | — | — | — | — | — | — | 49.400 | 49.450 | 49.500 |
| IBOA | — | — | — | — | — | — | — | — | — |
| EOEOEA | — | — | — | — | — | — | — | — | — |
| 2-MTA | — | — | — | — | — | — | — | — | — |
| DAROCUR TPO | 6.700 | 6.700 | 6.700 | 6.700 | 6.700 | 6.700 | 6.700 | 6.700 | 6.700 |
| ITX | 0.400 | 0.400 | 0.400 | 0.400 | 0.400 | 0.400 | 0.400 | 0.400 | 0.400 |
| IRGACURE 184 | 1.600 | 1.600 | 1.600 | 1.600 | 1.600 | 1.600 | 1.600 | 1.600 | 1.600 |
| HO-TEMPO | 0.300 | 0.300 | 0.300 | 0.300 | 0.300 | 0.300 | 0.300 | 0.300 | 0.300 |
| CYAN MILL BASE | 1.130 | 1.130 | 1.130 | 1.130 | 1.130 | 1.130 | 1.130 | 1.130 | 1.130 |
| CN964A85 | 12.500 | 5.000 | 5.000 | 5.000 | 5.000 | 5.000 | 10.000 | 10.000 | 10.000 |
| F-552 | — | 1.500 | 1.000 | 0.500 | 0.300 | 0.100 | 0.100 | 0.050 | — |
| Total (Parts by mass) | 100.000 | 100.000 | 100.000 | 100.000 | 100.000 | 100.000 | 100.000 | 100.000 | 100.000 |
| Viscosity (mPa · s) | 32 | 22 | 22 | 22 | 22 | 22 | 22 | 22 | 22 |
| Surface Tension (mN/m) | 38 | 22 | 23 | 25 | 30 | 35 | 38 | 39 | 40 |

Each component described in Tables 1 to 6 above was as follows.

NVC: N-vinylcaprolactam (V-CAP, manufactured by ISP Japan Ltd.)

CTFA: cyclic trimethylolpropane formal acrylate (SR531, manufactured by Sartomer Japan Inc.)

EOTMPTA: ethoxylated (3) trimethylolpropane triacrylate (compound formed by triacrylating a 3-mol adduct of trimethylolpropane ethylene oxide) (SR454D NS, manufactured by Sartomer Japan Inc.)

IBOA: isobornyl acrylate (IBXA, manufactured by OSAKA ORGANIC CHEMICAL INDUSTRY LTD.)

4-HBA: 4-hydroxybutyl acrylate (manufactured by OSAKA ORGANIC CHEMICAL INDUSTRY LTD.)

EOEOEA: ethoxyethoxy ethyl acrylate (SR256, manufactured by Sartomer Japan Inc.)

2-MTA: 2-methoxyethyl acrylate (manufactured by OSAKA ORGANIC CHEMICAL INDUSTRY LTD.)

CN964A85 (urethane acrylate oligomer, average number of functional groups: 2, manufactured by Sartomer Japan Inc.)

Irg819: bis(2,4,6-trimethylbenzoyl)phenylphosphine oxide (IRGACURE 819, manufactured by Ciba Japan KK)

TPO: 2,4,6-trimethylbenzoyldiphenylphosphine oxide (Darocur TPO, manufactured by Ciba Japan KK)

Irg184: 1-hydroxy cyclohexyl phenyl ketone (manufactured by Ciba Japan KK)

ITX: isopropylthioxanthone (manufactured by Lambson Ltd.)

ST-1: FIRSTCURE ST-1 (polymerization inhibitor, manufactured by Chem First)

MEHQ: methoxyhydroquinone (manufactured by Wako Pure Chemical Industries, Ltd.)

HO-TEMPO: 4-hydroxy-2,2,6,6,-tetramethyl piperidinyloxy (manufactured by ADEKA Corporation)

F-552: fluorine-based oligomer-type surfactant (manufactured by DIC Corporation)

<Inkjet Recording Method>

—Apparatus Configuration—

An apparatus in which inkjet heads of each color are arranged as shown in FIG. 9 was used. A relative relationship among the positions of each color head will be described later. In addition, details of each unit are as follows.

With regard to the heads of each color of yellow, magenta, cyan, black, light cyan and light magenta, a Q-class Sapphire QS-256/10 piezo type inkjet head (manufactured by FUJIFILM DIMATIX, number of nozzles: 256 (100 npi (nozzle per inch)), minimum droplet amount: 10 pL, 30 kHz) was used respectively.

With regard to the light sources, as the temporary curing light source, two light sources, in which light emitting diodes (UV-LED, NC4U134, manufactured by Nichia Corporation, wavelength: 385 nm) are arranged as shown in FIG. 9, with an illumination intensity of 780 mW/cm$^2$, were used, and as the main curing light source, two light sources, in which ten light emitting diodes (UV-LED, NC4U134, manufactured by Nichia Corporation, wavelength: 385 nm) are arranged, with an illumination intensity of 1,500 mW/cm$^2$, were used.

The ink supply system includes an ink pack, a supply pipe, a SEPAREL EF-G2 degassing filter (manufactured by DIC Corporation), an ink supply tank immediately before an ink jet head, a degassing filter, and a piezo type ink jet head, and the pressure was decreased to 0.5 atm in the degassing filter sections.

—Image Formation—

An image was formed using the apparatus having the above-mentioned configuration.

An image was formed under the following conditions.

Scanning Speed: 1 m/s

Substrate: UV gloss coat 157 (157 g/cm$^2$, UVGC760, gloss paper, manufactured by manufactured by Sakurai Co., Ltd., thickness of 150 μm)

Image formation Mode: 1,200 dpi×1,200 dpi, 12 passes

Image A: 4 color gray (yellow, magenta, cyan, black) of a dot percent of 300%

Image B: 4 color gray of a dot percent of 270%

Temporary curing illumination intensity condition A: 780 mW/cm$^2$

Temporary curing illumination intensity condition B: 390 mW/cm$^2$

Relative relationship A among positions of each color head: array in which nozzles of each color head are aligned on the same scanning line Relative relationship B among positions of each color head: nozzle arrangement of each color head shown in FIG. 5

<Evaluation Method>

≤Evaluation of Gloss Banding (Gloss Unevenness)—

The condition of the image A was output and a printed material was observed from a distance of 50 cm to evaluate the presence or absence of gloss banding. The number of evaluators was 10 and an evaluation score was an average value of 10 evaluators. The gloss banding means the presence of streaky gloss unevenness in an image.

5: No gloss banding was observed.

4: Slight gloss banding was observed but not conspicuous.

3: Gloss banding was observed but acceptable.

2: Gloss banding was conspicuous.

1: Gloss banding was very conspicuous.

A score of 3 or more is the acceptable range.

—Evaluation of Graininess—

The condition of the image B was output and a printed material was observed from a distance of 50 cm to evaluate graininess of the image, that is, a degree of roughness of the image. The number of evaluators was 10 and an evaluation score was an average value of 10 evaluators.

5: No roughness was observed.

4: Slight roughness was observed but not conspicuous.

3: Roughness was observed but acceptable.

2: Roughness was conspicuous.

1: Roughness was very conspicuous.

A score of 3 or more is the acceptable range.

Examples 1 to 16, and Comparative Examples 1 to 20

According to the conditions of the image A and image B, and the temporary curing illumination intensity condition B above, the results are shown in Table 7 which are obtained by forming images under the condition of the relative relationship A among the positions of each color head (Comparative Examples 1 to 18).

With regard to ink discharge, the discharge temperature was adjusted to optimize the viscosity during the discharge. In addition, the discharge waveform was also optimized. As a result, it was confirmed that any of the inks can be discharged favorably.

In the same manner, according to the conditions of the image A and image B, and the temporary curing illumination intensity condition B above, the results are shown in Table 8 which are obtained by forming images under the condition of the relative relationship B among the positions of each color head (Examples 1 to 16 and Comparative Examples 19 and 20).

Further, according to the conditions of the image A and image B, and the temporary curing illumination intensity condition A, images were formed under the condition of the relative relationship B among the positions of each color head. In this case, good quality in gloss unevenness and graininess was exhibited even when the same inks as in Examples 1 to 16 were used.

TABLE 7

| | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 |
|---|---|---|---|---|---|---|---|---|---|
| Yellow Ink | Y-1 | Y-2 | Y-3 | Y-4 | Y-5 | Y-6 | Y-7 | Y-8 | Y-9 |
| Magenta Ink | M-1 | M-2 | M-3 | M-4 | M-5 | M-6 | M-7 | M-8 | M-9 |
| Cyan Ink | C-1 | C-2 | C-3 | C-4 | C-5 | C-6 | C-7 | C-8 | C-9 |
| Black Ink | K-1 | K-2 | K-3 | K-4 | K-5 | K-6 | K-7 | K-8 | K-9 |
| Light Magenta Ink | Lm-1 | Lm-2 | Lm-3 | Lm-4 | Lm-5 | Lm-6 | Lm-7 | Lm-8 | Lm-9 |
| Light Cyan Ink | Lc-1 | Lc-2 | Lc-3 | Lc-4 | Lc-5 | Lc-6 | Lc-7 | Lc-8 | Lc-9 |
| Viscosity of Respective Inks (mPa · s) | 8 | 10 | 15 | 20 | 22 | 22 | 25 | 27 | 30 |
| Surface Tension of Respective Inks (mN/m) | 38 | 38 | 38 | 38 | 38 | 38 | 38 | 38 | 38 |
| Gloss Unevenness | 2 | 2 | 1 | 1 | 1 | 1 | 1 | 1 | 1 |

TABLE 7-continued

| | | | | | | | | | |
|---|---|---|---|---|---|---|---|---|---|
| Evaluation Graininess Evaluation | 5 | 5 | 5 | 5 | 5 | 5 | 5 | 5 | 5 |

| | Comparative Example 10 | Comparative Example 11 | Comparative Example 12 | Comparative Example 13 | Comparative Example 14 | Comparative Example 15 | Comparative Example 16 | Comparative Example 17 | Comparative Example 18 |
|---|---|---|---|---|---|---|---|---|---|
| Yellow Ink | Y-10 | Y-11 | Y-12 | Y-13 | Y-14 | Y-15 | Y-16 | Y-17 | Y-18 |
| Magenta Ink | M-10 | M-11 | M-12 | M-13 | M-14 | M-15 | M-16 | M-17 | M-18 |
| Cyan Ink | C-10 | C-11 | C-12 | C-13 | C-14 | C-15 | C-16 | C-17 | C-18 |
| Black Ink | K-10 | K-11 | K-12 | K-13 | K-14 | K-15 | K-16 | K-17 | K-18 |
| Light Magenta Ink | Lm-10 | Lm-11 | Lm-12 | Lm-13 | Lm-14 | Lm-15 | Lm-16 | Lm-17 | Lm-18 |
| Light Cyan Ink | Lc-10 | Lc-11 | Lc-12 | Lc-13 | Lc-14 | Lc-15 | Lc-16 | Lc-17 | Lc-18 |
| Viscosity of Respective Inks (mPa · s) | 32 | 22 | 22 | 22 | 22 | 22 | 22 | 22 | 22 |
| Surface Tension of Respective Inks (mN/m) | 38 | 22 | 23 | 25 | 30 | 35 | 38 | 39 | 40 |
| Gloss Unevenness Evaluation | 2 | 2 | 2 | 2 | 1 | 1 | 1 | 1 | 2 |
| Graininess Evaluation | 5 | 5 | 5 | 5 | 5 | 5 | 5 | 5 | 5 |

TABLE 8

| | Comparative Example 19 | Example 1 | Example 2 | Example 3 | Example 4 | Example 5 | Example 6 | Example 7 | Example 8 |
|---|---|---|---|---|---|---|---|---|---|
| Yellow Ink | Y-1 | Y-2 | Y-3 | Y-4 | Y-5 | Y-6 | Y-7 | Y-8 | Y-9 |
| Magenta Ink | M-1 | M-2 | M-3 | M-4 | M-5 | M-6 | M-7 | M-8 | M-9 |
| Cyan Ink | C-1 | C-2 | C-3 | C-4 | C-5 | C-6 | C-7 | C-8 | C-9 |
| Black Ink | K-1 | K-2 | K-3 | K-4 | K-5 | K-6 | K-7 | K-8 | K-9 |
| Light Magenta Ink | Lm-1 | Lm-2 | Lm-3 | Lm-4 | Lm-5 | Lm-6 | Lm-7 | Lm-8 | Lm-9 |
| Light Cyan Ink | Lc-1 | Lc-2 | Lc-3 | Lc-4 | Lc-5 | Lc-6 | Lc-7 | Lc-8 | Lc-9 |
| Viscosity of Respective Inks (mPa · s) | 8 | 10 | 15 | 20 | 22 | 22 | 25 | 27 | 30 |
| Surface Tension of Respective Inks (mN/m) | 38 | 38 | 38 | 38 | 38 | 38 | 38 | 38 | 38 |
| Gloss Unevenness Evaluation | 3 | 4 | 5 | 5 | 5 | 5 | 5 | 5 | 5 |
| Graininess Evaluation | 1 | 4 | 5 | 5 | 5 | 5 | 5 | 3 | 3 |

| | Comparative Example 20 | Example 9 | Example 10 | Example 11 | Example 12 | Example 13 | Example 14 | Example 15 | Example 16 |
|---|---|---|---|---|---|---|---|---|---|
| Yellow Ink | Y-10 | Y-11 | Y-12 | Y-13 | Y-14 | Y-15 | Y-16 | Y-17 | Y-18 |
| Magenta Ink | M-10 | M-11 | M-12 | M-13 | M-14 | M-15 | M-16 | M-17 | M-18 |
| Cyan Ink | C-10 | C-11 | C-12 | C-13 | C-14 | C-15 | C-16 | C-17 | C-18 |
| Black Ink | K-10 | K-11 | K-12 | K-13 | K-14 | K-15 | K-16 | K-17 | K-18 |
| Light Magenta Ink | Lm-10 | Lm-11 | Lm-12 | Lm-13 | Lm-14 | Lm-15 | Lm-16 | Lm-17 | Lm-18 |
| Light Cyan Ink | Lc-10 | Lc-11 | Lc-12 | Lc-13 | Lc-14 | Lc-15 | Lc-16 | Lc-17 | Lc-18 |

TABLE 8-continued

| | | | | | | | | | |
|---|---|---|---|---|---|---|---|---|---|
| Viscosity of Respective Inks (mPa · s) | 32 | 22 | 22 | 22 | 22 | 22 | 22 | 22 | 22 |
| Surface Tension of Respective Inks (mN/m) | 38 | 22 | 23 | 25 | 30 | 35 | 38 | 39 | 40 |
| Gloss Unevenness Evaluation | 3 | 4 | 4 | 4 | 5 | 5 | 5 | 5 | 4 |
| Graininess Evaluation | 1 | 3 | 4 | 4 | 5 | 5 | 5 | 5 | 3 |

As seen from Table 7, in the case where the relative relationship among the positions of each color head was an array in which nozzles of each color head are aligned on the same scanning line, even when any one of the inks was used, good graininess was exhibited but, gloss banding was at an unacceptable level.

On the other hand, as seen from Table 8, when the relative relationship among the positions of each color head of the present invention was employed, good results were shown in gloss banding. However, when the viscosity of the ink was less than 10 mPa·s or more than 30 mPa·s, great deterioration in graininess was observed. Meanwhile, when the viscosity of the ink was in the range of 10 to 30 mPa·s, a good image with low graininess and small gloss banding could be obtained.

Further, it is found that better images with reduced graininess can be obtained in the case where the viscosity is in the range of 15 to 25 mPa·s, and better results can be obtained in the case where the surface tension is in the range of 23 to 39 mN/m. Particularly, when the surface tension is in the range of 30 to 39 mN/m, it is found that particularly preferable results can be obtained.

Example 17

The test was performed in the same manner as in Example 1 except that the nozzle density was 600 npi and 5 kHz. Even when the relative relationship among the positions of each color head is an array in which nozzles of each color head are aligned on the same scanning line, gloss banding is relatively small in comparison with the case of image formation with the nozzle arrangement and discharge waveform (100 npi, 30 kHz) in Example 1. Accordingly, it could be confirmed that the effect was relatively small when the relative relationship among the positions of each color head was employed, but the effect of the present invention, that is, an image with low graininess and small gloss banding could be obtained.

Example 18

The test was performed in the same manner as in Example 1 except that the scanning speed of the inkjet head was 0.8 m/s. Even when the relative relationship among the positions of each color head is an array in which nozzles of each color head are aligned on the same scanning line, gloss banding is relatively small in comparison with the scanning speed (1.0 m/s) of Example 1. Accordingly, it could be confirmed that the effect was relatively small when the relative relationship among the positions of each color head was employed, but the effect of the present invention, that is, an image with low graininess and small gloss banding could be obtained.

Examples 19 to 34 and Comparative Examples 21 to 40

Figure 2:
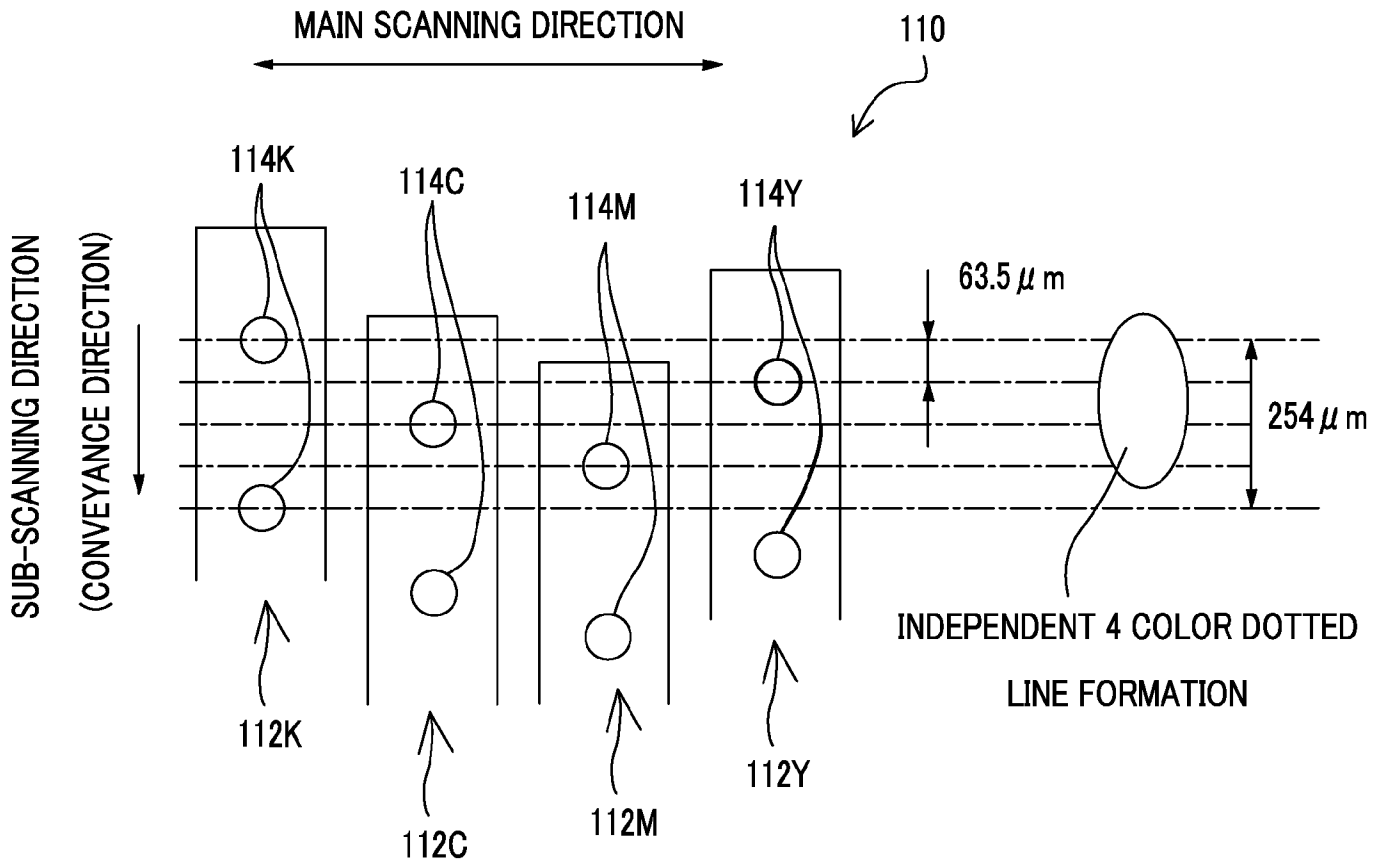
FIG. 2 is an enlarged schematic view showing another example of the inkjet head suitably used in the present invention.

Images were formed and evaluated in the same manner as in Examples 1 to 16 and Comparative Examples 1 to 20 except that the light cyan ink and the light magenta ink among the inks of the six colors used in Examples 1 to 16 and Comparative Examples 1 to 20 were not used and the relative relationship among the positions of each color head was changed to the nozzle arrangement of each color head shown in FIG. 1. The evaluation results are shown in Tables 9 and 10.

Specifically, according to the conditions of the images A and B and the temporary curing illumination intensity condition B, results obtained by forming images under the condition of the relative relationship A among the positions of each color head are shown in Table 9 (Comparative Examples 21 to 38).

In the same manner, according to the conditions of the images A and B and the temporary curing illumination intensity condition B, results obtained by forming images under the condition of the relative relationship B among the positions of each color head are shown in Table 10 (Examples 19 to 34 and Comparative Examples 39 and 40).

From Tables 9 and 10, it was found that the same results were obtained in Examples 19 to 34 and Comparative Examples 21 to 40 as in Examples 1 to 16 and Comparative Examples 1 to 20.

TABLE 9

| | Comparative Example 21 | Comparative Example 22 | Comparative Example 23 | Comparative Example 24 | Comparative Example 25 | Comparative Example 26 | Comparative Example 27 | Comparative Example 28 | Comparative Example 29 |
|---|---|---|---|---|---|---|---|---|---|
| Yellow Ink | Y-1 | Y-2 | Y-3 | Y-4 | Y-5 | Y-6 | Y-7 | Y-8 | Y-9 |
| Magenta Ink | M-1 | M-2 | M-3 | M-4 | M-5 | M-6 | M-7 | M-8 | M-9 |
| Cyan Ink | C-1 | C-2 | C-3 | C-4 | C-5 | C-6 | C-7 | C-8 | C-9 |

TABLE 9-continued

| | | | | | | | | | |
|---|---|---|---|---|---|---|---|---|---|
| Black Ink | K-1 | K-2 | K-3 | K-4 | K-5 | K-6 | K-7 | K-8 | K-9 |
| Viscosity of Respective Inks (mPa · s) | 8 | 10 | 15 | 20 | 22 | 22 | 25 | 27 | 30 |
| Surface Tension of Respective Inks (mN/m) | 38 | 38 | 38 | 38 | 38 | 38 | 38 | 38 | 38 |
| Gloss Unevenness Evaluation | 2 | 2 | 1 | 1 | 1 | 1 | 1 | 1 | 1 |
| Graininess Evaluation | 5 | 5 | 5 | 5 | 5 | 5 | 5 | 5 | 5 |

| | Comparative Example 30 | Comparative Example 31 | Comparative Example 32 | Comparative Example 33 | Comparative Example 34 | Comparative Example 35 | Comparative Example 36 | Comparative Example 37 | Comparative Example 38 |
|---|---|---|---|---|---|---|---|---|---|
| Yellow Ink | Y-10 | Y-11 | Y-12 | Y-13 | Y-14 | Y-15 | Y-16 | Y-17 | Y-18 |
| Magenta Ink | M-10 | M-11 | M-12 | M-13 | M-14 | M-15 | M-16 | M-17 | M-18 |
| Cyan Ink | C-10 | C-11 | C-12 | C-13 | C-14 | C-15 | C-16 | C-17 | C-18 |
| Black Ink | K-10 | K-11 | K-12 | K-13 | K-14 | K-15 | K-16 | K-17 | K-18 |
| Viscosity of Respective Inks (mPa · s) | 32 | 22 | 22 | 22 | 22 | 22 | 22 | 22 | 22 |
| Surface Tension of Respective Inks (mN/m) | 38 | 22 | 23 | 25 | 30 | 35 | 38 | 39 | 40 |
| Gloss Unevenness Evaluation | 2 | 2 | 2 | 2 | 1 | 1 | 1 | 1 | 2 |
| Graininess Evaluation | 5 | 5 | 5 | 5 | 5 | 5 | 5 | 5 | 5 |

TABLE 10

| | Comparative Example 39 | Example 19 | Example 20 | Example 21 | Example 22 | Example 23 | Example 24 | Example 25 | Example 26 |
|---|---|---|---|---|---|---|---|---|---|
| Yellow Ink | Y-1 | Y-2 | Y-3 | Y-4 | Y-5 | Y-6 | Y-7 | Y-8 | Y-9 |
| Magenta Ink | M-1 | M-2 | M-3 | M-4 | M-5 | M-6 | M-7 | M-8 | M-9 |
| Cyan Ink | C-1 | C-2 | C-3 | C-4 | C-5 | C-6 | C-7 | C-8 | C-9 |
| Black Ink | K-1 | K-2 | K-3 | K-4 | K-5 | K-6 | K-7 | K-8 | K-9 |
| Viscosity of Respective Inks (mPa · s) | 8 | 10 | 15 | 20 | 22 | 22 | 25 | 27 | 30 |
| Surface Tension of Respective Inks (mN/m) | 38 | 38 | 38 | 38 | 38 | 38 | 38 | 38 | 38 |
| Gloss Unevenness Evaluation | 3 | 4 | 5 | 5 | 5 | 5 | 5 | 5 | 5 |
| Graininess Evaluation | 1 | 4 | 5 | 5 | 5 | 5 | 5 | 3 | 3 |

| | Comparative Example 40 | Example 27 | Example 28 | Example 29 | Example 30 | Example 31 | Example 32 | Example 33 | Example 34 |
|---|---|---|---|---|---|---|---|---|---|
| Yellow Ink | Y-10 | Y-11 | Y-12 | Y-13 | Y-14 | Y-15 | Y-16 | Y-17 | Y-18 |
| Magenta Ink | M-10 | M-11 | M-12 | M-13 | M-14 | M-15 | M-16 | M-17 | M-18 |
| Cyan Ink | C-10 | C-11 | C-12 | C-13 | C-14 | C-15 | C-16 | C-17 | C-18 |
| Black Ink | K-10 | K-11 | K-12 | K-13 | K-14 | K-15 | K-16 | K-17 | K-18 |
| Viscosity of | 32 | 22 | 22 | 22 | 22 | 22 | 22 | 22 | 22 |

TABLE 10-continued

| | | | | | | | | | |
|---|---|---|---|---|---|---|---|---|---|
| Respective Inks (mPa · s) | | | | | | | | | |
| Surface Tension of Respective Inks (mN/m) | 38 | 22 | 23 | 25 | 30 | 35 | 38 | 39 | 40 |
| Gloss Unevenness Evaluation | 3 | 4 | 4 | 4 | 5 | 5 | 5 | 5 | 4 |
| Graininess Evaluation | 1 | 3 | 4 | 4 | 5 | 5 | 5 | 5 | 3 |

This application claims priority under 35 U.S.C. §119 of Japanese Patent application JP 2012-189067, filed on Aug. 29, 2012, the entire contents of which are hereby incorporated by reference.

What is claimed is:

1. An inkjet recording method comprising:

preparing an inkjet recording apparatus including an inkjet head that has N (N≥4) nozzle arrays, so as to respectively discharge inks of at least four colors of cyan, magenta, yellow and black, having nozzles arranged in a first direction at a predetermined pitch P for discharging a curable ink which is cured by providing active energy, each of the nozzle arrays is arranged to be shifted in the first direction so as to have distances of more than 0 among virtual lines each of which is extending from each nozzle in a second direction perpendicular to the first direction, an active energy providing unit that provides active energy to ink droplets discharged from the nozzles and dropped onto a recording surface of a recording medium, a holding unit that arranges the inkjet head and the active energy providing unit in the second direction and holds them, a scanning unit that causes the holding unit to relatively perform scanning on the recording medium in the second direction, a movement unit that causes the holding unit and the recording medium to relatively move in the first direction in each scan by the scanning unit, and a control unit that causes an image to be formed on the recording surface of the recording medium while causing the inkjet head and the active energy providing unit held by the holding unit to relatively perform scanning on each region of the recording medium by a predetermined number of times;

discharging at least one type of the ink from the inkjet head of the inkjet recording apparatus on the recording medium; and curing the discharged ink by providing active energy from the active energy providing unit, wherein the N (N≥4) nozzle arrays are provided, and the each of the nozzle arrays is arranged to be shifted in the first direction so as to have a distance between two adjacent virtual lines of P/N, and wherein the viscosity of any of the respective inks at 25° C. is 10 to 30 mPa·s.

2. The inkjet recording method according to claim 1, wherein the viscosity of any of the respective inks at 25° C. is 15 to 25 mPa·s.

3. The inkjet recording method according to claim 2, wherein the surface tension of any of the respective inks at 25° C. is 30 to 39 mN/m.

4. The inkjet recording method according to claim 3, wherein a nozzle density of the inkjet head is 100 npi or less, and discharge frequency is 10 kHz or more.

5. The inkjet recording method according to claim 4, wherein a scanning speed of the inkjet head is 0.9 m/s or more in the discharging step.

6. The inkjet recording method according to claim 1, wherein the surface tension of at least one type of the ink at 25° C. is 23 to 39 mN/m.

7. The inkjet recording method according to claim 1, wherein the surface tension of any of the respective inks at 25° C. is 23 to 39 mN/m.

8. The inkjet recording method according to claim 1, wherein the surface tension of any of the respective inks at 25° C. is 30 to 39 mN/m.

9. The inkjet recording method according to claim 1, wherein a nozzle density of the inkjet head is 100 npi or less, and discharge frequency is 10 kHz or more.

10. The inkjet recording method according to claim 1, wherein a scanning speed of the inkjet head is 0.9 m/s or more in the discharging step.

11. The inkjet recording method according to claim 1, wherein any of the respective inks contains an oligomer.

12. The inkjet recording method according to claim 11, wherein the oligomer is urethane (meth)acrylate.

13. A printed material obtained by the inkjet recording method according to claim 1.

14. The inkjet recording method according to claim 1, wherein the inkjet head has N (N≥5) nozzle arrays, and wherein every shift of adjacent nozzle arrays is (2×P/N) or more.

15. The inkjet recording method according to claim 1, wherein the inks contain an N-vinylcaprolactam.

16. The inkjet recording method according to claim 1, wherein the inks contain a cyclic trimethylolpropane formal acrylate.

* * * * *